US007780170B2

(12) United States Patent
Wong et al.

(10) Patent No.: US 7,780,170 B2
(45) Date of Patent: Aug. 24, 2010

(54) EAST-WEST CASINO BASED UPON CHINESE POKER DECK

(75) Inventors: Jacob Y. Wong, Goleta, CA (US); Roy L. Anderson, Glendale, CA (US)

(73) Assignee: Gamelot, Inc., Goleta, CA (US)

( * ) Notice: Subject to any disclaimer, the term of this patent is extended or adjusted under 35 U.S.C. 154(b) by 153 days.

(21) Appl. No.: 11/484,043

(22) Filed: Jul. 10, 2006

(65) Prior Publication Data

US 2006/0249907 A1 Nov. 9, 2006

Related U.S. Application Data

(63) Continuation-in-part of application No. 11/479,554, filed on Jun. 29, 2006, now Pat. No. 7,360,763, and a continuation-in-part of application No. 11/128,529, filed on May 14, 2005, now Pat. No. 7,434,807, which is a continuation-in-part of application No. 11/058,471, filed on Feb. 14, 2005, now abandoned, said application No. 11/479,554 is a continuation-in-part of application No. 11/058,471, filed on Feb. 14, 2005, now abandoned, application No. 11/484,043, which is a continuation-in-part of application No. 10/975,775, filed on Oct. 28, 2004, now abandoned, which is a continuation-in-part of application No. 10/941,513, filed on Sep. 15, 2004, now abandoned, and a continuation-in-part of application No. 10/941,514, filed on Sep. 15, 2004, now abandoned, which is a continuation-in-part of application No. 10/919,092, filed on Aug. 16, 2004, said application No. 10/941,513 is a continuation-in-part of application No. 10/919,092, filed on Aug. 16, 2004.

(51) Int. Cl.
*A63F 1/00* (2006.01)

(52) U.S. Cl. ..... 273/274; 273/292

(58) Field of Classification Search ..... 273/292, 273/274, 309, 142 H, 142 HA, 143 R, 138.2; 463/12, 13, 20, 31
See application file for complete search history.

(56) References Cited

U.S. PATENT DOCUMENTS 442,683 A * 12/1890 Kennedy ..... 194/295

(Continued)

OTHER PUBLICATIONS

Majong Tiles at Wikipedia website, http://en.wikipedia.org/wiki/Mahjong_tiles, 2001.*

Asian Games:The Art of Contest, Asia Society, p. 216-223, 2004.*

*Primary Examiner*—William M Pierce
(74) *Attorney, Agent, or Firm*—Roy L Anderson; Wagner, Anderson & Bright, LLP

(57) ABSTRACT

An East-West casino offers two or more gambling games in which at least one game involves a Feng Shui element of chance and the other involves either a game based upon a new Chinese Poker Deck of cards or a video slot machine having a carousel in which two or more wheels rotate in opposite directions and a random event associated with the two or more wheels is used in connection with a payout or bonus round of the video slot machine. The game involving a Feng Shui element of chance can be a Yin-Yang roulette game or a video slot machine or a Feng Shui keno machine while a game based upon the Chinese Poker Deck may be a poker game and the casino itself may be a website. The video slot machine can use a carousel in which two or more wheels rotating in opposite directions.

14 Claims, 32 Drawing Sheets

U.S. PATENT DOCUMENTS

| | | | | | |
|---|---|---|---|---|---|
| 1,554,834 | A * | 9/1925 | Babcock | 273/306 |
| 1,581,859 | A * | 4/1926 | McLaen New | 273/306 |
| 4,147,363 | A * | 4/1979 | Lee et al. | 273/304 |
| 4,480,840 | A * | 11/1984 | Chang | 273/292 |
| 5,522,595 | A * | 6/1996 | Wong | 273/292 |
| 5,752,881 | A * | 5/1998 | Inoue | 463/20 |
| 6,003,869 | A * | 12/1999 | Kuo | 273/292 |
| 6,336,858 | B1 * | 1/2002 | Yoseloff | 463/13 |
| 6,446,973 | B1 * | 9/2002 | Pham | 273/306 |
| 6,598,880 | B2 * | 7/2003 | Addabbo | 273/306 |
| 6,688,598 | B1 * | 2/2004 | Hsi | 273/292 |
| 6,834,857 | B2 * | 12/2004 | Lee et al. | 273/292 |
| 6,988,731 | B2 * | 1/2006 | Inoue | 273/142 H |
| 7,014,191 | B2 * | 3/2006 | Nasco | 273/292 |
| 2004/0155399 | A1 * | 8/2004 | Inoue | 273/138.1 |

* cited by examiner

| LO SHU Hands | SUM | POINT VALUE |
|---|---|---|
| 發 發 發 | | LO SHU |
| 發 南 北 | | LO SHU |
| 东 南 南 | | LO SHU |
| 寿 福 财 | 33 | "3" |
| 康 东 东 | 31 | "1" |
| 西 | 20 | "0" |
| 一 | 6 | "6" |
| 东 | 19 | "9" |
| 西 西 西 | | Busted! |
| 寿 福 南 | | Busted! |

Figure 7

Half Fang ("Chicken Chow"):

Scorer Not at "W" location AND
Not "W" wind round

One Fang:

Scorer at "E" location OR
It is "E" wind

Two Fang:

Scorer at "W" location <u>AND</u>
It is "W" wind round

Scorer is not at "S" or "N" location <u>AND</u>
It is not "S" or "N" wind round

Three Fang:

Scorer not at "S" location AND
It is not "S" wind round

Scorer not at "E" location AND
It is not "E" or "N" wind round

Four Fang:

Scorer at "S" location OR
It is "S" wind round

Scorer at "W" location and it is "E" wind round
Scorer at "W" location and it is "W" wind round
Scorer at "E" location and it is "W" wind round
Scorer at "E" location and it is "E" wind round

Five Fang:

Scorer at "N" location and it is "N" wind round

| | | | | | | | | |
|---|---|---|---|---|---|---|---|---|
| 1 | 一 | 丨 | 丶 | 丿 | 乙 | 亅 | 冂 | |
| 2 | 二 | 亠 | 人 | 儿 | 入 | 八 | 冂 | 冖 |
| 冫 | 几 | 凵 | 刀 | 刂 | 力 | 勹 | 匕 | 匚 |
| 十 | 卜 | 卩 | 厂 | 厶 | 又 | 〃 | 宀 | 3 |
| 口 | 土 | 士 | 夂 | 夕 | 大 | 女 | 子 | 宀 |
| 寸 | 小 | 尢 | 尸 | 山 | 川 | 工 | 己 | 巾 |
| 干 | 幺 | 广 | 廴 | 廾 | 弋 | 弓 | 彐 | 彡 |
| 彳 | 心 | 戈 | 戶 | 手 | 支 | 攵 | 文 | 斗 |
| 斤 | 方 | 日 | 曰 | 月 | 木 | 欠 | 止 | 歹 |
| 殳 | 毋 | 比 | 毛 | 氏 | 气 | 水 | 火 | 爪 |
| 父 | 爿 | 片 | 牛 | 犬 | 4 | | | |

| | | | | | | | | |
|---|---|---|---|---|---|---|---|---|
| 王 | 礻 | 耂 | 5 | 玄 | 玉 | 生 | 用 | 田 |
| 疋 | 疒 | 癶 | 白 | 皮 | 皿 | 目 | 矢 | 石 |
| 示 | 禾 | 穴 | 立 | 罒 | 母 | 氷 | 礻 | |
| 6 | 竹 | 米 | 糸 | 羊 | 羽 | 老 | 耒 | 耳 |
| 肉 | 自 | 至 | 舌 | 舟 | 色 | 虫 | 血 | 行 |
| 衣 | 西 | 良 | 7 | 見 | 角 | 言 | 谷 | 豆 |
| 豕 | 貝 | 赤 | 走 | 足 | 疋 | 身 | 車 | 辛 |
| 辰 | 酉 | 里 | 臣 | 8 | 金 | 長 | 門 | 隹 |
| 雨 | 青 | 非 | 食 | 9 | 面 | 革 | 音 | 頁 |
| 飛 | 食 | 首 | 10 | 馬 | 骨 | 高 | 11 | 魚 |
| 鳥 | 黄 | 黒 | 12 | 歯 | 14 | 鼻 | | |

Note: Radicals are arranged by stroke number.

Figure 23

An ensemble of Chinese characters constitutes a "Unit of Meaning". For example:

成 败 得 失

Figure 24

Each Chinese character can be decomposed into a number of unique individual symbols called "Radicals" much like decomposing an English word into its unique alphabetical letters (vowels and consonants). For example

成 → 丿 一 亅 戈

败 → 冂 人 攵

得 → 彳 目 一 寸

失 → 丿 一 大

Figure 25

| Character | Radicals by Number |
|---|---|
| 福 | *1, 2, 3, 4, 16, 27, 36* |
| 壽 | *1, 4, 27, 36, 45, 53* |
| 財 | *1, 3, 4, 7, 16* |
| 康 | *1, 2, 3, 4, 7, 8, 18* |
| 丁 | *1, 7* |

Figure 26

| Famous Chinese Sayings Decomposed by Radicals | | | |
|---|---|---|---|
| 福 | 如 | 東 | 海 |
| *1, 2, 3, 4, 16, 27, 36* | *36, 42* | *1, 7, 8, 14, 16* | *1, 3, 4, 7, 26, 72* |
| 壽 | 比 | 南 | 山 |
| *1, 4, 27, 36, 45, 53* | *25* | *2, 3, 4, 8, 16, 27* | *2, 20* |
| 財 | 源 | 廣 | 進 |
| *1, 3, 4, 7, 16* | *1, 3, 4, 7, 30, 36, 72* | *1,3,4,7,27, 30, 36, 64* | *2, 4, 37, 65* |
| 康 | 悅 | 如 | 神 |
| *1, 2, 3, 4, 7, 8, 18* | *3, 4, 13, 36, 69* | *36, 42* | *1, 2, 3, 4, 16* |
| 丁 | 裔 | 滿 | 堂 |
| *1, 7* | *1, 3, 4, 15, 16, 36* | *1, 2, 14, 16, 20, 72* | *17, 31, 36, 47* |

Figure 27

EAST-WEST CASINO BASED UPON CHINESE POKER DECK

NOTICE OF RELATED APPLICATIONS

The present application is a continuation-in-part application of U.S. Ser. No. 11/479,554, filed Jun. 29, 2006 now U.S. Pat. No. 7,360,763, entitled "Yangtze Hold'em And Other Poker Games Played With A Chinese Poker Deck" and U.S. Ser. No. 11/128,529 filed May 14, 2005 now U.S. Pat. No. 7,434,807, both of which are continuation-in-part applications of U.S. Ser. No. 11/058,471 filed Feb. 14, 2005 now abandoned, entitled "Chinese Poker Deck," all of which are specifically incorporated herein by reference.

The present application is also a continuation-in-part application of U.S. Ser. No. 10/975,775, filed Oct. 28, 2004 now abandoned, which is a continuation-in-part of U.S. patent application Ser. Nos. 10/941,513 and 10/941,514, filed Sep. 15, 2004 now abandoned, which are continuation-in-part applications of U.S. patent application Ser. No. 10/919,092, filed Aug. 16, 2004, the disclosures of all of which are specifically incorporated herein by reference.

FIELD OF THE INVENTION

The present invention is in the field of gaming facilities and operations in the gambling industry. In particular it is a unique concept in the design and operation of a gaming establishment that reflects the fusion of the culture and gambling methods of the East with those of the West.

BACKGROUND OF THE INVENTION

As we, the "earth people" living on this planet, enter into the 21$^{st}$ century, there have been profound changes in world affairs that severely impact the well-being of our lives. One can list a number of such events that led to those changes. But among them three really stand out and they should be given the appropriate recognition and elucidation for their immense effects. The first event has to be the end of the cold war between the Soviet Union and the United States. The end of the cold war has directly led to the breaking up of the Soviet Union and the creation of several independent smaller republics within the former Soviet Empire. Furthermore, the end of the cold war has also completely lifted the strong iron clasp rule by the former Communist power over the so-called "Eastern Bloc" countries in Europe. Such an event has changed many lives, both within and without the former Soviet Union. Many people formerly living under the Soviet rule are today enjoying their political freedom for the first time after many decades. More importantly they have now become productive and free citizens once again in their new environments leading to significant economical gain because of their entrepreneurship and hard work. Thus, there has been a true breath of fresh air and new hope injected into many people living around the world prior to entering into the 21$^{st}$ century.

The second event has to be the birth of the so-called Internet or online communication services starting as early as in the late 1970s even though it took more than two decades (including the notorious "World Wide Wait" period instead of "WWW or World Wide Web" for its ridiculously slow services in the beginning) and a gigantic bubble burst in the capital investment community towards the end of the last century to prove to everybody that it is indeed one of the most important events that has taken place. Needless to say, the advent of the Internet together with the tremendous advances in the silicon chip and the computer software technologies during the past two decades have literally ushered the world into the so-called Information Age. Today so many things are done via the Internet including the buying and selling of goods and services, production planning, raw material sourcing, manufacturing, marketing and sales, quality assurance, customer relations etc., that productivity gain in many industry sectors has never been so high and vibrant. It is primarily a direct result of the dawning of this Information Age discussed above that has led to the third event worth reckoning and elucidating below.

The third event can broadly be described as the globalization of trade, commerce, finance, communication and production of goods and services among literally all the civilized countries of the world including those that are developed, developing or even under-developed. In the layman sense, globalization simply means that all activities involving international commerce, trade, finance, communication and production of goods and services will take place irrespective of continental, national or geographical boundaries as long as they are done in the most efficient and cost-effective manner. The direct consequence of globalization is that goods and services are much cheaper across the board than they were before because of the immense increase in productivity. In other words, countries that possess plenty of cheap labor will automatically be given the opportunity to produce goods or to perform services that are needed worldwide. This globalization-induced gain in overall productivity has led to a significance rise in the standard of living for almost all countries during the past decade, especially those in the third world. However, globalization is by no means a pure blessing, but is actually a two-edged sword. Whereas some countries like China and India have been benefited tremendously by the effects of globalization, other countries like the US, European Union countries and even Japan have suffered significant negative effects like the loss of employment and the closing down of many factories that are no longer needed within their countries. Globalization is presently an on-going process and nobody really knows for sure exactly to where it will eventually lead the world. One thing however is amply clear, at least for the foreseeable future, and that is the strong rise in the economical fortune for China, a phenomenon that has never happened before until recently.

During the past decade or so, as more and more affluent Chinese and Asian gamblers (as a direct result of the phenomenon of globalization discussed above) have come to Las Vegas and Atlantic City to play, there has been a growing sense of opportunity for the casinos to come up with new games in order to attract the attention of these new customers. If these new games can be devised based upon the cultural folklores and ancient concepts that the Chinese and Asians revere, the chance of these new games being enthusiastically accepted by the new corners will be greatly enhanced. Furthermore, if these new games can blend the old and popular Chinese gambling games such as Mahjongg, Tin Gau, Sic Bo and Fan Tan (the so-called "Big Four"), with traditional Western style gambling games such as slot machines, card games, craps and roulette, the so-called gaming fusion of the East and West, then the chance of success should even be greater, especially if such games also still appeal to traditional Western gaming patrons.

While one might think that the creation of new games for casinos in the U.S., based upon the fusion of the culture and gambling methods of both the East and West, should be a natural course of action for casino operators in Las Vegas and Atlantic City, this has not been the case, and it appears that a lot of opportunity is still being left on the table. The reason for this kind of thinking is as follows. First of all, China is a big country with a population approaching 1.4 billion. Assuming the fact that the economical fortune of China will continue to rise during the next one or two decades, then the number of affluent Chinese visitors coming to the US in the future can easily be in the tens of millions. Ordinarily speaking, because of the immense size of the US and the large number of tourist attractions scattered all around the country, there is no particular reason to believe that the traveling itineraries for most Chinese visitors should include either Las Vegas or Atlantic City as intermediary stops. However, it is a well known fact that Chinese people have loved to play games of chance for centuries, or to put it plainly, they love to gamble. Gambling is literally in their blood, so to say, just like many Irish people love visiting their neighborhood bar for a drink of beer right after work and before heading home. As visitors to the US, therefore, a prime destination for affluent Chinese travelers will no doubt be Las Vegas or Atlantic City, in addition to some other well known sightseeing places in the U.S.

From the above arguments, namely, that the Chinese people are true avid gamblers at heart and that the rising economical fortune of the East, primarily referring to China, will eventually catch up with the West (primarily the US), a never-before-seen opportunity and a rare but realistic scenario in the gaming arena will be unfolding right in front of our eyes. This kind of opportunity is not a pie in the sky. Rather, it is real and it is coming. In order to take full advantage of this enormous financial windfall that should be shortly put in front of the US gaming industry, including casinos operated by the Indian tribes across the country, in addition to those operating in Las Vegas or Atlantic City, only a genuine East-West casino concept will be able to take full advantage of this financial windfall. By an East-West casino we mean a special gaming establishment designed and operated with the idea of fusing gambling methods between the East and the West while also taking into consideration the cultural folklores of Chinese people. Such a casino will appeal strongly not only to the flock of Chinese visitors coming to Las Vegas or Atlantic City, but also to the locals and ordinary American tourists paying their annual homage to the US gaming Mecca. But even to the new Chinese gaming city of Macao, the former Portuguese Colony at the Pearl river delta in China, such an East-West casino concept should equally be popular, not only for the massive Chinese gamblers coming across to Macao from China, but also for millions of foreign travelers coming annually to visit Hong Kong and China as well.

In current luxurious Western resort casino hotels based upon different theme concepts (such as the Venetian which uses the city of Venice as the backdrop or Paris, Paris which uses the famous French city etc.) only the hotel ground layout (both the interior and the exterior), the internal and external decors, restaurants, shopping arcades, concession amenities etc. reflect the resort hotel theme. As far as the gambling games are concerned, they are all practically the same with the same old Western style standbys in resonance with the resort hotel theme. However, while the presently invented East-West casino can certainly include emphasis on hotel amenities, and include themes based upon great cities in the East, its primary focus is upon new and unique casino games that are designed to blend the culture and gaming methods of the East with those of the West and cannot be found elsewhere. Thus, the concept of the currently invented East-West casino is truly innovative and unique and has never been advanced until now, even though the gaming industry has been spending tens of billions of dollars in developing new casinos, and the cost of high-end, world-class casinos today can easily exceed a billion dollars per casino.

SUMMARY OF THE INVENTION

The present invention is generally directed to an East-West casino in which two or more gambling games are offered to players in which at least one game involves a Feng Shui element of chance and the other involves either a game based upon a Chinese Poker Deck of cards (as defined herein) or a video slot machine having a carousel in which two or more wheels rotate in opposite directions and a random event associated with the two or more wheels is used in connection with a payout or bonus round of the video slot machine.

In a first, separate group of aspects of the present invention, the game involving a Feng Shui element of chance can be a Yin-Yang roulette game or a video slot machine (which may at least partially based upon the Chinese Poker Deck) or a Feng Shui keno machine while a game based upon the Chinese Poker Deck may be a poker game and the casino itself may be a website.

In a second, separate group of aspects of the present invention, a video slot machine is described having a carousel in which two or more wheels (which need not be round) rotate in opposite directions and a random event associated with the two or more wheels is used in connection with a payout or bonus round of the video slot machine. At least one additional wheel can be added in which symbols are shuffled. The carousel can be used in a bonus round or be part of a progressive jackpot (which may, for example, be paid when a plurality of radicals from at least one Chinese character is matched).

In a third, separate group of aspects of the present invention, a Yin-Yang roulette game is described in which two balls travel in opposite directions and a player can place bets on either of the two balls or the two balls together. The Yin-Yan roulette game can include symbols representative of a second Feng Shui element of chance and the Chinese games Tin Gau, Mahjongg, Fan Tan and Sic Bo.

In a fourth, separate group of aspects of the present invention, a Feng Shui keno machine is described in which at least one Chinese character is broken down into a plurality of radicals and a payout is at least partially based upon matching the plurality of radicals.

In a fifth, separate group of aspects of the present invention, the Chinese Poker Deck of cards has three different sets of nine cards in three suits of cards, each of the nine cards in one of said three suits of cards bearing a different designation representing the numbers 1 through 9, five different sets of four cards bearing a unique group designation with a hierarchal ranking of from 1 to 5 such that the hierarchal ranking of 1 is higher than 2 which is higher than 3 which is higher than 4 which is higher than 5 which is higher than a designation representing the number 9, and a set of five additional cards with a Feng Shui designation and a unique Feng Shui hierarchal ranking of from 1 to 5 such that the unique Feng Shui hierarchal ranging of 1 is higher than 2 which is higher than 3 which is higher than 4 which is higher than 5.

Accordingly, it is a primary object of the present invention to establish an East-West casino with new and unique casino games that are designed to blend the culture and gaming methods of the East with those of the West in formats that are attractive and exciting to gambling patrons from both Eastern and Western cultures.

This and further objects and advantages will be apparent to those skilled in the art in connection with the drawings and the detailed description of the preferred embodiment set forth below.

BRIEF DESCRIPTION OF THE DRAWINGS

FIG. 7 is a tabulation of point values for three-card hands from the Chinese Poker Deck for playing the game of Lo Shu.

FIG. 23 shows an official radical chart of the Chinese language.

FIG. 24 shows an example of an ensemble of Chinese characters with a Unit of Meaning.

FIG. 25 illustrates the decomposition of each of four Chinese characters shown in FIG. 24 into respective unique radicals.

FIG. 26 lists five common Feng Shui elements with the numbers of the radicals from FIG. 23 that can be combined to make each Feng Shui element.

FIG. 27 lists five celebrated Chinese proverbs related to the five Feng Shui elements shown in FIG. 26 decomposed by radicals from FIG. 23.

DETAILED DESCRIPTION OF THE INVENTION

Figure 1:
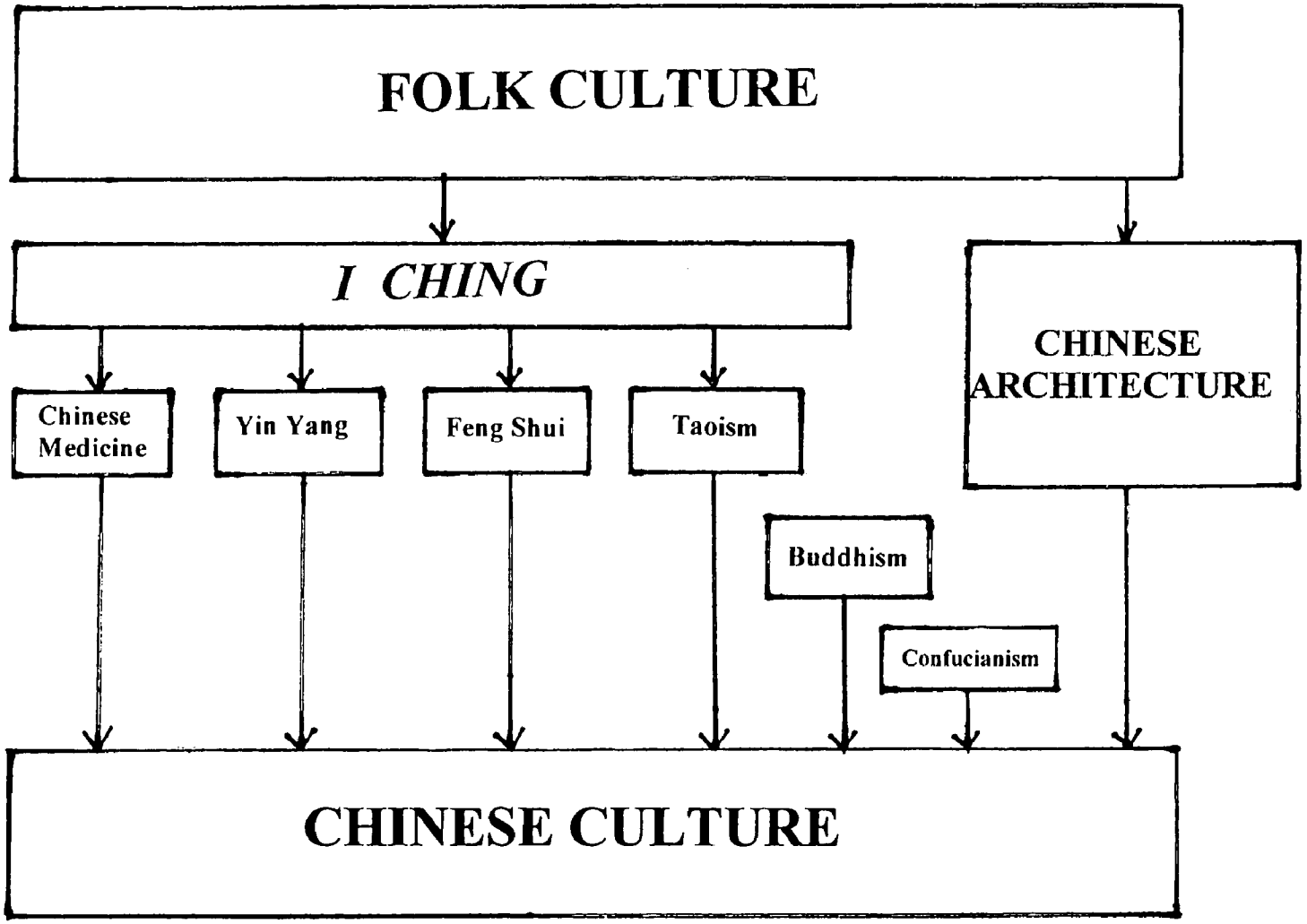
FIG. 1 is a schematic diagram portraying the roots of the Chinese culture.

The present invention is directed to an East-West casino. Although a casino might typically be defined as a building or large room devoted to gambling games or wagering on a variety of events, and such a definition is certainly encompassed within how the term "casino" is used in this description, for the purposes of the present invention, a "casino" can also be defined as a website devoted to gambling games or wagering on a variety of events. For the purposes of the present invention, a "website" can be defined as the entire collection of web pages and other information (such as images, sound, and video files, etc.) that are made available through what appears to users as a single web server or, alternatively, also be defined as a site (location) on a computer network (such as the World Wide Web) that contains a homepage, which is the first document users see when they enter the site, and the site might also contain additional documents and files that are owned and managed by an individual, company, or organization.

As alluded to earlier, although the gaming facility layout, external and internal decors, concession amenities etc. can also be important to maximize the experience of a true East-West casino concept, the focus of attention in the following description is on new and special gambling games that are available for play in this unique establishment. These unique gambling games, devised by taking advantage of the culture and gaming methods of the East and blending them with those of the West, form the necessary foundation in the creation of the presently invented East-West casino. The detailed description of these new and unique gambling games, and the role they play in the current invention of the East-West casino, together with embodiments of many different games, will be set forth in the following paragraphs along with the help of the accompanying drawings.

Finally, to aid in transitioning between the many different topics, ideas, concepts, inventions and games that are discussed below, an outline format has been adopted in the description that follows.

I. Background Information

A. The Traditional Western Casino

Although the present invention is directed to an East-West casino, it is helpful to begin with what is already known in the West—the traditional Western casino typical of those found today in Las Vegas, Nev. and Atlantic City, N.J. While there are many casinos of various sizes, it is safe to assume that all such casinos have one thing in common—slot machines.

Slot machines can be found almost everywhere in present day Western casinos. There are large areas that have nothing but slot machines. There are halls and walkways going from one location to another filled with slot machines. In larger casinos, there are often slot machines that can be played while one is waiting in line for a show or for a restaurant. In Las Vegas, there are some casinos that have nothing but slot machines. In addition, one can also find slot machines in places other than casinos, such as in the Las Vegas McCarren International Airport, so that one can begin and end a trip to Las Vegas by playing slot machines (assuming one wants to do so).

When slot machines first came into existence, they were based upon a mechanical machine in which a series of circular reels with a number of different stops were spun. The number of possible combinations for such a system is determined by multiplying the number of stops in each reel times the number of stops in each other reel in the series. To determine the odds for achieving a given combination involving x reels, one multiplies the number of times the desired symbol or designation appears in each reel times the same for each of the x reels to come up with the number of times that combination can occur. Next, this number is then subtracted from the total number of combinations for all the reels in the series. Finally, the resulting odds are the number of possible desired combinations versus the total number of other combinations. Thus, for example, let's assume a reel has twenty stops and we are dealing with five such reels. Next, let's assume we are trying to get a combination made by a given symbol or designation, such as a 7, and there is 1 7 in the first reel, 5 7s in the second reel, 10 7s in the third reel, 5 7s in the fourth wheel and 5 7s in the fifth wheel. The total number of possible combinations of 7 is $1\times5\times10\times5\times5=1250$ while the total number of possible combinations is $20\times20\times20\times20\times20=3{,}200{,}000$, so the odds for getting 5 7s in a row in this example are 1250 to (3,200,000−1,250), which is the same as 1 to 2559. In such machines, the odds for a given combination can easily be calculated, and multiple winning possibilities can be combined, to determine the odds for a winning spin.

Over time, slot machines moved away from purely mechanical devices to machines in which mechanical reels are controlled by a microprocessor and also to actual machines in which there are no mechanical reels at all and everything is controlled by a microprocessor and displayed on a video screen. Because such machines are controlled by a microprocessor, they can be linked to a computer or network that can provide immediate reports on the activity, performance and condition of such machines, and the profitability and usage of individual machines can easily be monitored, tabulated and analyzed. In addition, when one is dealing with a slot machine in which all of the action is controlled by a microprocessor and displayed on a video screen (hereinafter referred to as a video slot machine), one can design such a machine to take advantage of the possibilities offered by modern day computers and one is no longer tied to the format of rotating reels that must mechanically line up in a single line for game design. This, in turn, has led to a number of differing variations in present day video slot machines.

According to *Casino Games* by Gollehon (Gollehon Books 2004) (ISBN 0-914839-19-5), Chapter 4, pages 111-134, the disclosure of which is specifically incorporated herein by reference), there are three basic styles of reel-type slot machines in use today: the single pay-line, multiple pay-line, and option buy, and most of these machines can be played with single or multiple coins. The single pay-line machine plays a single row of the reels that are spun (typically three to five reels are used today) while multiple pay-lines create multiple potential rows of winning combinations. Option buy machines allow a player to increase the chances of winning by buying more winning symbols instead of buying more lines of potentially winning combinations for a given spin. In addition to these styles of reel-type slot machines, one can also choose to play a slot machine with a jackpot. Again, because of the possibilities offered by microprocessors today, there are different variations of jackpots being offered today. A standard, non-progressive jackpot is a fixed amount jackpot for a given machine whereas an individual progressive jackpot is a jackpot for a given machine that progresses higher and higher until the jackpot is reached while a multiple-progressive jackpot links multiple such machines together so that all of the linked machines feed into a higher linked progressive jackpot. Taken together, all of these variations have created a number of new ways to play slot machines, which offer players a number of betting choices that simply did not exist before microprocessors were used in slot machines.

In addition to increasing the number of ways to bet when playing video slot machines, the use of microprocessors and modern computer tools and programs has allowed designers of video slot machines to incorporate modern graphics and animation into such machines, and such graphics can be as elaborate as that which is commonly found in modern video games. This has also allowed video slot machine manufacturers to incorporate a number of different features into "bonus rounds" of play in which a player proceeds to a separate bonus round when a certain combination of symbols is obtained. Indeed, the bonus round itself can take the form of a whole separate game in which the results of the bonus round determine what additional payout or bonus, if any, is obtained by the player. For example, a bonus round might involve a spinning wheel used to determine the bonus, or the player may be allowed to make certain choices involving chance to determine the bonus.

Video slot machines can also be programmed so that they have "attract" modes to attract players to the machines, or allow for tutorials or descriptions of the game to be played, and they have also adopted the use of touch screens for both betting and navigating through available features and menus. In addition, since video slot machines do not have to use simulated "reels," except to try and keep the look and feel of older mechanical slot machines, they have also branched out into non-reel games, the biggest example of which has to be video poker. Indeed, in *Casino Games*, id., Chapter 5 is dedicated to Video Poker, the disclosure of which is also specifically incorporated herein by reference, and page 135 makes the following assertion:

> "Today, video-poker machines are taking more and more floor space in the casino, receiving play from over 30 percent of all slot players, according to a study commissioned by the Las Vegas Convention and Visitors Authority. That percentage is expected to increase dramatically over the next few years. The report also indicated that 12 percent of all visitors played video-poker machines. That figure is more than keno, more than roulette, and even exceeds craps! There's no doubt about it. Video-poker machines are a huge success story!"

So, it is clear that video slot machines, as well as video poker machines, are a major component of today's Western casino.

While video poker machines bear obvious similarity to video slot machines, it must also be recognized that such machines are based upon poker games, and poker games are, traditionally, based upon the use of a standard-52 card deck that has four suits (clubs, diamonds, hearts and spades) each of which has 13 cards (2, 3, 4, 5, 6, 7, 8, 9, 10, J, Q, K and A, in ascending order of ranking). The difference between video poker games and live poker card games is not only the difference between simulated and physical cards, but also the difference between playing a computer versus playing live opponents and all that is entailed in dealing with such live interaction.

In recent years, poker, and especially the poker game of Texas Hold 'em, have become extremely popular in the United States as a result of televised tournaments and jackpots to the winners of such tournaments (such as the World Series of Poker®) that run in the millions of dollars. At any given time there are numerous clinics and online tournaments to help people learn how to play Texas Hold 'em, and its huge surge in popularity has led to a resurgence and expansion of poker rooms in the larger casinos found in Las Vegas and Atlantic City.

In addition to poker rooms, Western casinos also generally have blackjack tables and Baccarat rooms. Both blackjack and Baccarat are card games that use the standard-52 card deck of cards, but unlike the game of poker, the games are played by betting against the house, and generally the casino acts as a bank. Whereas the game of blackjack is a game of skill in which a player can increase his or her probability of success through application of skillful play, Baccarat is a game of sheer luck involving absolutely no skill whatsoever, but a game in which large sums of money can be wagered in very short periods of time, especially since such games are often played with no limits.

Accordingly, larger Western casinos often have three distinct and different types of games involving the standard-52 card deck of cards, each of which has its own unique appeal.

The other major gambling games that are popular in Western casinos are craps (which is a dice game involving bets made on the roll of two dice), roulette (which is based upon a spinning wheel and a ball that ultimately lands in one of 38 or, less often, 37 spaces in the wheel), keno (which involves picking numbers from 80 possible numbers for a given game in which 20 of those numbers are then randomly drawn and checked for matches) and sports book (which involves betting on the outcome of sporting events).

Taken all together, Western casinos offer a wide variety of betting opportunities in a number of formats that have become relatively standardized, with the most innovation being found in the video betting games, although most of the variations found in such games tend to be of the same general ilk.

It is in this context that one must begin to consider how such formats can be modified, without creating such major modifications that the new formats no longer appeal to Western casino-goers, while still creating something that will appeal to, and attract, Eastern casino-goers, and this is the challenge faced by the present invention.

B. Some Background Information on Chinese Culture

In order to meet this challenge, we have decided to not only look at the major gambling games played in the East, but also to consider the rich Chinese culture so that elements of that culture can be included in the unique fusion that we propose.

To understand the culture of China, a country with over five thousand years of history and three thousand years of civilization, is no small matter. This is especially true for most people living in the Western world since the Chinese language remains as one of the most difficult languages for them to learn and comprehend because the Chinese language has yet to be Romanized into having a Roman alphabet like the Latin languages. Thus, to Westerners, Chinese remains structurally and functionally as an incoherent language as every Chinese character stands alone and bears no relationship whatsoever to other characters in spelling, pronunciation and meaning.

FIG. 1 shows a schematic diagram portraying the roots of the Chinese culture. One can see from FIG. 1 that Chinese culture is an amalgam of ancient folk traditions, namely Feng Shui, theory and practice of Chinese Medicine and three major religions, Taoism, Buddhism and Confucianism. It is interesting to note that the link between Chinese folklores, which cover a five thousand year time span, and Chinese culture, which dates back only three thousand years, is two-pronged. Understandingly so, one prong is Chinese architecture, which represents living conditions and societal standards, while the other prong is I Ching.

Before the theory of relativity, before the discovery of bacteria and viruses, before science was used to track weather systems, and even before compasses were common, people used observation and experience to explain their world. In ancient China observations about climate, geography, star systems, and human health led to the creation of I Ching. The philosophy of the people of ancient China was reflected in great detail by I Ching over three thousand years ago. I Ching is also called the *Book of Changes* because its view of the Universe is that all things change. I Ching is in essence China's greatest classic. It is the source book of much of the traditions and cultural practice of the Chinese dated back literally into antiquity. The concept of Yin Yang (two opposing forces) also finds its root in I Ching. I Ching says that in all good fortune there is the kernel of misfortune, which can rise and overwhelm, and become full-fledged misfortune. It also contends that in misfortune there is simultaneously the seed of great good fortune. Thus Yin and Yang is a particularly Chinese philosophical concept, one that denotes two opposing forces that exist within every living matter. There can be no light without darkness, or life without death.

Once a little bit about the ancient Chinese philosophy of I Ching is understood, one can see from FIG. 1 that Chinese culture is a direct descendent of Feng Shui in addition to Chinese medicine, Chinese architecture and the three primary religions—Taoism, Buddhism and Confucianism. Feng Shui's origin dates back several thousand years to ancient China. The geography of that vast land requires careful consideration when constructing a building since mountain winds can be severe and lower areas are prone to flooding. Hence, Feng Shui means wind and water.

The development of Chinese culture is reflected in Feng Shui. Throughout the development of Chinese civilization, new philosophies were combined with life space placement, beginning with astrology, astronomy and mathematics, which supplied intricate star charts designed to help rulers, farmers and even peasants, build places, public buildings, graveyards, farms and residences. I Ching actually contributed detailed trigrams and maps to Feng Shui practice. The three primary religions of China also added their imprint to Feng Shui.

According to ancient Chinese beliefs, all natural geographical structures have energy. Feng Shui is the science of maximizing natural positive energy by strategic placement. It allows people to exist harmoniously with the earth. Today one tends to use Feng Shui to guide one to look at how the placement of objects can bring harmony to the environment. It can be as simple as placing your couch in the best location in your living room or as complex as placing your house in the best location on your property. Practically speaking, the Chinese folk culture of Feng Shui can be interpreted as an "art of professional placement" or "opportunity engineering."

For the modern Chinese, it is most important for them to seek harmony with Feng Shui, meaning for them to find or identify opportunities for themselves and then to pursue them. The six opportunities most recognized with Feng Shui are, respectively: 1) Wind or the ability to trend events; 2) Personal Wealth; 3) Fertility or the ability to add a male baby to the family; 4) Longevity; 5) Luck as in the winning of a lottery and 6) Health. Thus, one is advised to constantly seek out these opportunities in the hope that they can be realized by executing the right strategies.

In summary, in order to understand Chinese culture, one has to recognize the concepts of Feng Shui and Yin Yang. To the extent that these concepts can be taken into consideration in designing new fusion games for an East-West casino, the cultural bias of Chinese people in favor of these concepts will help increase the acceptance of such games among Chinese peoples.

C. Major Eastern Gambling Games

Apart from incorporating aspects of Chinese culture into new casino games devised for the East-West casino, one can also blend Chinese gaming methods and practices with those of the West to create new fusion games that should also appeal to Chinese people and thus help increase the acceptance of such games among Chinese people as well.

Although Chinese people have been playing gambling games of various constructs for centuries, four games stand out as pillars of Chinese gambling dating back for at least several hundred years. We will refer to these games as the "Big Four" and they are, respectively, Mahjongg, Tin Gau, Sic Bo and Fan Tan.

1. Mahjongg

Mahjongg has been a popular gambling game in China and the Far East for at least several hundred years. It is generally a game to be played among family members and friends at home. During the early '50s, there were Mahjongg parlors in most major casinos in Las Vegas to accommodate gamblers from China and the Far East. But due to the small operating profits obtained by casinos from these Mahjongg parlors, most of them disappeared from the Las Vegas gambling scene starting in the early '70s. By the early '80s in Las Vegas, Mahjongg parlors became nothing but a fond memory of the past. Still, Mahjongg continues to be the number one family gambling game in Asia, particularly in China. Although no gambling is officially allowed within the People's Republic of China, Mahjongg has been tacitly allowed since the Communists took over China back in 1949 because the Chinese people love to play this game so much.

Figure 2:
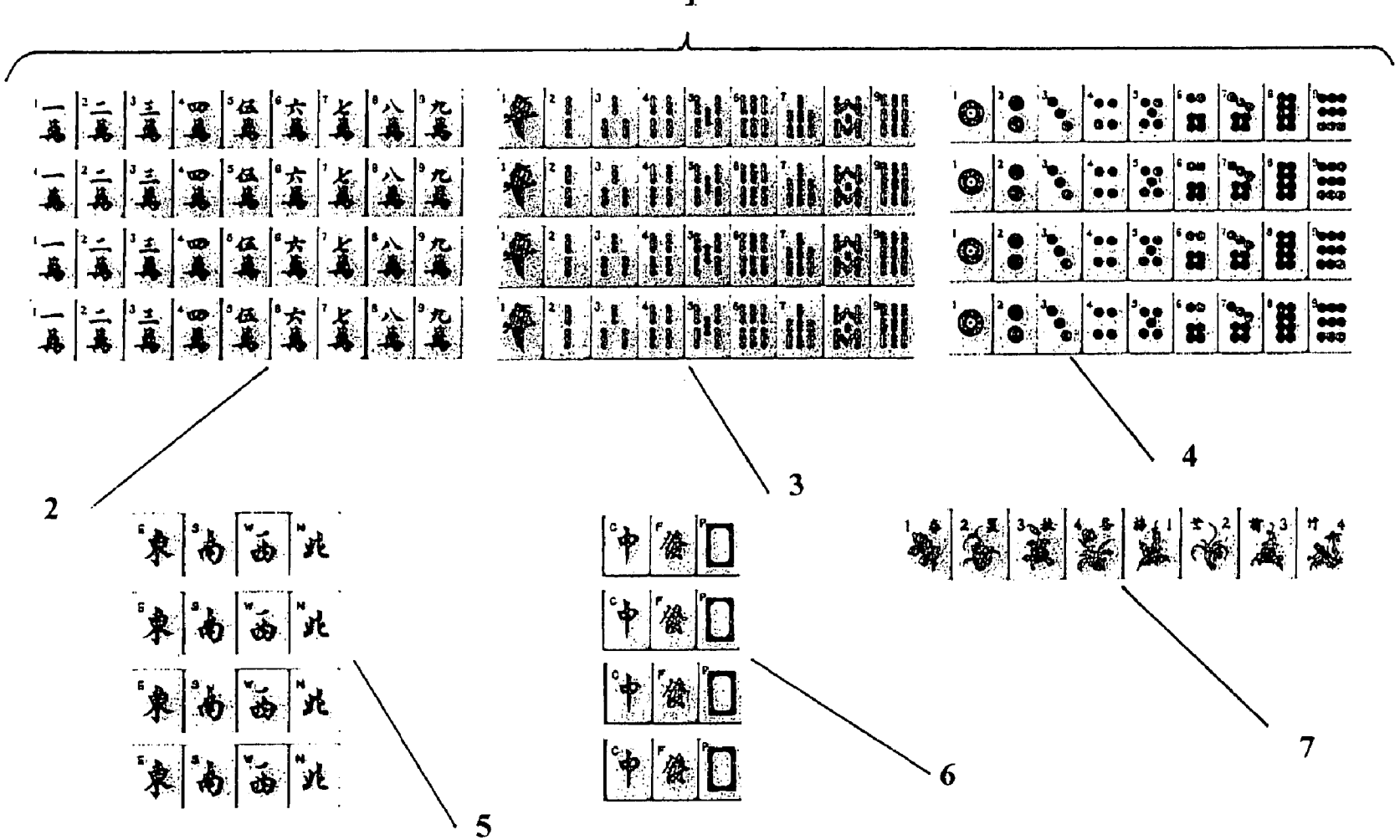
FIG. 2 illustrates the set of tiles for the playing of the Mahjongg game.

FIG. 2 shows the set of tiles 1 for the Mahjongg game. There are a total of 144 tiles in the set. There are three suits of tiles each comprising 27 tiles, namely the "Script" 2, the "Bamboo" 3 and the "Circle" 4. In addition, there are the four wind directions tiles 5 viz. East (E), South (S), West (W) and North (N) with four tiles each direction. Finally there are the three dragon set tiles 6, viz. the "Red Dragon," the "Green Dragon," and the "White Dragon," again with four tiles each. The remaining 8 tiles are the so-called "Flower" tiles 7 which sometimes do not come with the Mahjongg set.

To play the game of Mahjongg, exactly four players are required. The so-called Mahjongg table is a square table with each player sitting respectively at each of the four sides. After the tiles are shuffled, they are formed neatly into four equal line stacks (one line per player) two tiles high. Before the game starts, three dice are thrown (by any player) and the subsequent number that turns out decides which player will be the first banker. The banker throws the three dice again to determine the starting location of the line stacks for the players to orderly collect their tiles in a counterclockwise direction starting with the banker. Each player collects 13 tiles except the banker who starts out with 14. The players then take turns to discard one of the tiles and replenish it by collecting another from the remaining line stacks. This goes on until one of the player stops the game with a winning hand similar to the game of Domino. The amount of winnings that the winning player collects from the others depends upon how good the winning hand is. Like the Western chess game, learning to play Mahjongg is not difficult. But it can take years of practice before one is really good at it.

2. Tin Gau

Figure 3:
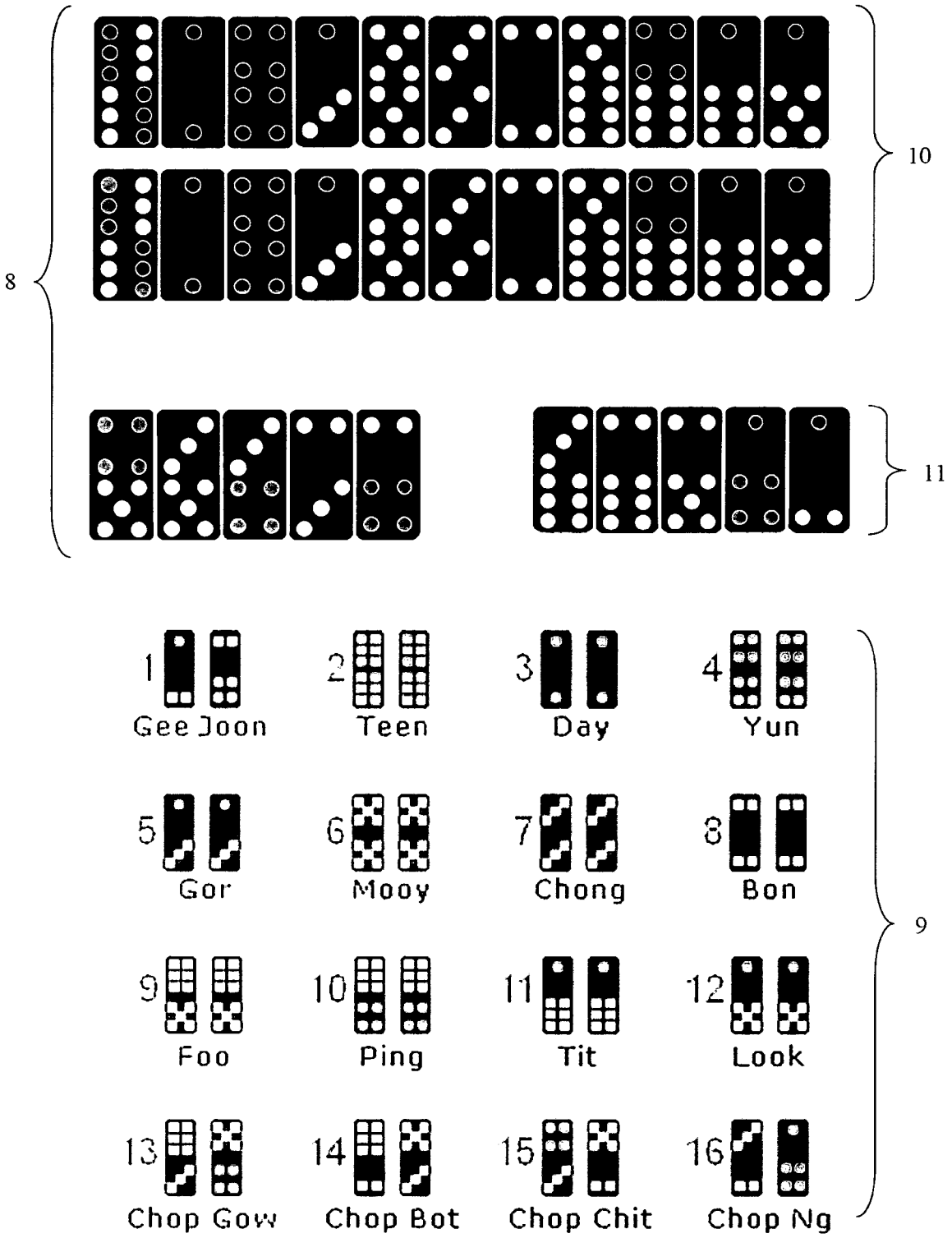
FIG. 3 illustrates the set of tiles for the playing of the Tin Gau game.

FIG. 3 shows the set of tiles 8 for the Chinese gambling game of Tin Gau. The set has 32 tiles and the tiles themselves have white and red dots. Similar to domino tiles, the number of dots on a particular tile indicates a "number designation" for the tile. However, as can be seen from FIG. 3 (read from left to right), the tiles are not ordered in any sequence of increasing or decreasing orders like domino. The reason is that in the Chinese game of Tin Gau, the tile's significance is not necessarily determined by how many red or white dots the tile has. Instead, each tile has its own unique name and has its own unique combinatorial power with other tiles. A simple illustration of this is shown in the bottom half 9 of FIG. 3 where the most common pairing of the tiles (numbering 16) are shown.

It is believed that the Chinese game of Tin Gau has been in existence in some parts of China for over a thousand years. As a matter of fact, the content of the tile set reflects the subtle revelation of the Chinese concept of Yin Yang. The 22 tiles 10 shown as the upper two rows in FIG. 3 are known as the Yin set of tiles. The ten tiles 11 shown as the third row in FIG. 3 are known as the Yang set of tiles. In addition to the pairing of the tiles shown in the bottom half 9 of FIG. 3 which are between the same Yin or Yang set tiles, there are more complicated and unique combinatorial tiles arrangement between Yin set tiles and Yang set tiles. These combinations could be pairs, triplets or even quadruplets. Since the dots on the Tin Gau tiles do not follow the ordering rule of the game of Dominos and each tile has to be remembered for its name, ranking and combinatorial possibilities, learning how to play the game of Tin Gau is much more difficult than learning how to play Mahjongg despite the fact that the latter is more complicated. A simpler gambling game called Pai Gau, which is featured in a number of casinos in Las Vegas and Atlantic City, is a direct derivative of Tin Gau. The game of Pai Gau is commonly played in China and in the Far East and is also quite popular in casinos in Macao, the Chinese gambling city east of Hong Kong and formerly a Portuguese colony.

3. Sic Bo

Sic Bo, known to some people as Tai Sai, means dice pair in Chinese. It is an ancient Chinese game of chance. It may have originally used dice shaken between a plate and an overturned bowl, but today it commonly has three dice in a cage for tumbling. Extremely popular in Asian cultures, this exciting and engaging game is winning new converts in many casinos around the world. Sic Bo is easy to play. The object is to pick the numbers or combinations that will appear on the dice when they come to rest after tumbling. There are 50 different ways to place bets, so players have plenty of choices with a range of payouts—some as high as 180-to-1. In a sense, this game is somewhat similar to the Western game of craps, but it involves many more betting opportunities and combinations due to the use of one additional dice than the game of craps. However, despite this similarity, this game has not yet found its way into traditional Western-style casinos.

4. Fan Tan

Fan Tan is one of the oldest gambling games in China and it is believed that this game dates back to the Chin Dynasty circa 100-200 BC. The game itself is exceedingly simple. The banker starts out separating a pile of beans or pebbles from a much larger pile of the same. The banker then starts separating the beans or pebbles into groups of four. What remains after such groups have been separated until there is a final group which contains either one, two, three or four beans or pebbles, is the so-called winning number for that particular play. Players can either bet outright the exact number that will remain at the end of the separation, namely 1, 2, 3 or 4, and the payoff is 4:1. Alternatively, players can bet two numbers or even three numbers, with correspondingly lesser payoffs.

Now that we have described a little bit about Chinese culture and also summarized the characteristics of some of the most popular gambling games of China played over the past hundreds of years, it is also necessary to understand that while there are some similarities between Sic Bo and craps, Chinese people are generally not familiar with, and generally do not play, most of the Western style gambling games. In addition, except for the game of Baccarat, which is now very popular in casinos in Macao, Chinese people generally do not play games with the standard-52 card deck, and the games of poker and blackjack, despite their enormous popularity in the West, are essentially foreign to the average Eastern gambler.

So, the challenge is to create new games that fuse the major Eastern and Western gambling games, while introducing persons versed in one culture but not the other, with the major games of the other culture. If this can be done, the new games can appeal to gamblers of both cultures and maybe even help introduce the major existing games of each culture to gamblers of the other culture, all in one location.

II. The Chinese Poker Deck

It is clear from the discussion above that a Chinese Poker Deck has to be invented but based upon Eastern cultural thinking and the concept of the original Western 52-card pack in order to take full advantage of the affluent Chinese and Asian gamblers visiting Las Vegas and Atlantic City in coming years. It is without argument that Mahjongg is by far the most popular gambling game in China and the Far East for at least several hundred years. Thus it is prudent that a portion of the unique tiles of the Mahjongg set is used as a basis for forming the Chinese Poker Deck. Because the new deck includes elements of Mahjongg and Chinese culture, it will immediately appeal to Eastern gamblers, but it still must be able to play Western style card games so that it will also appeal to Western gamblers who are used to playing a variety of games involving the standard-52 card deck of cards and are used to the appeal of such games.

A. Composition of the Chinese Poker Deck

A new deck of cards is disclosed that can be used for a variety of different games, some of which are also described herein. The new deck of cards is referred to as the Chinese Poker Deck because, like a traditional poker deck (i.e., a deck of 52 cards, having four suits—clubs, diamonds, hearts and spades—each of which has 13 cards comprised of 2-10, Jack, Queen, King and Ace), it uses 52 cards, but the cards integrate various aspects of traditional Chinese games and culture. The result is a novel deck that allows the East to meet the West, and vice versa.

Figure 4:
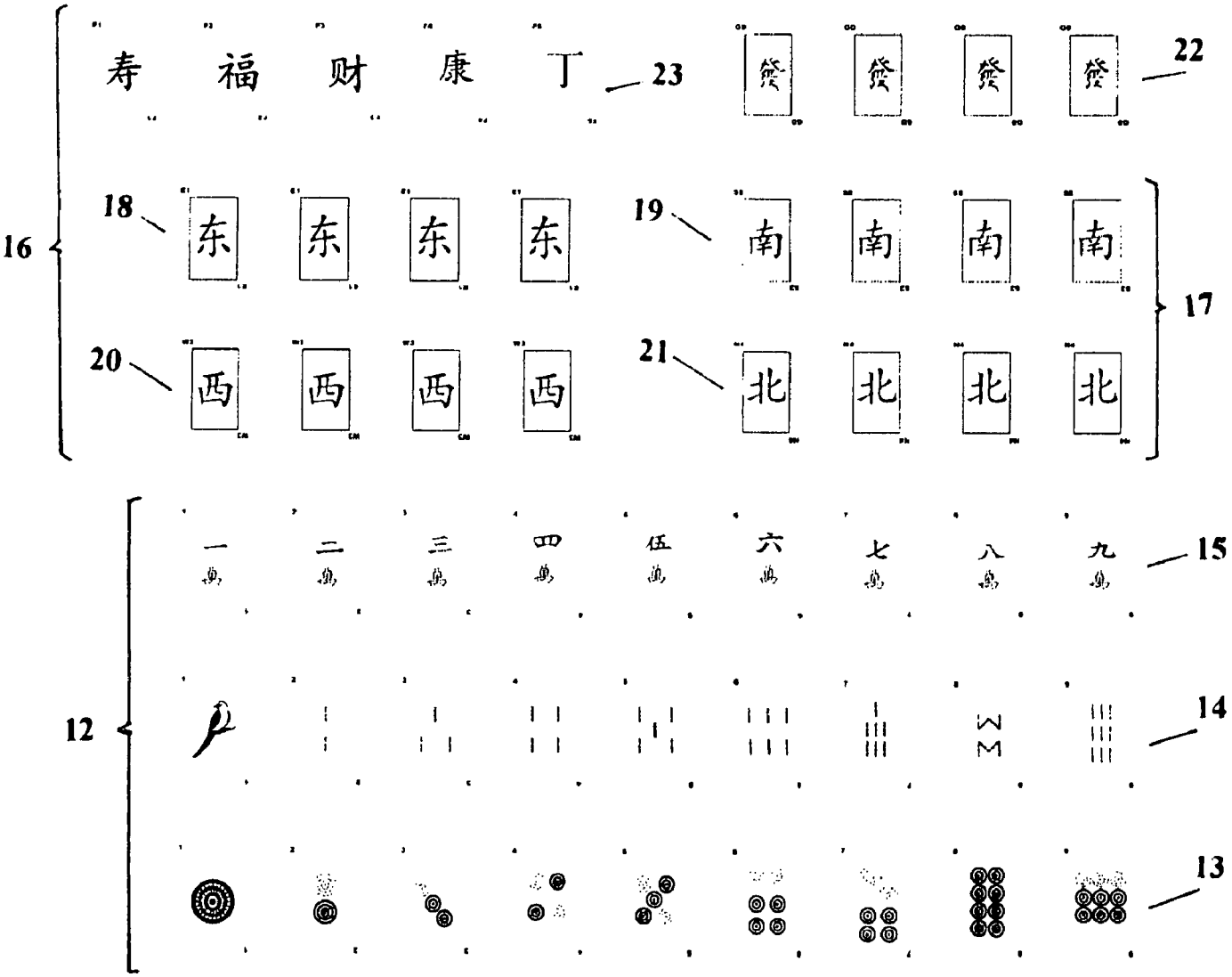
FIG. 4 illustrates The Chinese Poker Deck.
Figure 5:
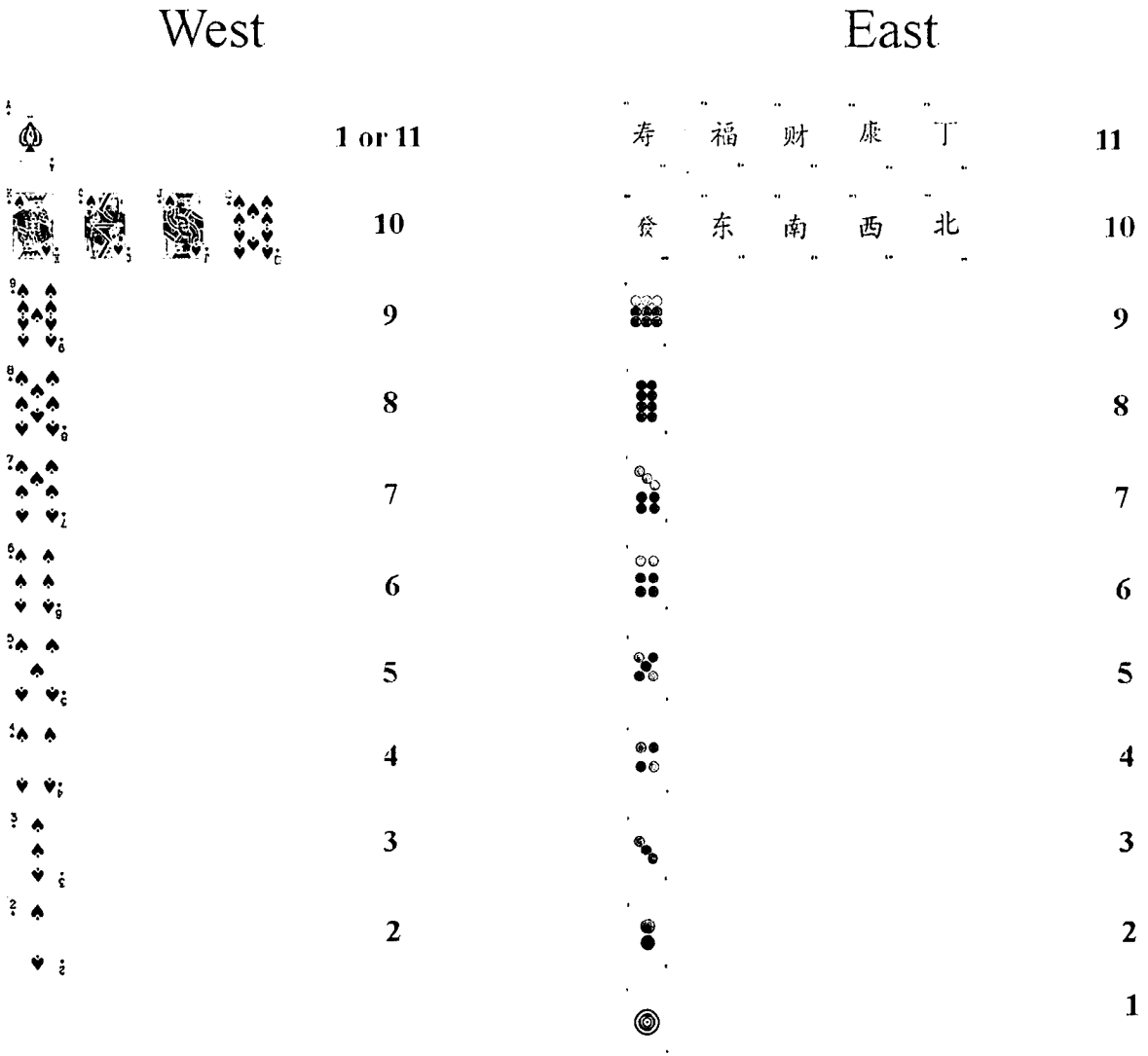
FIG. 5 lists the point numbering convention for both the traditional poker deck and the Chinese Poker Deck.
Figure 6:
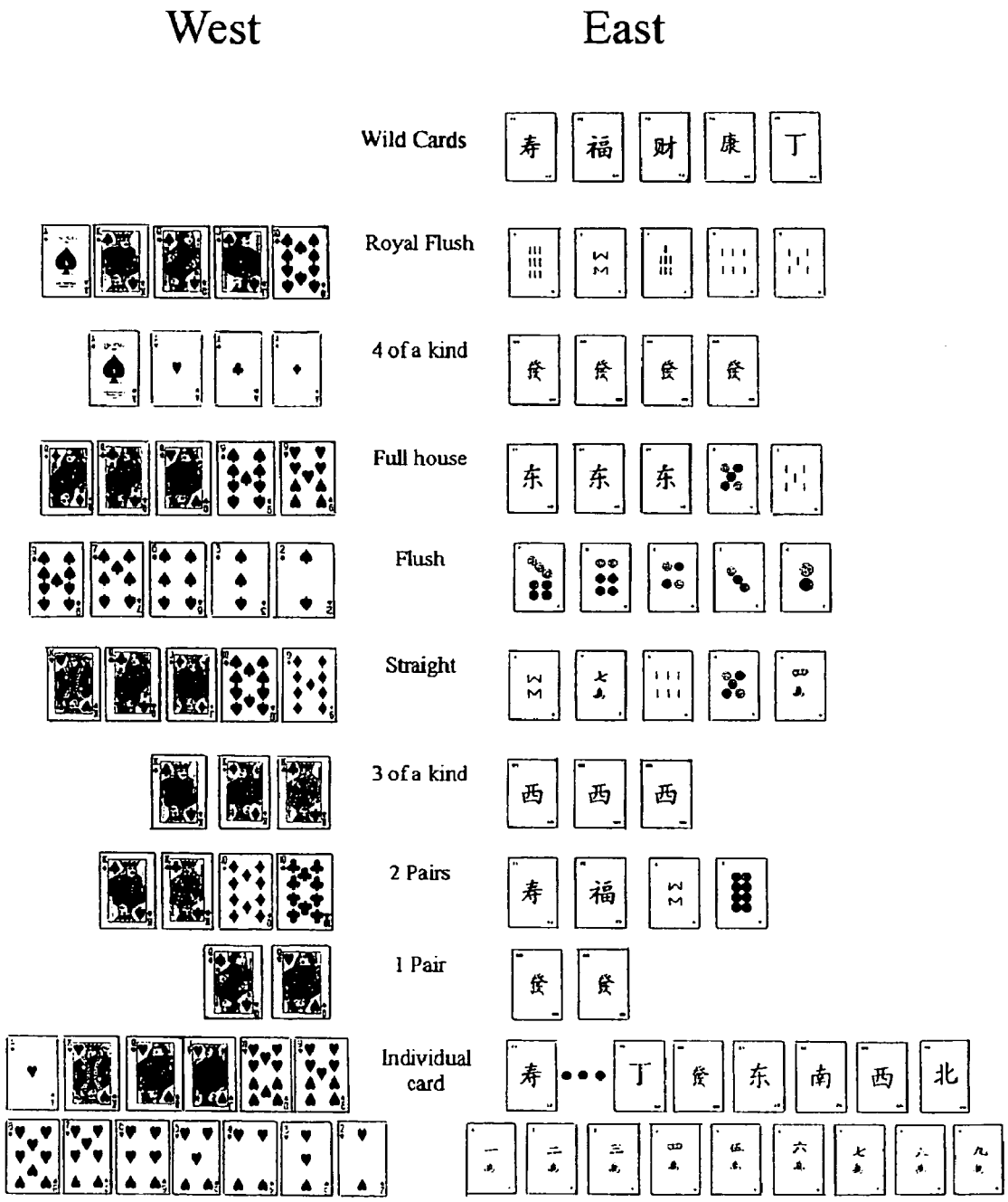
FIG. 6 shows the ranking of the cards in both the traditional poker deck and the Chinese Poker Deck.
Figure 8:
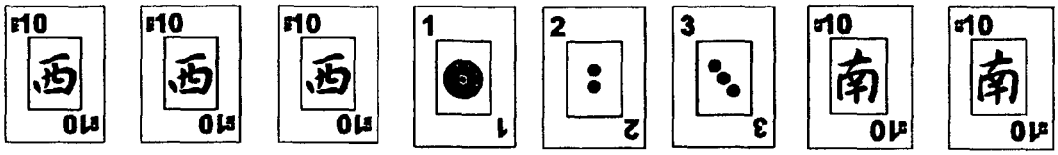
FIGS. 8-12 are depictions of the hands of Half Fang through Five Fang for the game of Wild Mini Mahjongg.
Figure 8:
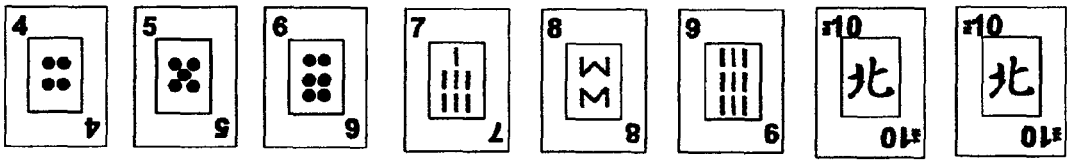
Figure 8:
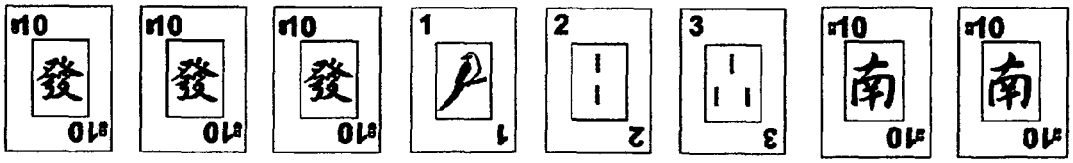
Figure 8:
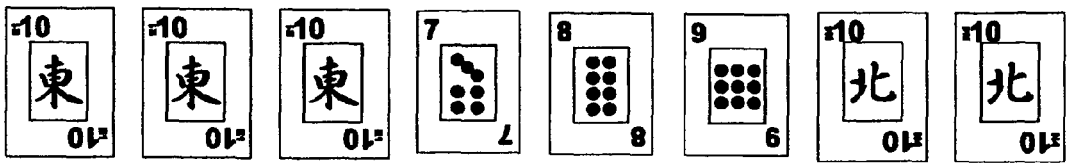
Figure 9:
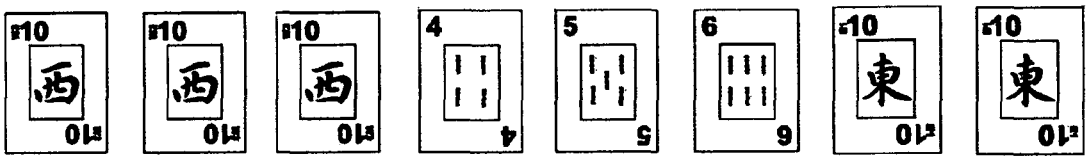
Figure 9:
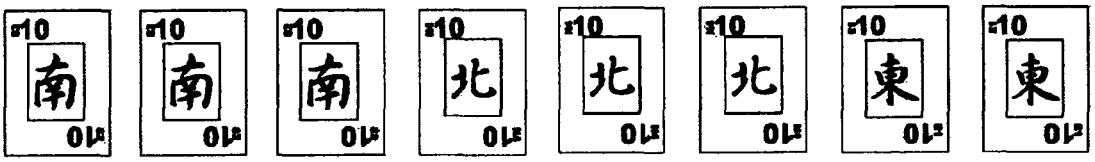
Figure 10:
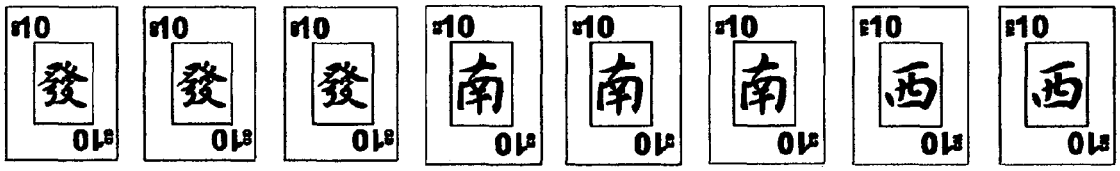
Figure 10:
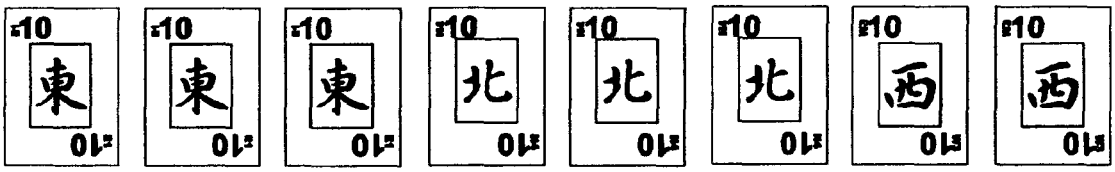
Figure 11:
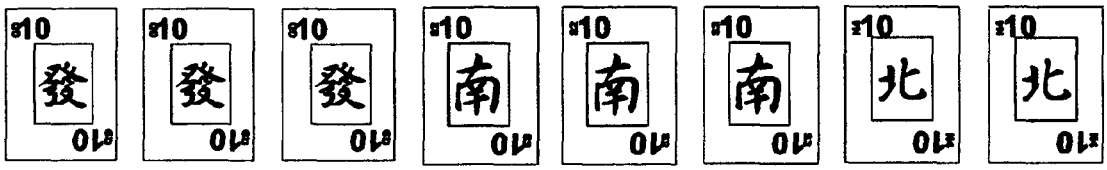
Figure 11:
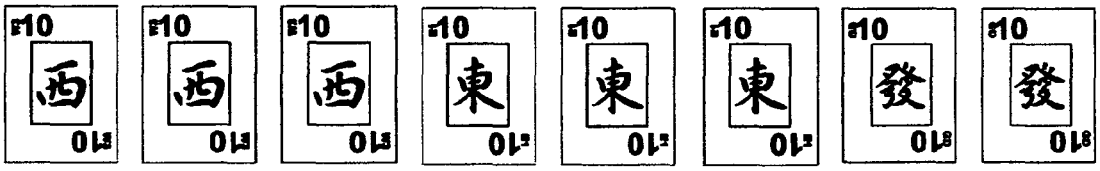
Figure 11:
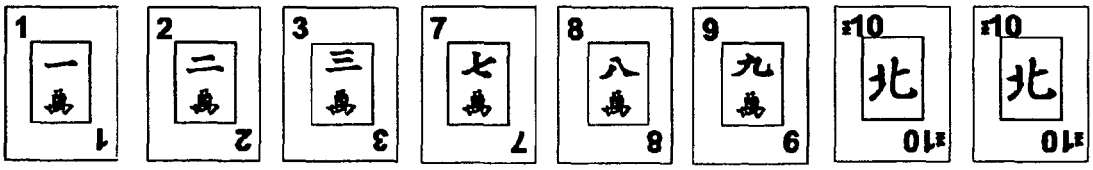
Figure 12:
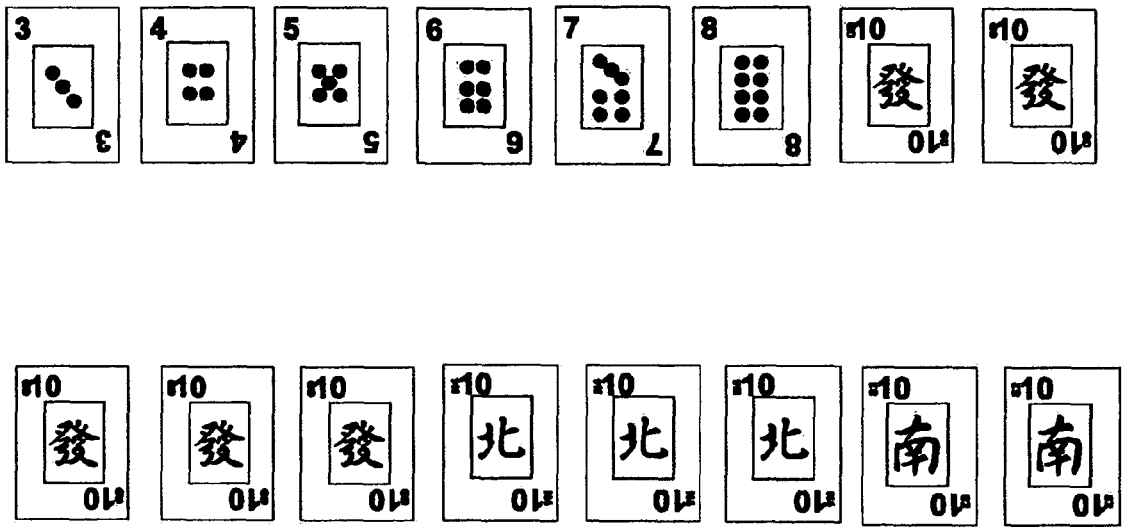
Figure 12:
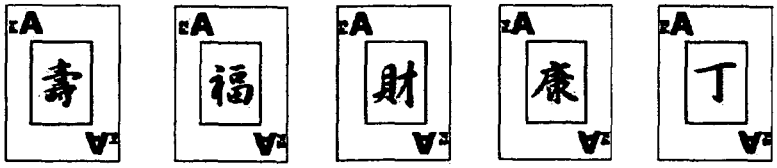

The Chinese Poker Deck is comprised of 27 numbered cards in three suits and 25 additional non-suit cards as shown in FIG. 4. The 27 numbered cards 12 are divided into three groups or suits—circles 13, bamboos 14 and scripts 15—each of which has nine cards numbered from 1 to 9. The 25 additional non-suit cards 16 are divided into 16 wind cards 17 (which is subdivided into four groups representing East 18, South 19, West 20 and North 21 winds, and each wind has four identical cards), 4 Green Dragon cards 22 (each of which is identical) and 5 Feng Shui cards 23. The 5 Feng Shui cards 23 are ranked from 1 to 5, 1 being the highest, and each bears a unique Feng Shui parameter designation which, in an especially preferred embodiment, represents, from 1 to 5, respectively, Longevity, Luck, Wealth, Health and Fertility. The wind and dragon cards might be compared to face cards in a traditional poker deck in that each such card is assigned a value of 10 in games in which the cards need to have a number value, such as in the game of Blackjack, while the five Feng Shui cards are assigned a value of 11 in such games. A comparison of the point numbering convention between the traditional 52-card deck and the Chinese Poker Deck is set forth in FIG. 5 while the rankings of the cards in both decks is set forth in FIG. 6.

The incorporation of the three suits of circles 13, bamboos 14 and scripts 15 (see FIG. 4) into the Chinese Poker Deck ties the deck to the traditional Chinese game of Mahjongg which uses the same three suits. Similarly, Mahjongg also uses the four winds as well as dragons (typically green, red and white). However, unlike Mahjongg, the Chinese Poker Deck uses such symbols and designations in a new context, i.e., the context of a deck of 52 cards. Thus, the Chinese Poker Deck at once invokes a certain feeling of familiarity to one familiar with Mahjongg, while the 52-card deck also invokes a certain feeling of familiarity to one familiar with the traditional poker deck (international 52-card pack).

The Chinese Poker Deck departs from any similarity to Mahjongg by the addition of the five Feng Shui cards 23 (see FIG. 4) which are not found in Mahjongg. Because of the pull of Feng Shui in the Chinese and Eastern culture, even though Feng Shui is not incorporated into Mahjongg, its addition to the Chinese Poker Deck brings an additional type of familiarity to those familiar with its precepts. In addition, because there are 5 such cards, it allows the Chinese Poker Deck to be perfectly rounded out to 52 cards so as to maintain the same number of cards found in the traditional poker deck, which is very desirable for playing poker.

The ramifications of the Chinese Poker Deck are profound. The Chinese Poker Deck can be used to play traditional Western poker games, although the odds and some of the rules (such as values or ordering of hands) will necessarily have to be changed to adapt to the new composition of the deck. While this by itself is interesting, and offers new flavors and variants of games, such could be said for any change to the traditional deck of cards. However, because the Chinese Poker Deck also incorporates ideas found in Mahjongg, it can also be used to play new games that might be analogized as variants of Mahjongg, even though they are totally novel variants in a new medium. And, with the incorporation of the Feng Shui cards, the Chinese Poker Deck opens up totally new possibilities and allows persons familiar with the precepts of Feng Shui to connect with such possibilities on a whole new level. Finally, because all of these variants can be played with the same deck, as one begins playing any of the many games that are possible with the Chinese Poker Deck, one becomes familiar with the new deck, and possibly becomes more open to playing other games with the same deck. In this way, a person familiar with Western games may be drawn to more Eastern types of games, and vice versa, thus creating an intersection of the two cultures in a single deck of cards.

B. Poker Games with the Chinese Poker Deck

Although there are literally hundreds of variations on how poker is played, there are three main categories of popular variations.

First, there is draw poker, in which a certain number of cards are dealt, there is usually a round of betting, and then players still remaining in the game are given the option of drawing one or more additional cards, after which another round of betting ensues. A popular example of draw poker is 5 card draw.

Second, there is stud poker, in which a certain number of cards are dealt one at a time to players, usually with certain cards dealt face up, but the players have no option of discarding cards, and betting rounds ensue in accordance with a pre-selected set of rules for the game after players have been dealt certain cards (in other words, while a player may fold, if two players stay in to the final card, the outcome of the hand will not change, as it might in draw poker, as a result of a player choice, such as deciding how many and which cards to discard). A popular example of stud poker is 7 card stud poker.

Third, there is community card poker, in which players make a hand from cards dealt to individual players and a number of "community cards" (which are usually dealt face up) that can be used by all players to make a hand in accordance with a pre-selected set of rules for the game. A popular example of community card poker is Texas Hold 'Em, also known as Hold 'Em or holdem. In Texas Hold 'Em, each player receives two cards face down, and then three community cards are turned face up, followed by a fourth community card turned face up, followed by a fifth and final community card turned face up, with betting rounds ensuing at each stage of the process. Indeed, Texas Hold 'Em has become so popular in the United States today that it is regularly played in tournaments in casinos, card clubs and online websites, and some of the tournaments, such as the World Series of Pokers, are televised events with the winner taking millions of dollars in prize money.

In view of the widespread popularity of poker, and its many variants, for a new Chinese Poker Deck to be successful, it must be capable of being used to play poker games, including the main categories of its popular variations, for such a deck to be truly successful in fusing concepts from both the East and the West into a deck that can be universally accepted.

1. Playing Existing Variations

Before one can play traditional poker games with the Chinese Poker Deck, one must reconcile the fact that the 16 Wind cards, 4 Green Dragon cards and 5 Feng Shui cards do not have suits, while there are only three suits with numbers 1 through 9 instead of four suits with numbers 2 through 10. This means that a poker hand of a straight or a flush can only be made with cards from suit values, not from the 16 Wind cards or the 4 Green Dragon cards. In addition, in order to make a pair, three of a kind or four of a kind with Wind or Green Dragon cards, there must be two, three or four of the identical card (i.e., either EW, SW, WW, NW or GD), and two different Wind cards cannot be combined to make a pair, three of a kind or four of a kind. Because of these differences, certain additional rules are needed for traditional poker games to still be viable and interesting.

The first rule is that the 5 Feng Shui cards are treated as wild cards, which means that a player with a Feng Shui card can designate the Feng Shui card to be any card contained in the Chinese Poker Deck. The result of this rule is that it is now possible to make a straight, a flush, or a straight flush using four numbered cards of appropriate suits plus a Feng Shui card. However, because of the inherent value of a such a wild card, many poker games would no longer be interesting without another rule to counter the effect of such wild cards, and the second rule that provides such counterbalance is that a player can only use one Feng Shui card in a given hand and, if as a result of this rule a player can not make a hand, then the player loses to any other player who can make a hand. Thus, for example, if a first player is playing five card draw and has a GD, a NW, a SW, a 9 of bamboo and a Feng Shui card while a second player has two EW, a SW, a WW and a NW, the first player has the highest hand prior to the draw, because the first player has a pair of GD while the second player only has a pair of EW, which is lower in ranking than a pair of GD. Now, in this same example, if the first player decides to discard the NW, SW and 9 of bamboo and draws two additional GD cards plus one more Feng Shui card, the first player will automatically lose the hand (even though the first player has 4 GD cards) unless the second player draws two or more Feng Shui cards because the first player can not use the second Feng Shui card to make a hand. (If both players cannot make a hand, the particular hand is a draw.)

Thus, although Feng Shui cards are wild, which is a very good thing, too much of a good thing can be very bad for a hand, and this is what gives hope to a player who does not have a Feng Shui card, and also tempers the enthusiasm of a player who does have a Feng Shui card. It is the key rules involving the 5 Feng Shui cards that makes poker games with the Chinese Poker Deck viable and exciting while still keeping the same rules and traditional poker rankings (the lowest ranking being the highest one of a kind, followed by one pair, followed by two pairs, followed by three of a kind, followed by a straight, followed by a flush, followed by a full house, followed by four of a kind, followed by a straight flush—see FIG. 6) that are already familiar to tens of millions of poker players. However, in order to keep the same traditional poker rankings in place, one must also recognize that a wild card introduces the possibility of a hand not found in traditional poker games that do not use wild cards—the possibility of a hand of five of a kind. To maintain traditional rankings, and thus eliminate confusion that might result from recognizing such a hand, another specialized rule for playing traditional poker games with the Chinese Poker Deck is that a hand of five of a kind is not recognized. (Of course, if one wants to play a poker game in which the variant recognizes wild cards, then this rule might not apply, although it would be desirable to specify how such a hand would be ranked vis-à-vis a straight flush to avoid inevitable disputes over such a matter.)

To further illustrate the present invention, a new poker game, called by the trademark name YANGTZE HOLD 'EM, will now be described, which is basically the game of Texas Hold 'em played with the Chinese Poker Deck and the additional rules just described.

Yangtze™ Hold 'em is a community card poker game that is played with the 52-card Chinese Poker Deck (which is being marketed under the trademark Dragon Deck™). The game starts to the left of the dealer button. The blind bet(s) are made from the position(s) left of the dealer button and are forced bets which must be made before the cards are dealt. Two cards (hole cards) are dealt to each player, one at a time, face down, in rotation. This is followed by the first round of betting. A player may check, bet, call, raise or fold. Three cards (the flop) are then dealt face up in the middle of the table as community cards (board cards) and the second round of betting occurs. The fourth community card is dealt face up (the turn), followed by the third round of betting. The final community card (the river) is dealt face up and followed by the fourth (final) round of betting. At the showdown, each player may use any combination of the hole cards and community cards, or may play the board and use no hole cards to make the highest ranking five-card poker hand. The player with the highest ranking five-card poker hand wins the pot. In the event of a tie, the pot is split equally. A player may only use one wild card to make a five-card poker hand and five-of-a-kind is not recognized as a poker hand. If a player cannot make a five-card poker hand and another player can, the player who cannot make a five-card poker hand loses.

A variation of Yangtze™ Hold 'em has also been developed called Tibet High™ that is especially well suited for tournament play in which a number of players (e.g., ten per table) all start with a specified number of chips and the winner is the last player with chips. As such a tournament progresses, a player with a large amount of chips has an advantage over players with fewer chips still left. However, in Tibet High™, a new twist is added to make the tournament a little more interesting, especially for viewers of the tournament. The twist is that when a player calls at a showdown, if the calling player loses to the betting player and the betting player has a hand of at least a flush or higher, the losing caller player(s) must pay additional money to the winning player as a losing calling penalty. In a preferred embodiment of Tibet High, if the winning player has a flush, the losing calling penalty is the amount of the last bet that was called, if the winning player has a full house, the losing calling penalty is twice the amount of the called bet, if the winning player has a four of a kind, the losing calling penalty is three times the amount of the called bet, and if the winning player has a straight flush, the losing calling penalty is four times the amount of the called bet. In an alternative embodiment, a losing player does not have to pay a losing calling penalty if the losing player's hand is the same class of hand, but lower (i.e., a lower flush than the winning flush, a lower full house than the winning full house, a lower four of a kind than the winning four of a kind, or a lower straight flush than a winning straight flush).

From the description of the invention already set forth, it should be readily apparent that any poker game presently being played with the familiar international 52-card pack in accordance with a pre-selected set of rules for the game can also be played with the Chinese Poker Deck described herein with the addition of the specific rules associated with its use which also have already been described herein.

2. Some New Variations

Because the composition of the Chinese Poker Deck is different from the standard 52-card deck, it opens up the possibility of new variations of poker or poker-like games that take advantage of its different composition. As time goes by and the Chinese Poker Deck gains acceptance, there will no doubt be many different additional variations of games. However, for the present, two such games are Pa Kua Poker™ and Dragon Poker.™ The playing rules for these two games have previously been described in U.S. patent application Ser. No. 11/058,471 and will not be repeated herein, but, instead, be incorporated herein by reference.

C. Lo Shu™—A New Fusion Game to Compare with Blackjack

The casino game called Lo Shu™ using the Chinese Poker Deck has been invented to rival the game of blackjack. Although the game was originally described in previously filed U.S. patent application Ser. No. 11/058,471, a mathematical analysis of the game, with two options for play as a casino game, has been prepared by an independent gaming expert who regularly analyzes new games for the Nevada Gaming Commission and State Control Board, which will now be described.

Rules of Play.

Lo Shu™ is similar to blackjack and baccarat. All players play against the house dealer. Each player receives three cards, and the dealer also receives three cards, one of which is turned face up. The player may hit or stand.

Lo Shu is played with a special deck of 52 cards (the Chinese Poker Deck). The deck is composed of three different sets of cards numbered 1 through 9, five different sets of four 10-valued cards, and five cards with a value of 11.

The object of the game is to form a hand whose total is less than the dealer's total. The scoring system is the same as baccarat. The lowest score is 0 and the highest score is 9. The hand with the lower score wins. In the event of a tie, it is a push. The value of each card in the hand will be summed up and the sum modulo 10 is the score of the hand. If the first three cards received are all 10-value cards, which is called "Lo Shu," it is the best hand that even beats a score of 0.

The player can hit until the player has a maximum of five cards in the player's hand. The dealer can hit until the dealer has a maximum of six cards in the dealer's hand. The dealer must stand on 3 or lower and hit otherwise. Any four or more card hand that contains four or more 10- and/or 11-valued cards is said to "bust" and will lose. If the player busts, the player loses the player's bet immediately.

A second version of Lo Shu (1) allows the dealer to have a maximum of five 10- and/or 11-valued cards without busting, and (2) pays 3:2 for a player's Lo Shu. An example of common Lo Shu hands together with their point values is shown in FIG. 7.

Mathematical Analysis.

A computer program known as a combinatorial analyzer was written to analyze the game. The analyzer cycled through all 286 initial player three-card hands versus each of the 11 dealer up cards and determined the best play for the player by hitting or standing.

For each initial player three-card hand against each dealer up card, the analyzer cycled through all possible dealer hand combinations to determine the player's expectation for standing and hitting. The strategy that yielded the best result was chosen. As soon as all player hands were examined, the optimal strategy was determined and the house advantage derived.

The optimal strategy (for the first version) for three-card hands is to: 1) stand on a 2 or less; and 2) stand on a 3 only (a) when all three cards are 11 and (b) in the following cases:

| Dealer Up Card | Player's 3 Cards |
|---|---|
| 3 | 7-8-8 |
| 4 | 7-8-8 |
| 5 | 7-7-9 |
| 7 | 7-7-9 |
| 7 | 7-8-8 |

The house advantage for the first version is 3.52%. The house advantage for the second version is 5.16%.

A computer simulation of 300 million hands for the first version was run to verify the accuracy of the analysis. The simulation used the optimal strategy for the three-card hands and a simplified strategy for the four-card hands. The simplified four-card strategy was to stand on a score of 3 or less. The result of the simulation is: Win: 42.42%; Loss: 40.99%; Tie: 11.34% and Bust: 5.26% with a Player expectation: −3.83%. No study was conducted to ascertain whether the game could be vulnerable to card counting.

D. Tarracab™—A New Fusion Game to Compare with Baccarat

The casino game called Taraccab™ using the Chinese Poker Deck has been invented to rival the game of Baccarat. The reasons for doing so, the advantages of Taraccab™ over Baccarat, the details of playing Taraccab™, a mathematical analysis of Taraccab™ prepared by an independent gaming expert who regularly analyzes new games for the Nevada Gaming Commission and State Control Board and even two versions of the game with payout rules and calculated house advantages are all set forth in a previously filed patent application, U.S. patent application Ser. No. 11/128,529, the disclosure of which is specifically incorporated herein.

Suffice it to say, however, that this game should be as exciting to play, if not more so, and offer the same advantages and opportunities as the game of Baccarat while still representing a new fusion game in accordance with the present invention.

E. Other New Casino Games with the Chinese Poker Deck

Over time, in view of the versatility of the Chinese Poker Deck, there is no doubt that additional casino games can be developed using its unique structure. Two additional such games will now be described.

1. Rainbow 7™

Using The Dragon Deck, this new casino game is fast-paced and easy to play for the players. It can be compared with an advanced version of Taraccab™, another casino game designed to play only with the Dragon Deck. It can not be simulated to play with the International 52-card pack.

How to Play:

This game can accommodate up to seven (7) players. After the players make their bets, the dealer first deals 3 cards each faced down to everybody including the dealer. The dealer then reveals the dealer's cards which are called "The shower". At this point a player can either pull back his or her original bet to exactly half or to double his or her bet dependent upon the winning prospect of the player's cards combined with those of the dealer's.

The players are not allowed to share the contents of their cards with other players. The way to win against the dealer is to complete certain 3-card combinations according to the following:

1. Any 3-card suit (Circles, Bamboos or Scripts) is a push or no winner.
2. Any two 3-card suits pays 1:1.
3. Any Feng Shui, Wind Directions (E1, S2, W3, N4) or GD triplets pays 2:1.
4. A 3-card sequence of any suit pays 3:1.

Note: Any 3-card suits, any triplets and 3-card sequence of any suits all belong to different classes.

HOWEVER, THE PLAYER MUST USE ONE OR MORE OF THE PLAYER'S THREE CARDS FOR COMPLETING ANY ONE OR MORE 3-CARD WINNING COMBINATION.

ALSO, DEALER ONLY PAYS THE HIGHEST OF THE WINNING 3-CARD COMBOS AND NOT BOTH WINNING 3-CARD COMBOS EXCEPT WHEN THE WINNING 3-CARD COMBOS BELONG TO THE SAME CLASS AS STIPULATED ABOVE IN WHICH CASE THE PLAYER WINS DOUBLE. FOR EXAMPLE:

1. Any two 3-card suits (any suits) pays 1:1.
2. Only two triplets of the same class pays double the respective winnings. For example:
   a. Any 3-card suit with FFF, E1E1E1, S2S2S2, W3W3W3, N4N4N4, GDGDGD or a 3-card sequence of any suit pays only the winning for the respective triplets or the 3-card sequence of any suit.
   b. Any triplet with a 3-card sequence of any suits pays only the winning of the latter or 3:1.
   c. Any two triplets pay double or 4:1.
   d. Any two 3-card sequences of any suit also pays double or 9:1.

After the players have revised their bets, the dealer discards one card from the Deck and then deals himself four more cards face up which are called "The Sun". The "Pot of Gold" at the end of Rainbow 7 depends upon whether the combined cards of the player and the dealer's contain any winning combinations described above.

A player can have more than one winning 3-card combination. However, any card can only be used ONCE and cannot be shared to make more than one winning 3-card combinations.

Since the mathematical analysis of this game has not been carried out, the rules of the game can be changed in order to meet the required odds for the house dealer.

2. Dragon Gates™

The casino game of Dragon Gates is in essence the traditional game of PAI GAU played with the Pai Gau tiles. The traditional Pai Gau game has only 32 tiles but the Dragon Gates is played with the 52-card Dragon Deck. Whereas the Pai Gau game can accommodate a maximum of seven players, the Dragon Gates can theoretically accommodate 12 players.

How to Play:

Depending upon the number of players less than the theoretical maximum, the dealer deals out 4 cards face up to every player including himself one at a time. The players arrange their four (4) cards into two pairs of two. By following the ranking of the cards for the Dragon Deck, the players make sure that the contents of their cards are used to advantage. However, the ranking of the first two cards or the First Gate must always be lower than the ranking of the second two cards or the Second Gate. If the dealer discovers that a particular player does not follow this rule, that player loses automatically and there is no recourse.

When ready, the dealer compares the ranking of his two gates with those for all the players and decides whether the player loses or wins. The rules for determining whether a player wins or loses are as follows:

1. A particulate gate can be a WIN, LOSS or TIE (see later for cards ranking)
2. A dealer or player must win both gates before the winner or loser is declared.
3. It will be a tie for the player if he wins one but loses the other gate.
4. It will be a WIN for the player if he wins one gate and ties the other.
5. It will be a LOSS for the player if he loses one gate and ties the other.
6. It will be a LOSS for the player if he ties both gates. This is the only edge for the dealer in this game.

The Rankings of 2-card pairs for the Dragon Deck

1. THERE IS NO RANKING DIFFERENCE AMONG THE FENG SHUI PARAMETERS. Namely, F1, F2, F3, F4 and F5 rank the same.
2. THERE IS NO RANKING DIFFERENCE AMONG THE THREE SUITS.
3. The ranking for the 2-card pairs are therefore:
   F F, GD GD, E1 E1, S2 S2, W3 W3, N4 N4.
   F9, F8, F7, F6, F5, F4, F3, F2, F1 (the numbers 1-9 are any suit cards)
4. It the ranking of the 2-cards is not determined by #3 above, then the highest card of the 2-card counts If there is a tie in the first card, then the ranking of the second card determines the ultimate ranking for the 2-card pair or gate.

F. Other Games with the Chinese Poker Deck

As will become apparent from a review of the following games, certain new games bearing some of the characteristics of Mahjongg can be played with the Chinese Poker Deck. This, in itself, is of huge importance, since the Chinese Poker Deck can now be used outside of a casino in the same way as a traditional Mahjongg set, but without the heft, noise and space requirements associated with playing Mahjongg the traditional way. As such new play increases, Chinese people will become familiar with the Chinese Poker Deck, thus giving it greater recognition and acceptance, which should make the reality of a true East-West casino that much closer. And, if such games are economically viable in a casino, so much the better.

But, just as the success of the standard 52-card deck is not limited solely to its use in gambling games, such will also be the case with the Chinese Poker Deck. There are many non-casino games that are played with the standard 52-card deck and a variety of these games are described in *The New Complete Hoyle Revised* (1991 Doubleday)(ISBN 0-385-24962-4) and a loose description of categories for such games might be adult card games of skill, children's card games and solitaire card games. When one considers the variety of such games that can be played with the standard 52-card deck, it is easy to see why the 52-card deck is so widely recognized and familiar. However, it bears note again, that such acceptance is not the same in the East as in the West, and this leads to the question of why? While it may not be possible to know the answer, culture, history, opportunity, familiarity and bias may all be part of the answer, all of which again emphasize the need for the new Chinese Poker Deck that can engage the Eastern mind in new card games. Thus, if the Chinese Poker Deck is to ever rival the success of the standard 52-card deck, it will need to engage the Eastern mind, as well as Western minds already familiar with games that can be played with the standard 52-card deck, in non-casino games. As should be apparent by a description of the following games, the Chinese Poker Deck fits this bill. In fact, there are many games listed below, such as Three Fishing™ and its variants, which are fun family games, while still offering educational opportunities, plus, as is the case with traditional games such as hearts, spades and bridge, if one is inclined to do so, one can also bet on such games.

1. Unabridged Version of Playing Wild Mini Mahjongg™

This game can be played by 2-4 players using the Chinese Poker Deck (marketed under the trademark Dragon Deck). In general this game is played almost exactly like the regular Mahjongg game but with the following exceptions:

Because the Dragon Deck only has 52 cards (cards are used in lieu of the traditional tiles) instead of the usual 136 tiles (with Flowers 144), the set is simplified with the following rule changes:

1. There is only ONE card each, instead of four, for each of the members of the three suits, namely Circles [C], Bamboos [B] and Scripts [S] for a total of 27 cards.

2. There is only the Green Dragon [GD] in this game and no Red nor White Dragons, for a total of only 4 "dragon" cards.

3. There are the usual East [E], South [S], West [W] and North [N] wind cards, four each for a total of 16 cards 4. Five Feng Shui parameter cards, F1 to F5, have been added which can be used to represent any card in the Dragon Deck during the playing of the game.

Because of the 52 cards, the usual Mahjongg hand of 13 tiles is reduced to 7 Cards and the winning hand has 8 cards instead of the usual 14 tiles in regular Mahjongg.

The makeup of the winning hand for Wild Mini Mahjongg is exactly the same as regular Mahjongg comprising 2 triplets (three of a kind or a suit sequence of 3) and a pair (eyes) instead of 4 triplets and a pair (eyes) in regular Mahjongg.

How the Game is Played (Similar to regular Mahjongg)

1. Assuming that there are 4 players playing this game (see special rules below when 2 or 3 players play), the first order of business as in the regular Mahjongg game is to throw 2 dice to decide who is going to be the first Banker (The East wind position). Dice number counting is always counterclockwise for Mahjongg. Thus, the player to the right of the Banker (East) would be the South wind position, and the player sitting opposite would be the West wind position etc.

Note: There is an easier way to play the current Wild Mini Mahjongg. All the players need to decide in the beginning is "who is going to be Banker for the first four-wind round of play". Once decided, no throwing of dice is needed and the Banker simply deals the cards after shuffling the deck and having it cut by another player starting with himself and then going clockwise.

Note: When playing the game of Wild Mini Mahjongg with the Dragon Deck, cards are dealt to players one at a time in the Clockwise direction. However, during the play, including the dice counting if selected, the flow of play is Counterclockwise. This rule of play might sound confusing for players in the beginning. However, players normally have no difficulty with it after playing just a few hands.

2. The banker thoroughly shuffles the card deck and has it cut by another player before dealing each player one card at a time with 7 cards and himself with 8. The Banker represents the first "location" of the "East" or first "wind round" of plays.

3. The banker first discards one of his 8 cards face-up unless he has a scoring hand (very rare), i.e. 2 triplets plus a pair (eye) or five Feng Shui or wild cards together (even rarer) [see below].

4. This discarded card can either be 1) ignored by other players; 2) picked up by any player by using it to form any suit sequence of 3, an operation called "Tsee" (Note 1) or to form a three-of-a-kind, an operation called "Pung" or 3) picked up by any player to score.

Note. In the rules for playing Regular Mahjongg, only the player to the right of the player who is discarding the tile (card in the present case) can pick up same to form any suit sequence of three or "Tsee" and not by any players. This is a rule change for the current Wild Mini Mahjongg from the regular Mahjongg due to the much smaller number of cards (52 versus 136) available for play.

5. If the discarded card is ignored, then it is the South player's turn to draw a card from the top of the remaining deck. He then discards one of his cards unless he has a scoring hand. The fate possibilities for this discarded card follow those stipulated in item #4 above.

6. Following 2) of item #4, namely that East's discarded card is picked by a player to form a suit sequence of three ("Tsee") or to form a three-of-a-kind ("Pung"), the respective three cards have to be displayed face-up in front of the player who has "Tseed" or "Punged" and followed by discarding one of his remaining cards. Afterwards it is the turn of the player to his right to draw a card.

7. A Feng Shui or wild card can be used to "Tsee" or "Pung" by combining them with another regular card to form a triplet. The wild card can later be retrieved by the player, however, if subsequently he draws the card represented by the wild card in the triplet that is formed. In the case of a suit sequence of three, there may be two ways that the wild card is retrieved as long as a suit sequence of three is still formed and it does not have to be the same sequence as the original suit sequence.

8. Following 4) of item #3, namely that East's discarded card can be picked up by any of the three other players to score, when this happens, that particular hand of the game is over and the amount of the winning is tallied up (see below) which is to be paid by the player discarding that particular scoring card. The other two players are spared from any such liability.

9. If the East player scores, then he will continue to be the Banker and another hand will start following the steps described in items #1-8. As long as the East player continues to score, he will remain as the Banker until one of the other three players scores.

10. If East does not score, then it is the South's turn to be the Banker and another hand starts following the steps described in items #1-8. This will be the second "location hand" of the "East" round of plays.

11. When it is West's turn to be the Banker, it will be the third location hand of the "East" round. Finally when it is East's' turn to play again after North's location hand ends, the four location hands of the "East" round end and East will become the Banker again to start the second or "South" round of plays. In accordance with regular Mahjongg playing custom, the Mahjongg game is played in multiple units of "4-round" (namely East, South, West and North) events. The 4-round and 8-round events are particularly popular to play.

12. Note that when the banker scores by drawing his own card, then the non-scoring players all pay the winning player in equal tallied amount.

Other Occurrences During the Play

1. When a player has already a 3-of-a-kind triplet in his hand and obtains the fourth (regular or wild card) either by drawing during his turn or through a discard by the other players, he can display the quadruplet face-up and then draw a card from the bottom of the deck of the remaining cards before discarding a card and giving up his turn of play to the player to his right. This operation is called "Gong".
2. When a player collects 4-of-a-kind quadruplet on his own (with or without the use of a wild card), he may choose to display them face-up or face down and draws a card from the bottom of the deck of the remaining cards before discarding a card and continuing. This process is also called "Gong".
3. When a player discards a card that is scored by one of the other players, he is responsible for paying everybody's (including himself of course) liabilities to the winning player.
4. When a player scores by drawing his own card, all players are liable equally for their own winning indebtedness to the scorer.
5. When a player officially declares that he scores but actually does not because of his mistake or oversight, he is responsible for paying the other players the top winning liability or six (6) "Fang" allowed for by the game (see below).
6. The player's right to score through the discarded card is according to his position with respect to the Banker (East) in a counterclockwise direction. Thus the player to the right of the Banker (or South) has the right to score first followed by the West player (sitting opposite the banker) and the North player etc. Only one player can score at any one time.
7. A player is allowed to pick up two discarded cards at different times to form two triplets (3-of-a-kind or suit sequence of 3) and left with only one card in his hand. In this case, the player is looking for another card to match the one he is holding in order to make a pair (eyes) to score.

Scoring

There are several scoring conventions for Mahjongg and none is universal. Different players might wish to adhere to different scoring conventions but they have to agree unanimously before starting. The following is recommended for the Wild Mini Mahjongg.

Generally speaking, the scoring is limited by a maximum of six levels or "Fang". The game's win-loss stake is dependent upon how much (how many points) one is willing to assign per Fang of the scoring hand. For example if one Fang has a value of 4 points, then 1. Half Fang . . . Banker scores worth 4; non-banker worth 2
2. One Fang . . . Banker scores worth 8; non-banker worth 4
3. Two Fang . . . Banker scores worth 16; non-banker worth 8
4. Three Fang . . . Banker scores worth 32; non-banker worth 16
5. Four Fang . . . Banker scores worth 64; non-banker worth 32
6. Five Fang . . . Banker scores worth 96; non-banker worth 48
7. Six Fang . . . Banker scores worth 128; non-banker worth 64

The Classification of Scoring Hands:

The seven Fang allocations are illustrated in FIGS. 8-12.

Special Scoring Occasions

1. If a player scores as a Banker before he discards a card, then this winning hand is worth 6 Fang.
2. If a player scores with the first discarded card from the Banker, then the winning hand is also worth 6 Fang.
3. If a player scores with the card drawn from the bottom of the deck of remaining cards, i.e. when he "gonged" or displaying 4-of-a-kind from his hand, then the winning hand is added one extra Fang.
4. If a player scores with the card drawn from the bottom of the deck of remaining cards, i.e. "gonged" with the help of a discarded card from another player, his winning hand will be considered as self-drawn and worth one extra Fang.
5. A hand with five Feng Shui or wild cards scores automatically and is an exception to the regular scoring rules of Mahjongg. It is worth 5 Fang. However, since the player must acquire all five of the Feng Shui or wild cards himself without any assistance from other players, the hand is in practice worth 6 Fang.

Playing with Only 2 or 3 Players

The regular Mahjongg game is normally played with four players. Each player represents a "wind" direction or location, namely East (E), South (S), West (W) and North (N), respectively. Players rotate counterclockwise as Banker and every time when a non-Banker scores, the Banker location will advance one position. One full rotation of four locations, namely starting from East to South, to West and finally to North is called one "round" of play. The game is played in multiples of 4-round. Thus, an 8-round game comprises 2 4-round plays and a 16-round game comprises 4 4-round plays and so on.

The Wild Mini Mahjongg game is designed to be played by either 2, 3 or 4 players using the Dragon Deck. For two players, one only uses two "wind" locations instead of usual four, namely East and South only. The Banker holds the East and the other player the South and vice versa as the game progresses. There are no West or North "wind" locations in this case. Thus one round of play takes only one full rotation of two "wind" locations. All the regular rules pertaining to the playing of the Wild Mini Mahjongg game apply unchanged to the 2-player game. Because of this reason, it is easy for an individual to teach another individual to play the 2-player version of Wild Mini Mahjongg. Since the rules are basically the same as the regular Mahjongg game, once one masters the Wild Mini Mahjongg game, one will soon master the regular game too.

Similarly, three people can also play the Wild Mini Mahjongg game instead of four. In this case, only three "wind" locations are used, namely East, South and West only. One round of play comprises a three "wind" location rotation. The Banker is the East location; the player to his right assumes the South location and the third player the West location. Again all the playing rules for the Wild Mini Mahjongg apply also to the three players version, just like they apply to the two player version.

2. The Thirteen Dragons

The Thirteen Dragons played with the Dragon Deck is basically the same game as the Thirteen Cards played with the International 52-card pack. This game is best played with four players. Players take turns to be the banker one hand at a time (rotating in a clockwise direction) who in essence plays against the other three players for that particular hand. Oftentimes players decide ahead of time how many banker rounds they will play. Thus one banker round means that there will be four hands played with each player having a chance to be the banker.

After it is decided which player will start as the banker, the banker will deal all the cards to the players one at a time starting from the player to his left and dealing in a clockwise direction. After all the cards are dealt, each player should have exactly thirteen cards each, hence the name "Thirteen Dragons" of the game.

Each player shall divide the player's thirteen cards into three groups. The first group shall contain three cards and the second and third group each has five cards. The object of the game is to arrange the cards into the three groups each having a particular "value". The "value" of a group of cards is synonymous with how good the "hand" is when looked upon as a three-card or a five-card poker hand. Thus for the first group of three cards, the best is a three-of-a-kind in Ace (Western Deck) followed by a pair and then the by the highest ranking of the cards making up the group. For the five-card group, the highest ranking is the Royal Flush (Western Deck) followed by the straight flush, four-of-a-kind, flush, straight, three-of-a-kind, two pairs, one pair and the highest ranking cards etc.

With the exception of the five Feng Shui cards in the Dragon Deck, there is a one-to-one correspondence between the ranking of the groups (or hands) as stipulated above between the Thirteen Cards (Western Deck) and the Thirteen Dragons (Dragon Deck). In the Thirteen Dragons played with the Dragon Deck, the highest ranking hand is five-of-a-kind or 5 Feng Shui cards absent in the Western Deck. Thus the five-of-a-kind Feng Shui is the highest ranking five-card hand in the game of Thirteen Dragons. Please refer to the instructions for playing the Yangtze Hold 'em poker game for the rankings of the five-card hands for both the Western Deck and the Dragon Deck.

Note that in arranging the three groups of a particular hand, the ranking of the three groups from the lowest (first) to the highest (second and then third) must be strictly complied with. Failure to do so as pointed out by any player results in the automatic loss of three tricks by that player without further comparison of the groups.

The Scoring System for the Thirteen Dragons Game

As mentioned earlier, each playing hand of the game has a banker and three players. It is the hand of the banker versus the individual hands of the three players that determines who is winning or losing. Thus the banker compares the three groups of his hand respectively with those of the three players on an individual basis. If the banker wins all three groups from a particular player, then he wins three tricks from that individual player. Before the hands are dealt out to the players, the wager for each trick is normally declared ahead of play. Thus each trick might be arbitrarily determined to be worth five chips each. In the example above, the player loses all three groups to the banker or he loses a total of 15 chips to him. On the other hand, another player might have won one trick from the banker and the banker has to give him five chips. When all the three players' hands are separately compared with that of the banker to determine the win-loss results, that particular hand of the game comes to an end. The banker's role shifts to the player to the left of the last banker and the game continues.

Special Hands in the Scoring System

When a player possesses an extraordinarily good hand the player can win more tricks (normally one trick) from another player every time the player wins with that special hand in a particular group. The following are examples of the special hands and their scoring values:

1. Any win resulting from three-of-a-kind hand in the first group is worth three tricks.
2. Any win resulting from a full house hand in the second group is worth two tricks.
3. Any win resulting from a four-of-a-kind hand in the second group is worth 10 tricks.
4. Any win resulting from a straight flush hand in the second group is worth 15 tricks.
5. Any win resulting from a five-of-a-kind hand in the third group is worth 8 tricks.
6. Any win resulting from a straight flush win in the third group is worth 5 tricks.
7. Any win resulting from a four-of-a-kind win in the third group is worth 4 tricks.

More Special Winning Hands

The following are additional special hands that win automatically without comparing the three groups of the hands between two players:

1. Any thirteen cards without the Feng Shui card and any pair is worth 13 tricks.
2. Any three groups comprising nothing but any flush hand (including the first group of three cards) is worth 10 tricks.
3. Any three groups comprising nothing but any straight hand (including the first group of three cards) is worth 10 tricks.

Note: The above scoring system is only a recommendation or guideline for the game and individual players can decide what the scoring system should be prior to starting the game.

3. The Dragon Bridge™

The Dragon Bridge™ game played with the Dragon Deck is the counterpart of the regular Bridge Game played with the international 52-card pack. The rules for playing these games are similar but there are distinct differences to make them individually intriguing and challenging to master. The main similarities and differences between the two bridge games are listed below:

1. There are four suits in the Dragon Bridge just as in the regular Bridge game. They are the Dragon suit, the Circle suit, the Bamboo suit and the Script suit corresponding respectively to the suits of Spade, Heart, Diamond and Club. But there are only nine (9) cards per suit in the Dragon Bridge as versus thirteen (13) in regular Bridge. The cards for the four suits are respectively:

The Dragon suit: F1, F2, F3, F4, F5, GD, GD, GD and GD

The Circle suit: 9, 8, 7, 6, 5, 4, 3, 2 and 1

The Bamboo suit: 9, 8, 7, 6, 5, 4, 3, 2 and 1

The Script suit: 9, 8, 7, 6, 5, 4, 3, 2 and 1

2. Unlike regular Bridge, there are sixteen (16) neutral cards (the "neutrals") in Dragon Bridge. They can never be trump cards like the suit cards. But from the ranking standpoint, they are higher than all the suit cards except for those belonging to the Dragon suit. They make up the remaining 16 cards for a deck of 52 cards of the Dragon Deck.
3. Both games have "No Trumps" plays meaning that the tricks will be won by cards of the higher ranking only without "trumping." For Dragon Bridge, the ranking of the cards are: F, GD, E1, S2, W3, N4, 9, 8, 7, 6, 5, 4, 3, 2, 1 of the three suits. Note that there are no ranking differences among the three suit cards when they are not bid as trumps except for the Dragon suit whose cards are of higher ranking by design.
4. In regular bridge, the tricks are played out one at a time. In Dragon bridge, a maximum of five tricks (e.g. represented by 5 F's) can be played all at one time for the Dragon suit and for the neutrals. Of course one can trump that with five trump cards! However, one cannot play more than one trick at a time for the Circle, Bamboo and Script suit cards.
5. In cases when multiple tricks are played all at one time, a set of the trump cards can be "over-trumped" by another set of equal number trump cards containing a higher ranking trump card in the set. For example, for a 3-trick play when GD, GD, GD are being trumped by 6, 5, 4 of Bamboo which is the trump suit, the latter can be "over-trumped" by 8, 2, 1 of Bamboo. That is because the latter 3-card set has a higher ranking suit card in the Bamboo 8 card.

How to Play

For those who know how to play the regular bridge, Dragon bridge is easy to play. The bidding is the same:

"1" of anything (suit or No trump) requires winning of 7 tricks.

"2" of anything requires winning of 8 tricks.

"3" of anything requires winning of 9 tricks.

"4" of anything requires winning of 10 tricks.

"5" of anything requires winning of 11 tricks.

"6" of anything requires winning of 12 tricks, and

"7" of anything requires winning of 13 or all the tricks.

The ranking of the suits during bidding is Dragon first, Circle second, Bamboo third and Script fourth. Thus, like regular bridge, 2 of Circle will supercede 2 of Bamboo and so on. But, like the regular bridge, No Trump bid is the highest and therefore in the above example, 2 No Trump would prevail over all 2 of the suits.

The scoring system is also the same as regular bridge. Players should consult the rules therefrom.

Like the playing of the regular bridge, four players are needed to play the game. They are paired as two opposing teams and the position of the players around a square table alternates from one team member to the next so that two members of the same team always sit facing each other.

4. Three Fishing™

Two to six players with four being optimum are recommended. The objective is for a player to "fish" the maximum number of cards from a card pool consistent with the rules of the game. The game ends when all the available cards are drawn by the players and shown for being possibly "fished". The players then count up the number of cards that they have "fished" and convert them into points according to the following rules:

1. Any Feng Shui card is worth ten (10) points.
2. Any Green Dragon (GD) is worth five (5) points.
3. Any wind direction card, namely E1, S2, W3 and N4 is worth two (2) points.
4. Any suit card is worth one (1) point.

How to Play the Game

Example for four players is set forth below. Each player is dealt four cards one at a time. Four cards are then dealt face-up or open at the center of the playing area. The dealer starts by drawing a card and placing it face-up with the others that are already in the "fish pond". The dealer then finds out whether he or she can "fish" anything. That means the dealer tries to find out between the cards he has in his possession and the cards in the "fish pond", whether any three cards exist that will add up to a sum of tens, namely 10, 20 or 30.

Examples are given below. Note that a Feng Shui card counts as eleven (11) points.

Three cards that add up to ten (10) points: Any three cards of any suit that add to 10. For example, 1, 1 and 8 of any suit (Circles, Bamboos or Scripts).

Three cards that add up to twenty (20) points: Any three cards of any suit that add up to 20. For example, cards 9, 9 and 2 of any suit, Cards 1 and 9 of any suit plus a 10 card (GD, E1, S2, W3 or N4), Cards 2 and 8 of any suit plus a 10 card, Cards 3 and 7 of any suit plus a 10 card, Cards 4 and 6 of any suit plus a 10 card, Cards 5 and 5 of any suit plus a 10 card.

Three cards that add up to thirty (30) points: Any three 10 cards or a Feng Shui card plus a 9 card of any suit plus any 10 card.

After the first player finishes "fishing", the turn will be passed to the player to the first player's right. This player will first draw a card and place it face-up at the "fish pond" and then try to "fish" according to the rules established above. The play then continues passing to the next player to the right and the game ends after all the cards are drawn and no player is able to "fish" any more cards. The players then count up their points and whosoever gets the highest point score will be declared the winner of the game.

It should be noted that this game, as well as variants of this game described below, make good family games and also are educational for young children in the sense that players are required to constantly be adding cards together.

5. Modulo N™

The number of players for this game can be any number from 2 to 6 with 4 players being the optimum. The object of the games if or the players to get rid of all their cards held in their hands by discarding them according to rules set forth below. Whosoever gets rid of all their cards first wins the game. The game is similar to Three Fishing, but different in that instead of always trying to get three cards to add up to a modulo 10, the modulo may vary at the beginning of a hand, and the winner is the first player to get rid of all of the cards in their hand.

How to Play the Game

Any player can start first as a cards dealer and players then take turns thereafter in a clockwise or counterclockwise direction to deal.

Each player is dealt four cards, one at a time, starting from the dealer's left. After the four cards are dealt, the dealer picks a card from the top of the remaining deck and turns it up and places it in the center so that every player can clearly see. This card can be any card from F (A or 11), GD (10), E1 (10), S2 (10), W3 (10), N4 (10), 9 of any suit (9), 8 of any suit (8), and so on down to 1 of any suit (1) having:

| | |
|---|---|
| GD, E1, S2, W3, and N4 | Modulo 0 |
| F and 1 of any suit | Modulo 1 |
| 2 of any suit | Modulo 2 |
| 3 of any suit | Modulo 3 |
| 4 of any suit | Modulo 4 |
| 5 of any suit | Modulo 5 |
| 6 of any suit | Modulo 6 |
| 7 of any suit | Modulo 7 |
| 8 of any suit | Modulo 8 |
| 9 of any suit | Modulo 9 |

The card that was turned up last determines the Modulo N of the game and dictates how it will be played. For example, if the card turned up is Modulo 0, then the players can discard their cards in any number no more than three (3) as long as their total sums adds up to 0 (e.g. 10, 20, 30 etc.) or Modulo 0.

However, if the card that is first turned up has a Modulo other than 10, then the player can discard their cards in any number no more than 3 as long as their total sum adds up to the Modulo number. Thus, if the Modulo number is 1, examples are: Any number of cards up to 3 that adds up to Modulo 1 like GD, GD & Feng Shui (F) card or any two number of cards that add up to 1 plus a Modulo 0 card. Similarly, if the card that is first turned up has Modulo 9, then the players can discard their cards in any number no more than 3 as long as their total sum adds up to 9 or Modulo 9.

Examples are any number of cards no more than 3 that add up to Modulo 9 such as 1, 4 and 4 together or 4 plus 5 plus a Modulo 0 card such as GD, E1, S2 etc.

Note that the card that is first turned up cannot be used by anybody. The Dealer first draws a card from the deck and discards any of his cards if he can. Then the player to his right draws a card and also discards if he can. This will go on until one of the players gets rid of all his cards including the last one he draws to win the game.

In the event that all the cards are drawn and nobody is able to get rid of his cards, then the player with the minimum number of cards in his possession wins the game. In the further event of a tie, players take a card from a freshly shuffled deck and whosoever gets a higher ranking card is declared the winner.

6. Modulo Minus N™

This game is played the same as Modulo N except that the Modulo values now can have negative values as set forth below:

| | |
|---|---|
| GD, E1, S2, W3, and N4 | Modulo 0 |
| F and 1 of any suit | Modulo −1 |
| 2 of any suit | Modulo −2 |
| 3 of any suit | Modulo −3 |
| 4 of any suit | Modulo −4 |
| 5 of any suit | Modulo −5 |
| 6 of any suit | Modulo −6 |
| 7 of any suit | Modulo −7 |
| 8 of any suit | Modulo −8 |
| 9 of any suit | Modulo −9 |

NOTE THAT FOR THIS GAME, ALL SUIT CARDS CARRY NEGATIVE NUMBER VALUES AND ALL OTHERS, except the Green Dragon (GD) which can carry both negative and positive number values as selected by player, CARRY POSITIVE NUMBER VALUES. For example, E1=S2=W3=N4=+10, F=+11 and 9 of any suit has a "−9" negative number value and 5 of any suit has a "−5" negative number value and so on. The GD can be both +10 or −10 as selected by the player, but if two or more GD's are used, then they must have the same sign for number value, namely + or −.

The card that was turned up last determines the Modulo Minus N of the game and dictates how it will be played. For example, if the card turned up is Modulo 0, then the players can discard their cards in any number no more than three (3) as long as their total sums adds up to 0 (e.g. 10, 20, 30 etc.) or Modulo 0.

Examples are:

1. Up to three (3) GD, E1, S2, W3 or N4 cards (GD can be + or −10 without any consequence in this case).

2. No more than three (3) cards that yield a "0" or Modulo 0 together. For example, E1, 5, 5 yield a "0" or Modulo 0 because the 5 card has a "−5" number value, and GD, E1, 5 also have −5 value because we select GD as −10 to cancel the +10 from E1.

Similarly if the card that is first turned up has Modulo 1 or has Modulo −1 value, then the player can discard their cards in any number no more than 3 as long as their total number yields a Modulo −1 values (−1, −11, −21, −31). Examples are: Any number of cards up to 3 that adds up to Modulo −1 like N4, 3, 8 or F, 4, 8; 9, 8, 4; GD, E1, 1 (GD taken as −10) and so on. As another example, if the card that is first turned up has Modulo −9, then the players can discard their cards in any number no more than 3 as long as their total value yields −9 or Modulo −9. Examples are: (1) Any number of cards no more than 3 that yield to Modulo −9. Examples are 1, 4 and 4 together or 2, 3, 4; and (2) Using GD as −10, one can also have GD, S2, 9 (value −9); GD, 1, 8 (value −19) etc.

Other than changes associated with the negative Modulo option already described, the game plays the same as Modulo N.

7. Three Fishing I™

The rules for this game are the same as for Three Fishing except that the first card dealt by the first dealer (which will be the $5^{th}$ face up card available to the dealer at the beginning of the game) determines a Modulo value for the game that must then be met for "fishing" three cards throughout that hand. Thus, if said first card is a Modulo 10 (i.e., a Wind or GD card), there is no difference in the game; however, if the first card has a Modulo value of from 1 through 9, the play will be different. For example, in a Modulo 5 game, before three cards can be "fished," their sum must end in a Modulo 5, such as 5, GD, NW; 2, 2, 1; FS, FS, 3.

8. Houdini™

Houdini has four to six number of Players. Three is OK too but each player might have too many cards to start. Depending upon the number of players, all the 52 cards of the Dragon deck will be dealt out completely to the players in a clockwise direction. If one player has one more card dealt to him or her, it is OK and will not affect the playing of the game.

The winning objective of the game is to try to get rid of the cards that are in the player's hand or possession as quickly as possible. The player who first gets rid of all his or her cards wins the game. To win this game, one has to have very good memory and be observing all the time what card is being inquired of from which player and by which player together with the subsequent results. This would include the results of one's own inquiries. Knowing exactly what has been inquired successfully or otherwise by all players is crucial in forming the ultimate strategy in how to win this game. The strategy adopted by a player to plan to discard which sequences or groups of cards first also plays a crucial role in attaining the overall winning strategy.

A player can get rid of his or her cards if the cards in his or her possession match or complete the following groups or sequences:

1. All five Feng Shui cards, namely F1, F2, F3, F4 and F5
2. All four of the Green Dragon (GD)
3. All four of either the East (E1), South (S2), West (W3) or North (N4) wind directions
4. Sequences of 987, 654 or 321 of the three suits, namely Circles, Bamboos or Scripts.

How to Play the Game

Starting with the player who deals the cards, that player has the right to inquire, based upon the contents of his or her hand, of any of the remaining players for any particular card, e.g. E1, in order that the player improves the chance of him or her discarding the, in this case, four E1's. If the already has 3 E1's in his or possession, it is very likely that he will inquire of the remaining players for the fourth E1 card so that according to the discarding rules above, the player can immediately discard four E1's in the player's possession. Likewise, if the player has 9 and 7 cards of the Bamboo suit in the player's possession, the choice of inquiry might very well be the 8 card of the Bamboo suit.

If the player's inquiry from any of the remaining players for a particular card is successful, then the player can continue inquiring for the next. This goes on until the player's inquiry fails and the player sitting to his left will start his or her turn of inquiring. This will continue until one of the players successfully gets rid of all his cards in his possession and he will be declared the winner of the game.

9. Magnet™

Number of Players: Four.

Game Winning Objective: Players collect points by successfully completing groups of special cards or sequences of cards belong to the three suits of the Dragon Deck in his or her possession. The point scoring is summarized as follows:

1. Fifty (50) points for all five Feng Shui cards or F1, F2, F3, F4 and F5
2. Twenty (20) points for any group of four of the GD, E1, S2, W3 of N4 cards
3. Ten (10) points for any sequence of the following in any of the three suits, namely Circles, bamboos or Scripts:

987, 654, 321.

How to Play the Game:

Starting with four players each is dealt six cards and the remaining cards are put at the center of the playing table or surface reachable by all four players. The player who deals the cards starts first. He has two choices. He can either inquire of one of the remaining players for a particular card in order that he can complete the groups or sequences of cards to score. Alternately, he can draw a card and the turn then passes on to the player to his right. If his inquiry is successful he can continue until he fails. Then the turn will also be passed on to the next player to his right. The only time he can score is after his successful inquiry and at the end of drawing a card. He cannot score at nay other time. The game ends when all the cards in the center are exhausted. The players then count who scores the most point and he or she will be declared the winner of the game.

10. Four of a Kind™

The number of players is four. The object of the game is for a player to collect any group of four special cards, in this case it could be either four Feng Shui cards (any four from F1, F2, F3, F4 or F5) or four GD, E1, S2, W3 or N4 cards. The cards belonging to the three suits of the Dragon Deck, namely Circles, Bamboos and Scripts have no special significance in the playing of this game.

The group of four winning cards can be from the four or more cards the player has to show (see below) or from the player's hand of four additional cards in the player's possession.

How to Play the Game

Each of the four players is dealt eight cards each, one at a time. The remaining cards are to be put at the center of the playing surface accessible by all four players.

If any player receives a group of four cards after the cards are dealt, the game ends immediately and he or she is declared the winner.

If nobody has a possession of four winning card as a group, then each player has to show four cards up front. Starting with the dealer, the dealer shall have two choices:

1. The dealer can choose to draw a card and if the dealer does not win, the dealer has to add one additional card to the group of four that are already being shown.
2. Or the dealer can exchange one of the dealer's shown cards with any one of the group of four cards shown by the other three players.
3. If the dealer does not win, then the turn passes on to the player to the right.

This player has the same choices as the first player. This also applies to the other two players to follow.

When the turn to play comes back to the original player, the player has one extra choice the player can now make in addition to the previous two and that is the player can exchange one of the cards in the player's possession with one being shown. The other three players to follow also have this extra choice.

The game goes on until somebody wins. If when all the cards are drawn and nobody still wins, then the game goes on with the choice for drawing a card eliminated. The game will end when one of the four players collect the group of four cards stipulated.

11. Solitaire

This is the first Solitaire game designed for the Dragon Deck. Because of the major distinctions between the Dragon Deck and the International 52-card pack, the structure and intricacy of play for this Solitaire are quite different from those Solitaire games designed for the International 52-card pack.

The object of this Solitaire is to successfully arrange the sequence of cards in columns starting from the five (5) Feng Shui parameters F1 to F5, then the (4) Green Dragons (GD), the respective wind direction cards (four each direction) in the order of E1, S2, W3 and N4 to be followed by the suits of Circles, Bamboos and Scripts from 1 to 9 in sequence order. A winning layout is depicted below:

| 5F's 4GD's 4E1's 4S2's 4W3's 4N's | Circles 1-9 | Bamboos 1-9 | Scripts 1-9 |
|---|---|---|---|

How to Play the Game

The player first deals open face 9 cards from the Dragon Deck. The column lead-in cards have to be ordered starting from the F's followed by the GD, E1, S2 . . . and so on. If there are any Feng Shui cards in the 9 initially dealt cards, they can start the column array building with the first or F column. However, if there are no Feng Shui cards in the initially dealt 9 cards, then the column array building cannot start until one of the F's card shows up subsequently. If on the other hand, there is also the GD card besides the F card in the beginning, then the second GD column can also start and so on. The only exceptions are the ones of the three suits. They can start their columns at any time independent of the sequence for F, GD, E1, S2, W3 and N4 columns being completely established already or not.

To continue playing the game and revealing more cards from the remaining deck, take cards from the top of the deck two at a time. Then flip the two cards to expose the second card as the top card, i.e. the first card would now be under the top or second card. The top card of this operation can now be used to continue the building of the column array for this game. For example, if a F card shows up and there is no F card in the 9 initially dealt cards, then this card can be used to start the first or F column in the array. If the top card of the two has been successfully used for column array building, then the card underneath would also become available for further column array building.

Continue flipping the deck of cards, two at a time in the procedure described above, in order to expose more cards for use with the array building. Note that the card immediately under a card that has been used is also available for array building and there is no limit on how many cards that can be used from that procedure at any one time. Keep flipping until the deck eventually runs out. If at the end there is only one card instead of two, then this one card can first be used for array building if useful. Otherwise start the flipping of the deck all over again and continue building the array. If all goes well, the array will slowly but surely is completely built. However, if no array building progress is made despite the repeated flipping of the deck, then one is stuck and the Solitaire game ends and fails. Last checked the probability of successfully building the column array is approximately 1:1.

12. MAC I™ (Multiply, Add, Catch)

Two to six players with four being optimum for play is ideal.

The objective is for a player to "fish" the maximum number of cards from a card pool consistent with the rules of the game. The game ends when all the available cards are drawn by the players and shown for being possibly "fished" by them. The players then count up the number of cards that they have "fished" and convert them into points according to the following rules:

5. Any Feng Shui card is worth ten (10) points.
6. Any Green Dragon (GD) is worth five (5) points.
7. Any "wind" direction card, namely E1, S2, W3 and N4 is worth two (2) points.
8. Any suit card is worth one (1) point.

How to Play the Game

Example for four players is set forth. Each player is dealt four cards one at a time. Four cards are then dealt face-up or open-face at the center of the playing area. The dealer starts by drawing a card and places it face-up with the others that are already in the common area called the "fish pond". The player then finds out whether the player can "fish" anything. That means the player tries to find out between the cards the player has in the player's possession (the "bait") and the cards in the "fish pond", whether any three cards exist such that the sum of the product of any two of the three cards and the third card will add up to a sum of tens, namely 10, 20, 30, . . . 130. Examples are given below. Note that a Feng Shui card counts as eleven (11) points.

1. Any three ten-point (10) cards. In this case, the product of any two is 100 and when added the value of the third ten-point card, the total sum is 100+10=110.

2. Any three cards that include two ten-point (10) cards. In this case the product of one of the two ten-point card with the third card is 10×N, where N is the number value of the third card. Thus the sum of 10N and 10 is (N+1)10 and is a sum of tens.

3. If M, N and L are the number values of any three cards (either as bait possessed by a player or in the fish pond), and if the sum of [M×N+L], [N×L+M] or [L×M+N] is a sum of tens, then the three cards can be fished.

After the first player finishes "fishing", the turn will be passed on to the player to the player's right. This player will first draw a card and place it face-up at the "fish pond". This player then tries to "fish" according to the rules established above. After that, it is the next player to his or her right's turn to "fish" and so on.

The game ends after all the cards are drawn and no player is able to "fish" any more cards. The players then count up their points and whosoever gets the highest point score will be declared the winner of the game.

To play a longer and more satisfying game, the scores of each player can be accumulated up to a predetermined number of games, say 3, 5 or even 10, before a winner is declared. The player with the highest sum score for the total number of games played will be declared the winner.

13. MAC II™

Mac II has two to six players with four being optimum for play.

The objective is for a player to "fish" the maximum number of cards from a card pool consistent with the rules of the game. The game ends when all the available cards are drawn by the players and shown for being possibly "fished" by them. The players then count up the number of cards that they have "fished" and convert them into points according to the following rules:

1. Any Feng Shui card is worth ten (10) points.
2. Any Green Dragon (GD) is worth five (5) points.
3. Any "wind" direction card, namely E1, S2, W3 and N4 is worth two (2) points.
4. Any suit card is worth one (1) point.

How to Play the Game

Example for four players is set forth below. Each player is dealt four cards one at a time. Four cards are then dealt face-up (open-face) at the center of the playing area. The dealer starts by drawing a card and places it face-up with the others that are already in the common area called the "fish pond". The number value of this last drawn card by the first player determines the fishing rules for playing this game. After the first player has drawn the card to start playing, the player then finds out whether he or she can "fish" anything. That means the player tries to find out between the cards in the player's possession (the "bait") and the cards (the "fish") in the "fish pond", whether any three cards exist such that the sum of the product of any two of the three cards and the third card is a number having Modulo N, where N is the number value of his or her last drawn card to start playing the game. Examples are given below. Note that a Feng Shui card counts as eleven (11) points.

1. If X, Y and Z are the number values of any three cards (either exist as "bait" possessed by a player or as "fish" in the pond), and if the sum of [X×Y+Z], [Y×Z+X] or [Z×X+Y] is a sum having Modulo N, where N is the number value of the last card drawn by the first player to start playing the game, then the three cards can be fished. For example, if the number value of the last drawn card is "8" or Modulo 8, then the three cards E1 (10-card), 2 and 8 can be fished. The reason is that the product of E1 and 2 is 20 and the sum of 20 and 8 is 28 which have Modulo 8.

After the first player finishes "fishing", the turn will be passed on to the player to the right. This player will first draw a card and place it face-up at the "fish pond". This player then tries to "fish" according to the rules established above. After that, it is the player to this player's right's turn to "fish" and so on.

The game ends after all the cards are drawn and no player is able to "fish" any more cards. The players then count up their points and whosoever gets the highest point score will be declared the winner of the game.

To play a longer and more satisfying game, the scores of each player can be accumulated up to a predetermined number of games, say 3, 5 or even 10, before a winner is declared. The player with the highest sum score for the total number of games played will be declared the winner.

14. Match Me Right!™

The number of Players for Match Me Right is two to six players with four being optimum for play.

The objective is for a player to "fish" the maximum number of cards from a card pool consistent with the rules of the game. The game ends when all the available cards are drawn by the players and shown for being possibly "fished" by them. The players then count up the number of cards that they have "fished" and convert them into points according to the following rules:

1. Any Feng Shui card (Wild Color, could be Red, Green or Deep Blue) is worth ten (10) points.

2. Any Green Dragon card (Green Color) is worth five (5) points.

3. Any "Wind" direction card (Deep Blue Color), namely E1, S2, W3 and N4 is worth two (2) points.

4. Any Circle, Bamboo or Script suit card (Color Light Blue, Orange or Pink) is worth one (1) point.

How to Play the Game

Example for four players is set forth below. Each player is dealt four cards one at a time. Four cards are then dealt face-up or open-face at the center of the playing area. The dealer starts by drawing a card and place it face-up with the others that are already in the common area called the "fish pond". To start playing the first player finds out whether he can "fish" anything. That means the player tries to find out between the cards the player has in his or her possession (the "bait") and the cards in the "fish pond", whether any three cards match in color or suit class. If they do, then the three cards can be "fished". If there are more than one set of any three cards having matched color or suit class, all sets can be "fished" at the same time. Note that the Feng Shui or F cards are designated to have a wild color, meaning that they can assume colors Red, Green or Deep Blue. Examples of sets of three cards having a color or suit class match are illustrated below:

1. Any three F cards.
2. Any three Green Dragon (GD) cards.
3. Any one F and two GD cards.
4. Any one F and two Wind Direction cards.
5. Any two F and one GD card.
6. Any two F and one Wind Direction card.
7. Any three Wind Direction cards.
8. Any three Circle suit (Light Blue) cards.
9. Any three Bamboo suit (Orange) cards.
10. Any three Script suit (Pink) cards.

After the first player finishes "fishing", the turn will be passed on to the player to the right. This player will first draw a card and place it face-up at the "fish pond" and this player will try to "fish" according to the matching rules established above. After that, it is the player to this player's right's turn to "fish" and so on.

The game ends after all the cards are drawn and no player is able to "fish" any more cards. The players then count up their points and whosoever gets the highest point score will be declared the winner of the game.

To play a longer and more satisfying game, the scores of each player can be accumulated up to a predetermined number of games, say 3, 5 or even 10, before a winner is declared. The player with the highest sum score for the total number of games played will be declared the winner.

15. The Fortune Teller™

The following game is meant to be entertaining, and it should be taken in the spirit. It probably is a game that will appeal more to a person of Eastern origin than to one of Western origin.

Shuffle the Dragon Deck real well and have it cut as usual before one starts. Deal the first card faced-up on one's left hand side and the next one faced-down on one's right hand side to form two stacks. Keep doing this until one of the five Feng Shui cards shows up on the left hand stack of cards. When this happens, remove this card and place it in an area at about six inches from the two stacks of cards being accumulated. This becomes one of the fortunes of the player whose fate is to be decided later in the game.

Following the Feng Shui card just put away, continue to deal the next card faced-up for the left hand stack. If this card is another Feng Shui card, treat it the same way as the earlier one to form another column. (Note that the Feng Shui cards are numbered from A1 through A5. When there are more than one Feng Shui cards showing up, order them according to their number in ascending order from left to right.) Continue dealing the next card faced-up. If this card is not a Feng Shui card, then deal the next card faced-down to the right hand stack. Continue dealing the rest of the cards and putting away any additional Feng Shui cards as before until all the cards are dealt. This finishes the so-called Fortune round. During this round, there might be anywhere from zero to five Feng Shui cards showing up to be put away to form columns. These are the potential fortunes for the player to be decided by the next two rounds of play. It is very rare if all five Feng Shui cards show up during this round. It is equally rare for no Feng Shui card to show up at all. If the latter case prevails, you might want to stop playing now for a while. Stay cool and live your life normally until you have a chance to play the Fortune Teller again.

The next round of play is called the Ying round. If any of the Feng Shui cards proves out to be true (see below), then the prospect of this fortune happening in the near future is virtually a certainty. The round following the Ying is called the Yang round. If any of the Feng Shui cards proves out to be true during this round, then the prospect is excellent that the fortune will happen soon in your life.

To start the Ying round, put the faced-up stack of cards accumulated during the Fortune round faced down on top of the right hand side stack. Start dealing again with the first card on top faced-up as before on the left hand side. If this card dealt is either East (E1), South (S2), West (W3), North (N4) or the Green Dragon (GD), called the P-cards as a group but of different types, put it down under the left-most Feng Shui card column. Continue to deal the next card faced-up again to the left stack. If this card is another P card of the same type as the previous one, put this P card under the same column as the earlier one. If this P card is of a different type, put it under the Feng Shui card column immediately to the right of the first one if there is one. In other words, treat this P card as a don't care card if there is no more Feng Shui card column available and put it faced-up on the left stack. Deal the next card faced-down on the right hand side similar to what has been done before. Continue dealing all the remaining cards and attempt to build up four P-cards of the same type under any Feng Shui card column. When all the cards are dealt, it will be the end of the Ying round. If any Feng Shui card column successfully collects all four P-cards of the same type during this round, then the chance of the fortune represented by that Feng Shui card taking place in the future virtually a certainty.

Now put the faced-up stack of cards on the left side faced-down on the right stack to start the Yang round. The procedure is exactly the same as that for the Ying round. During the subsequent card dealing, any P-card shows up on the left hand side can either be put under a Feng Shui card column having already P-cards of the same type or regarded as a don't care. When all the cards are dealt, the Yang round ends. Now investigate whether any Feng Shui card column has successfully collects all four P-cards of the same type. If so, the chance that the fortune represented by that particular Feng Shui card taking place will be excellent.

16. The Fortune Dragon™

Like The Fortune Teller, the following game is meant to be entertaining, and it should be taken in the spirit.

Shuffle the Dragon Deck real well and have it cut as usual before one starts. Deal the first card faced-up on one's left hand side and the next one faced-down on one's right hand side to form two stacks. Keep doing this until one of the five Feng Shui cards shows up on the left hand stack of cards. When this happens, remove this card and place it in an area at about six inches from the two stacks of cards being accumulated. This becomes one of the fortunes of the player whose fortune is to be decided later in the game.

Following the Feng Shui card just put away, continue to deal the next card faced-up to the left hand stack. If this card is another Feng Shui card, treat it the same way as the earlier one to form another column. (Note that the Feng Shui cards are numbered from A1 through A5. When there are more than one Feng Shui cards showing up, order them according to their number in ascending order from left to right.) Continue dealing the next card faced-up. If this card is not a Feng Shui card, then deal the next card faced-down to the right hand stack. Continue dealing the rest of the cards and putting away any additional Feng Shui cards as before until all the cards are dealt. This finishes the so-called Fortune round. During this round, there might be anywhere from zero to five Feng Shui cards showing up to be put away to form columns. These are the potential fortunes for the player to be decided by the next two rounds of play. It is very rare if all five Feng Shui cards show up during this round. It is equally rare for no Feng Shui card to show up at all. If the latter case prevails, you might want to stop playing now for a while. Stay cool and live your life normally until you have a chance to play the Fortune Dragon again.

The next round of play is called the Ying round. If any of the Feng Shui cards proves out to be true (see below), then the prospect of this fortune happening in the near future is virtually a reality. The round following the Ying is called the Yang round. If any of the Feng Shui cards proves out to be true during this round, then the prospect is excellent that the fortune will happen soon in your life.

To start the Ying round, put the faced-up stack of cards accumulated during the Fortune round faced-down on top of the right hand stack. Start dealing again with the first card on top faced-up as before to the left hand side. If this card dealt is either East (E1), South (S2), West (W3), North (N4) or the Green Dragon (GD), called the P-cards as a group, put it down to the left stack and continue dealing a faced-down card to the right stack. On the other hand, if this card is one that belongs to either of the three suits, namely Circles, Bamboos or Scripts, put the card under any of the Feng Shui card columns. Deal the next card faced-up again to the left stack. If the card is either a P or Feng Shui card, deal the next card faced-down to the right stack similar to what has been done in the Fortune round before. If the next faced-up card is another S card, then put it under another unoccupied Feng Shui column if available. If no more Feng Shui column is unoccupied or available and if the card is not the same suit as the other S cards already put under other Feng Shui columns, then treat this card as a don't-care card and continue dealing a faced-down card to the right stack. Continue dealing all the remaining cards and attempt to build up the same S cards under any Feng Shui card columns. When all the cards are dealt, it will be the end of the Ying round. If any Feng Shui card column successfully collects all the S cards of a particular suit (9 cards) during this round, then the chance of the fortune represented by that Feng Shui card taking place in the future is virtually a certainty.

Now put the faced-up stack of cards on the left side faced-down on the right to start the Yang round. The procedure is exactly the same as that for the Ying round. During the subsequent card dealing, any S card shows up on the left hand side can either be put under an available Feng Shui card column or regarded as don't care. When all the cards are dealt, the Yang round ends. Now investigate whether any Feng Shui card column has successfully collects all the same 9 S-cards of the same suit. If so, the chance that the fortune represented by that particular Feng Shui card taking place will be excellent.

III. New Casino Games Incorporating a Feng Shui Element in a Medium Apart from Cards Up until now great attention has been paid to the Chinese Poker Deck and the wealth of games that can be played with it. It is now time to look at some new non-card games that can be incorporated into an East-West casino; after all, casinos are not limited to card games.

A. The Casino Feng Shui™ Game

This game has been designed to meet the expectations of ethnic gamblers, especially the Chinese. Since most Chinese people love to play Mahjongg, this newly invented game uses the Chinese cultural folklore of "Feng Shui" and the twelve Chinese Zodiac animal signs as backgrounds. The game is described in a previously filed patent application, U.S. patent application Ser. No. 10/919,092, the disclosure of which is specifically incorporated herein. Because a description of this game will be necessary to understand certain aspects of the present invention, portions of this prior application will be repeated herein.

Figure 13:
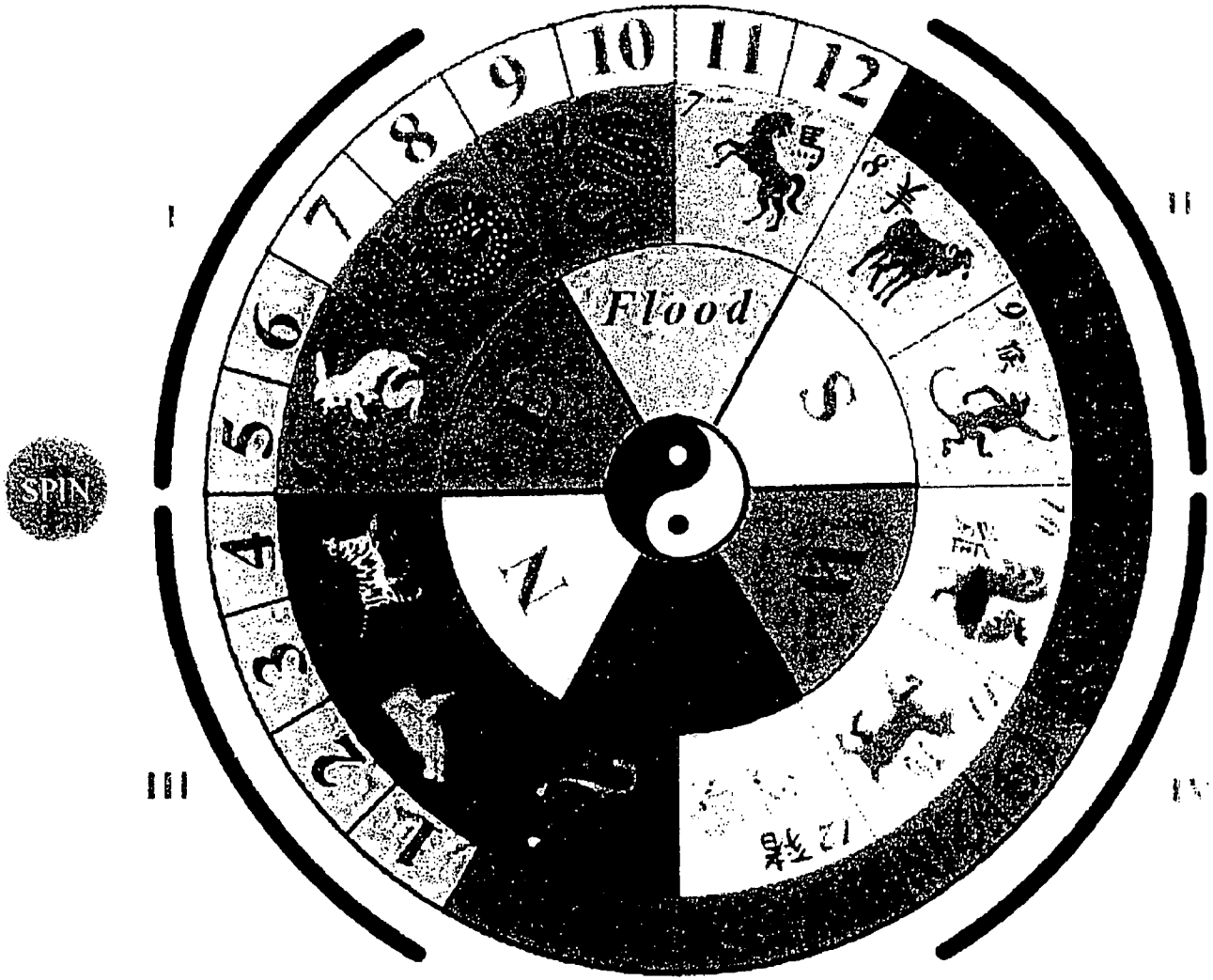
FIG. 13 illustrates the carousel for playing the "Casino Feng Shui Game."

The present game is designed for two to four players to play. Since the players are basically playing against one another, any number of players between two and four can play this game. Besides the casino chips which are used as game money, the game equipment comprises a carousel and 40 asset tiles. FIG. 13 shows the carousel which is a composite structure of three wheels sharing a common axis but each of them has its own degree of freedom. In other words, each of the three wheels can either rotate clockwise or counterclockwise and can land at its own final spot or location independent of the others after a spin. The innermost wheel is called the Feng Shui wheel, the middle the Animal wheel and the outermost the Time Passage wheel. There are four pointers in the form of circular arcs located at four distinct locations outside perimeter of the carousel. Before the game starts, each player (up to four) takes up one of the respective four pointers marked according to where the player sits around a square table for four. What comes out of a spin for a player depends on where each of the three wheels respectively ends up at the player's pointer.

In addition to being assigned a specific pointer, each player takes possession of 10 asset tiles. The 40 asset tiles make up three distinct asset sets clearly marked on the back of the tiles for asset set differentiation, namely the Feng Shui set, the Animal set and the Time Passage set. The Feng Shui set has four asset tiles and they are respectively the four wind directions East (E), South (S), West (W) and North (N). The Animal set has 12 asset tiles each is being represented by a zodiac animal. The Time Passage set has 24 asset tiles each representing a period of one hour and cover uniquely the 24 hours time span of a day. Of the 10 asset tiles randomly picked by a player before a play, one comes from the Feng Shui set, 3 from the Animal set and the remaining 6 from the Time Passage set.

The basic play for this game involves 1) the spinning of the carousel; 2) determination of the spinning outcome for each player according to his assigned pointer and 3) a comparison between a player's spinning outcome with the player's asset tiles in order to determine player winnings for that particular spin. Since the players are playing against one another, each player will pay the other players their winnings but will also receive the player's winning from them. Accordingly, a player will have a winning spin if the player receives more than the player pays out. On the other hand, a player will have a losing spin if the player pays out more than the player receives. The payment to the players by one another or the money settlement for each spin of the carousel must be completed prior to the start of another spin. The casino operator will demand a service charge from the players after a predetermined number of spins have been completed which can be one or four etc. to be solely determined by the casino operator.

As a casino game, a number of tables, typical 24 and each sitting four players, can be set in a so-called Feng Shui Parlor having an area of approximately 3,000 to 5,000 sq. ft. The Feng Shui carousel is set up electronically on three giant screens (16 ft.×20 ft. typical) on three sides of the parlor such that every player, irrespective of where the player sits, can enjoy a clear view of the carousel. The spinning of the carousel on the screens is also electronically controlled by a casino staff (projection technician). The next spinning of the carousel will start approximately 15 seconds after the sounding of an audible musical tone in order to alert all players to get ready for the next spin. It will take approximately 10 seconds for the carousel to start and stop. A one minute period (flexible) is allocated to the money settlement for each spin. Thus it will take on an average close two full minutes for the game to complete one carousel play.

Note that the casino Feng Shui game can be configured as an independent game set just like the Mahjongg set which can be purchased by anyone to use at home or on outdoor camping trips to play among family members and friends. In this case the custom developed software is provided in an CD and can be loaded to any PC or Laptop computer using a CD driver but without the need of any special application software. The computer monitor screen will replace the giant screens set up in a casino Feng Shui parlor to display the carousel outcome during the game play.

B. The Casino Feng Shui Sic Bo Game

The "Casino Feng Shui Sic Bo Game" takes advantage of the ancient Chinese game of Sic Bo (a dice game) as a basis to incorporate into it an important playing feature based upon the Chinese cultural folklore of Feng Shui. At the same time, the tumbling of the three dice in a cage is replaced with the spinning motion of a carousel whose design is based upon the use of a complex computer software program. The randomness of tumbling the three dice is not only faithfully reproduced via computer software by the carousel, the tumbling motion of the three dice and the outcome of the tumbling are also directly projected onto a giant display screen as a beautiful, multicolor and spinning image for all players to see.

The game is described in a previously filed patent application, U.S. patent application Ser. No. 10/941,514, the disclosure of which is specifically incorporated herein. Because a description of this game will be necessary to understand certain aspects of the present invention, portions of this prior application will be repeated herein.

Figure 14:
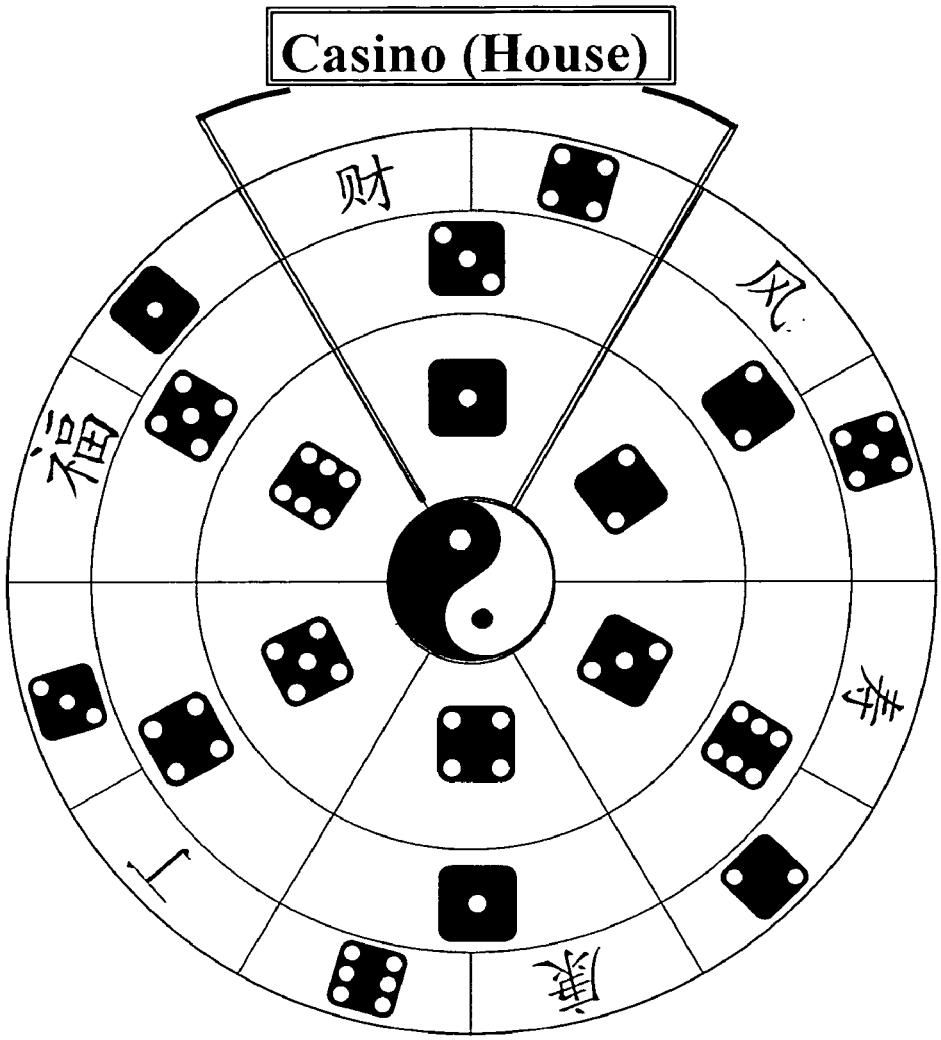
FIG. 14 illustrates the carousel for playing the "Casino Feng Shui Sic Bo Game."
Figure 14:
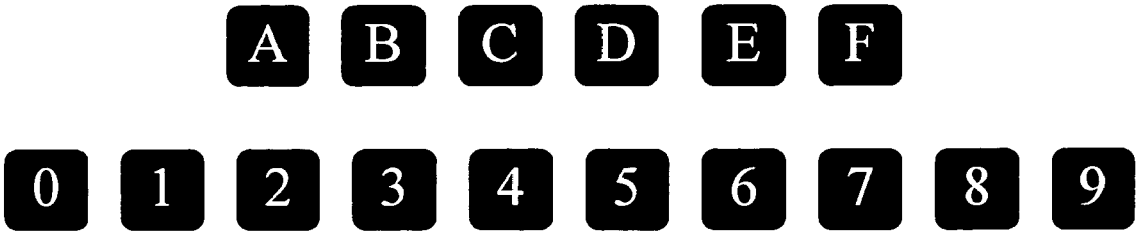

The carousel used in the playing of this game is shown in FIG. 14. This carousel, created via complex software programs, is a coplanar structure of three wheels, designated as the inner, the middle and outer wheel respectively, all sharing a common axis and also commonly "geared" to only six possible angular positions. Each of the three wheels can rotate with their own degree of freedom. In other words, each wheel can either independently rotate in a clockwise direction, a counterclockwise direction or remain stationary. Both the inner and the middle wheel are divided up into six equal sectors each of which spans an angular extent of 60 degrees out of a possible 360 degrees for a circle. The outer wheel is divided into twelve (12) equal sectors each spanning an angle of 30 degrees.

Because of the fact that the three wheels are commonly electronically "geared" or "registered" to rotate in only intervals of 60 degrees, the wheels cannot arbitrarily be stopped with their sectors randomly registered in angles other than exactly 60 degrees. To add contents to the respective wheels, both the inner and the middle wheel are populated with the numbers of the six faces of a dice, namely one, two, three, four, five and six. For the outer wheel, six sectors are filled with the numbers of the six faces of a dice, like the inner and middle wheels. The other six sectors are filled with the six opportunities of Feng Shu identified earlier, namely Wind, Wealth, Fertility, Longevity, Luck and Health. Thus, when the three wheels of the carousel are made to spin and stop randomly according to a random number generator software application, their final positions with respect to a fixed angular pointer spanning 60 degrees will also be random. With the exception of the addition of the six Feng Shui opportunity designators described above, the spinning and subsequent stopping of the three independent wheels of the carousel with respect to a fixed pointer is exactly likened to the tumbling of three dice with each wheel being identified as one of them.

By replacing the tumbling of the three dice in a traditional Sic Bo game with the spinning of the computer software carousel, the outcome of the tumbling for the Sic Bo game will be determined by the stopping position of the carousel at the designated pointer. In this way, the Chinese folk culture of Feng Shui can readily be incorporated into the traditional Sic Bo game. Also, most the deficiencies of the Sic Bo game as pointed out previously have been corrected.

C. The Casino Feng Shui Slot Machine Game

The Casino Feng Shui Slot Machine Game™ takes advantage of the fact that slot machines existing today are not devised based upon the concept of the ancient Chinese dice game of Sic Bo. The game is described in a previously filed patent application, U.S. patent application Ser. No. 10/941,513, the disclosure of which is specifically incorporated herein.

Figure 15:
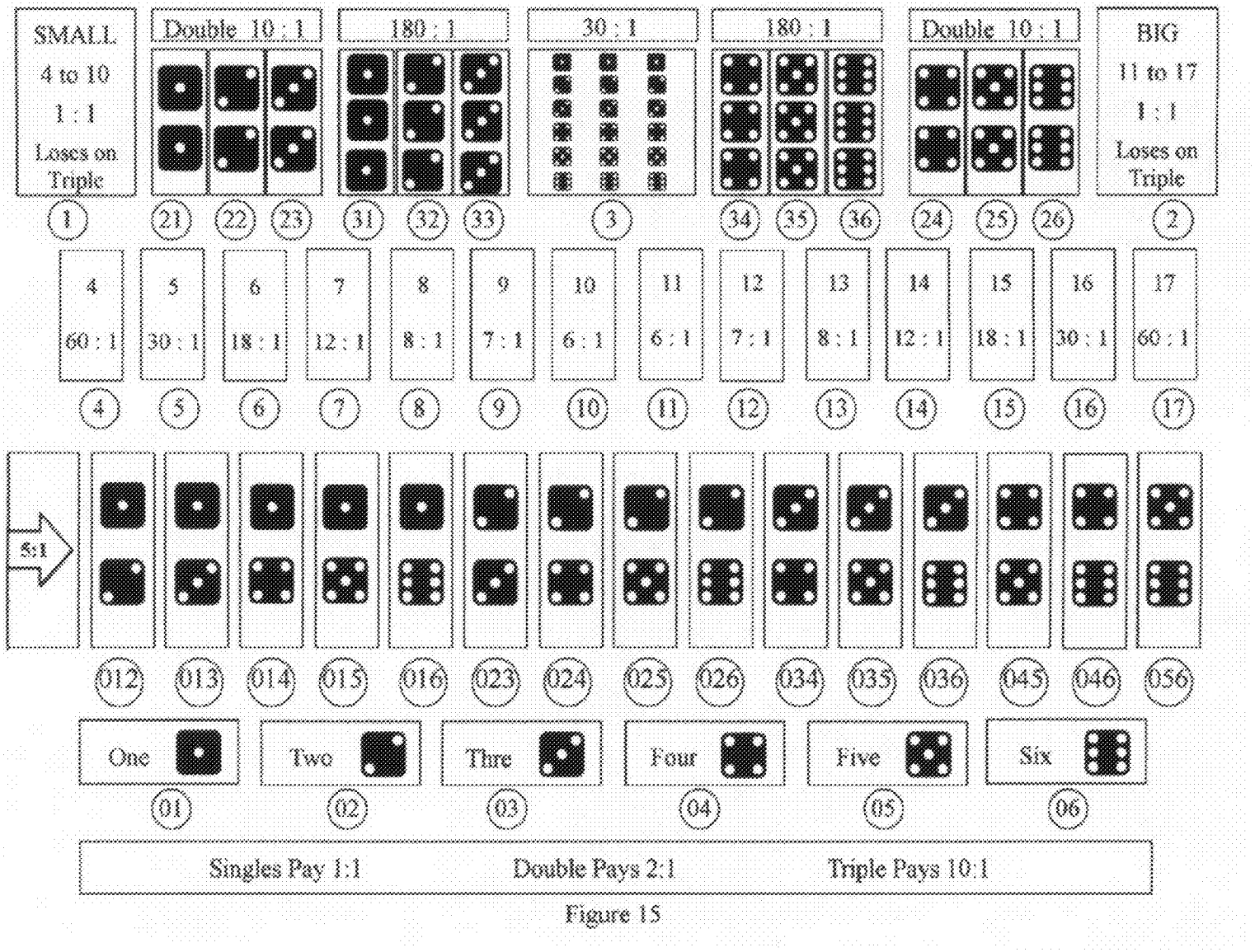
FIG. 15 is a list of alphanumeric codes for all possible bets for the Feng Shui Slot Machine game.

The current invention is in essence an extension of the second casino game described earlier, namely "Casino Feng Shui Sic Bo Game". However, in order for one to be able to implement the Casino Feng Shui Sic Bo game as a slot machine game, its extensive betting possibilities (exactly 50 ways) must first be systematically and logically coded using a novel representation scheme. Such a novel alphanumeric representation or coding scheme for the 300 possible bets to play the Sic Bo game including the Feng Shui feature is devised and is shown in FIG. 15.

Figure 16:
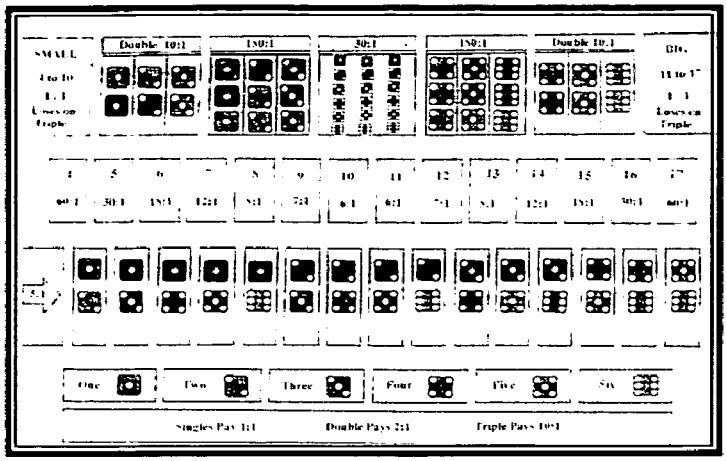
FIG. 16 is a representation of the Feng Shui Slot Machine showing a summary of all possible bets with their alphanumeric codes and payout odds (top), display screen (middle) and buttons A-F and 0-9 for entering various bets (bottom).
Figure 16:
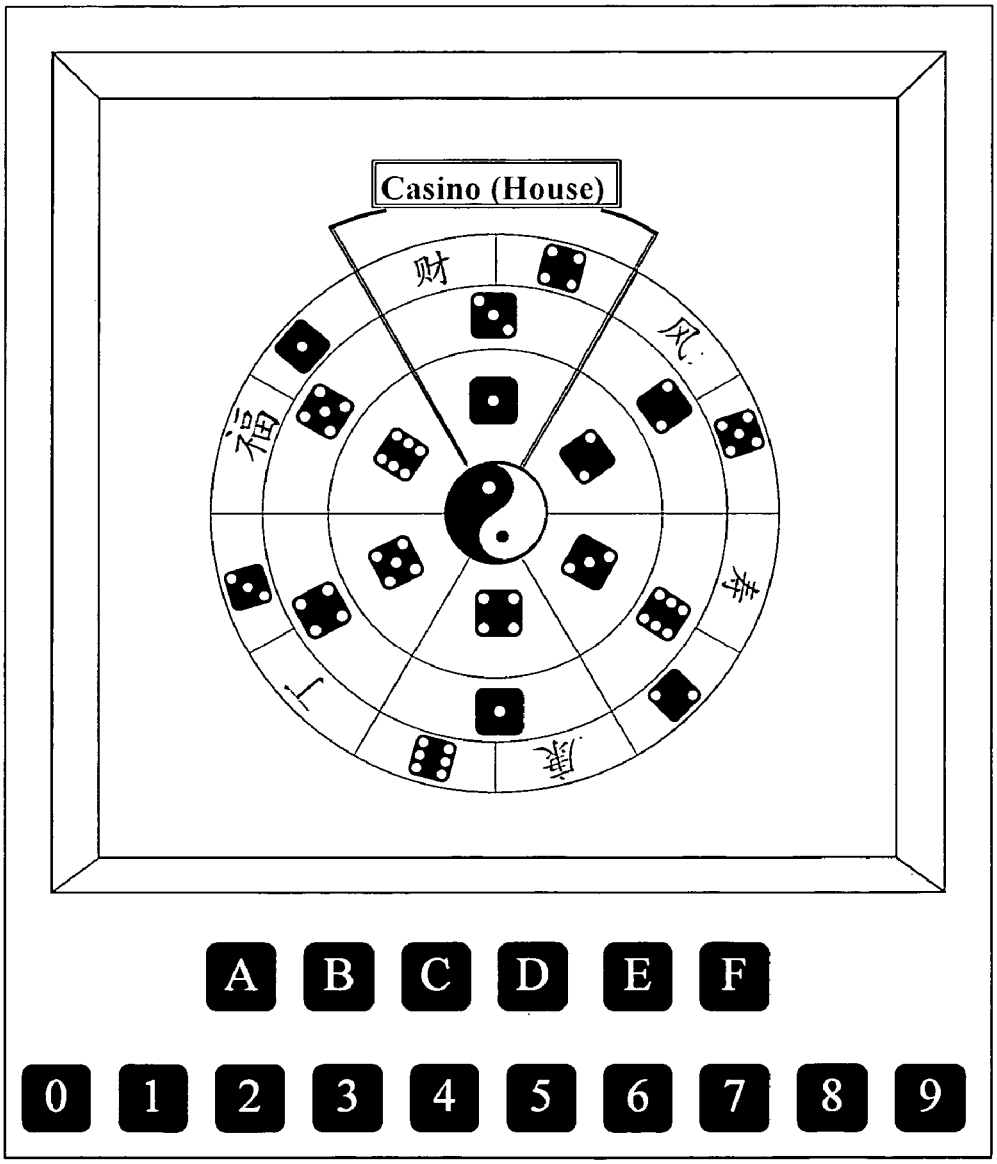

FIG. 16 shows a partial design representation for the currently invented Feng Shui Slot Machine showing a summary of all possible bets with their alphanumeric codes and payout odds, display screen and the buttons A-F and 0-9 for entering various bets.

D. Yin Yang Roulette Game™

The earliest version of the modern-day casino game of roulette was believed to be invented in England back in 1720 under the name of "roly-poly." Roly-Poly used the horizontal gaming wheel with the sole purpose that it could be hidden much easier than a vertical wheel from authorities but was banned nonetheless in England in 1745. The game survived in France and by the late 1700s a version of it emerged having alternated red and black slots, as on modern roulette wheel, but still without numbers. It was not until dozens of years later that the 36-number feature of the Italian ball game "biribi" was adapted to the game and became known as the modern-day roulette. Fully modern wheels, complete with numbered slots and both a zero and double-zero, have been traced to Paris in the early 19th century.

The roulette wheel has not changed much since its introduction in 1842. One small change was the introduction of the color green to the wheel. Originally the zero slot was red and the double-zero slot was black but this confused some players. To eliminate confusion the black and the red colors were changed to green.

In the United States the double-zero roulette wheel has become the standard. It was introduced by Europeans to the city of New Orleans and became popular in the west during the California Gold Rush. The casino edge on the double-zero roulette is 5.26% and the game is not very popular, because other games, such as craps, offer a player much better odds.

As it turns out, roulette has the potential of being able to resonate with popular Chinese gambling games and particularly with the ancient Chinese cultural concepts of Yin Yang and Feng Shui in the fusion of a new casino game. To start, roulette has the dynamic motion of its rotating wheel with the bouncing of a small ball around its perimeter during the play. From the Chinese cultural standpoint, the rotation of the roulette with its bouncing ball is likened to a human being caught in the midst of life itself as metaphorically manifested by the rotating earth (wheel). The number slots of the roulette wheel further resemble the passage of time as the roulette rotates around and around until it stops. Thus, there is a subtle link between roulette and Feng Shui (wind and water or the turbulence of life). Unfortunately, the resonance just about stops right there if no further modification to the game of roulette is advanced. In the current invention, the idea of adding another small ball to the roulette wheel but allowing the balls to rotate in the wheel in opposite directions brings forth precisely and elegantly the Chinese Yin Yang concept. After all, The Chinese concept of Yin Yang denotes two opposing forces and there is no closer manifestation of this concept than the rotation of two small balls in opposite directions confined to the same track of the roulette wheel.

It is interesting to note that almost 250 years have gone by but yet there has been no modification at all to the roulette game of the 18th century. In order to make this new casino game resonate or reinforce the conceptual spirit of Yin Yang, a second small ball is added to the traditional casino game of roulette and then the result is connected with the popular Chinese gambling games in the present so-called "Yin Yang roulette" game. This is done by replacing the 38 number slots (inclusive of the zero and double-zero) of roulette with the different arrangements of tiles for the Tin Gau, Mahjongg, and Fan Tan games, respectively. As a result, a total of three Yin Yang Roulette Games™ have been invented and identified by separate versions of Tin Gau, Mahjongg and Fan Tan, respectively.

In the Tin Gau version of the Yin Yang Roulette Game, the number of slots around the wheel is chosen as 48 instead of 38 for the traditional roulette wheel and the traditional circular wheel has been converted to a square one having twelve slots on each side. The reason why we can readily have a square wheel is that the latter can be created via computer software rather than using a traditional mechanical construction method. The display of the square wheel will either be on a projection screen, the monitor of any PC or Laptop computer, or a video slot machine when the game is played. Incidentally, the use of computer graphics and software programs is also the reason why there should be no problem at all in implementing two balls going in opposite directions around a square wheel in the design of the current invention.

Figure 17:
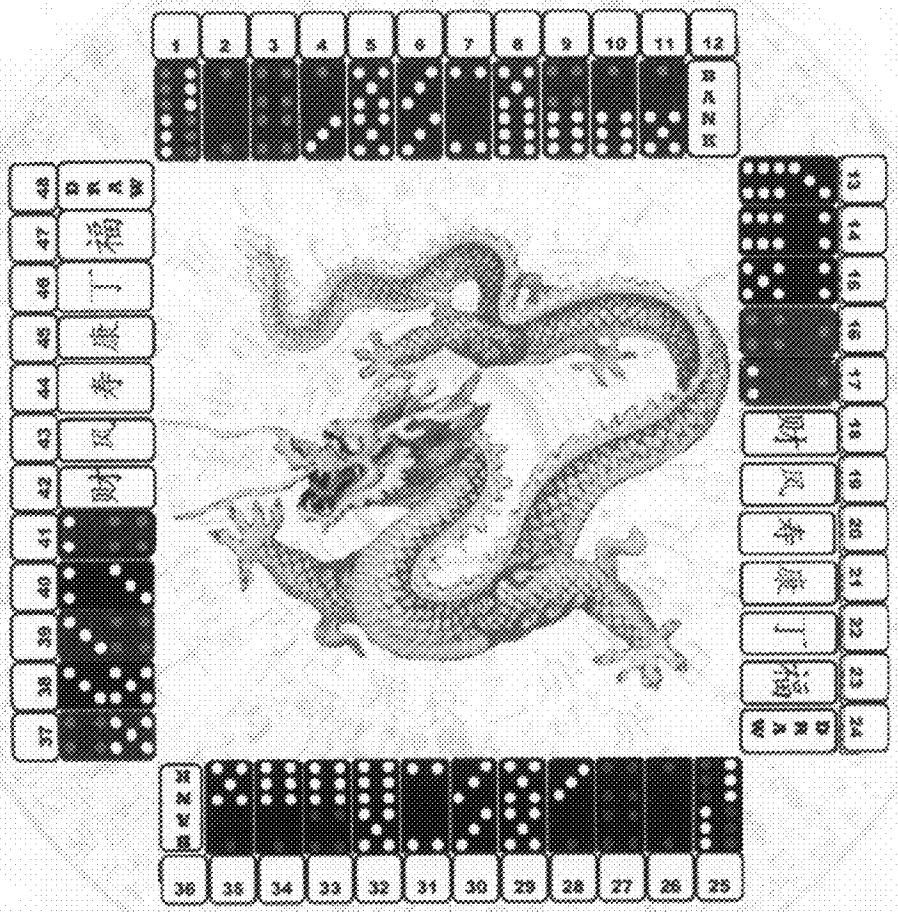
FIG. 17 illustrates the square wheel of the Yin Yang roulette casino game, Tin Gau version.

The reason why 48 slots (labeled from "1" to "48") has been chosen for the Tin Gau version of Yin Yang roulette is that, in addition to accommodating the 32 tiles of the Tin Gau game itself, 12 slots have been reserved for six pairs of Feng Shui tiles or parameters, two BANK slots and two DRAW slots. The square wheel of this game with its tiles layout is shown in FIG. 17. Starting with slot "1" of the wheel at the upper left hand corner and going clockwise, one half of the Yin set tiles or 11 tiles followed by a BANK tile have been arranged. The order of arrangement of the Yin set tiles is in the tradition of how the game is normally played. The role of the BANK tile will be described later on below. Starting with slot "13" and continuing going clockwise, one half of the Yang set tiles or 5 tiles followed by six Feng Shui tiles or parameters and a DRAW tile are arranged. The Chinese characters for the Feng Shui tiles starting from slot "18" mean, respectively, "Wealth (W)", "Wind (T)", "Longevity (L)", "Health (H)" "Fertility (F)" and "Luck (G)." Again, the role of the DRAW tile will be explained later below. Starting from slot "25" and continue going clockwise, the 9 Yin set tiles are repeated followed by the BANK tile. Finally, starting from slot "37" and finishing up the 48-slot square wheel are the 5 Yang set tiles, the six Feng Shui tiles and ending up with another DRAW tile.

Two balls, one red and one green, are generated also by computer graphic software randomly occupying at any one time two of the 48 slots shown in FIG. 16. At a "PLAY" command, the balls will move along the 48-slot number track 3 in opposite directions. After a predetermined period of time, typically a few seconds, both balls will stop randomly at one or two slots of the square wheel. In other words, it is possible that both balls may end up at the same slot number of the square wheel. The computer software program for the design of this game ensures that the outcome of the positions for the two balls in the 48-slot track 3 of the square wheel after every play will be completely random.

Figure 18:
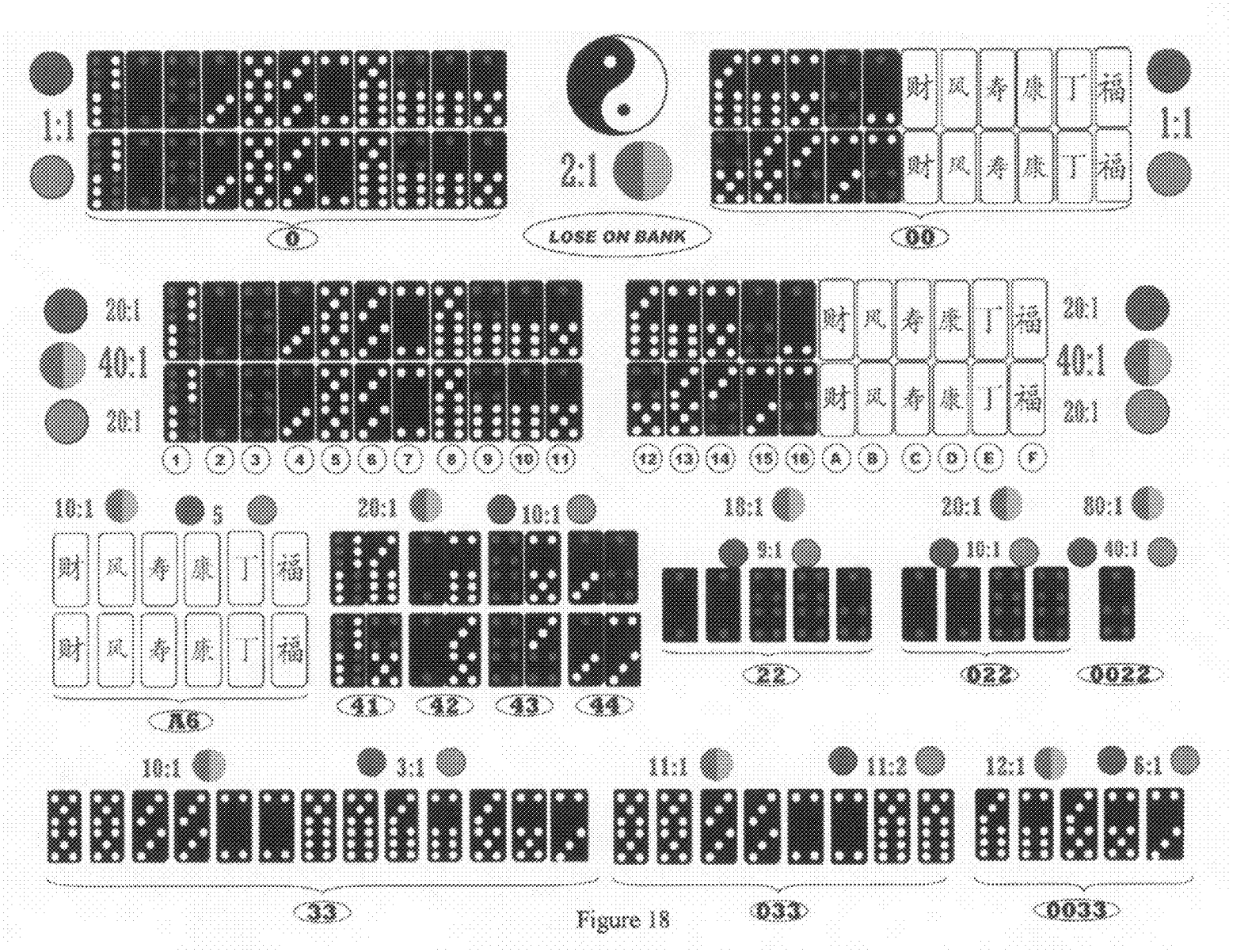
FIG. 18 sets forth the betting chart and betting codes for the Yin Yang roulette casino game, Tin Gau version.

Not unlike the traditional roulette game, there are many ways to bet for playing the game of Yin Yang roulette, Tin Gau version. Concomitant with the invention of this game, a betting chart compiling the various ways to bet on this game is presented in FIG. 18. In FIG. 18, the odds for various bets are shown and also the so-called betting codes in order to simplify and facilitate betting. As shown in FIG. 18, there are three distinct ways to play the game for a particular betting preference. They are simply referred to as 1) Red; 2) Green and 3) Red-Green or RG. To play Red, only the position of the Red ball counts and to play Green, only the position of the Green ball counts. However, to play RG, both the position of the Red and the Green ball count in the outcome of the play. As for the BANK slot, it is the House' advantage. In other words, if a Red ball lands on BANK, then all bets on the Red play lose, if a Green ball lands on BANK, then all bets on the Green play lose, and if both the Red and Green balls land in one or two BANK slots, then all bets lose for that particular play irrespective whether it is a Red play, a Green play or a RG play. The DRAW slots are NO PLAY slots. Any time a Red ball lands on DRAW, it is a draw for everybody betting Red, and any time a Green ball lands on DRAW, it is a draw for everybody betting Green. If both the Red and Green ball land on one or two DRAW slots, then the entire play is a draw or NO PLAY.

The simplest way to play the Yin Yang roulette, Tin Gau version, is to bet a "YIN" (code "0") or "YANG" (code "00"). Referring to FIG. 18 let us bet a Red "0" play. In this example, if the Red ball falls on any of the Yin set tiles (22 in total), then the player wins 1:1 whereas if the Red ball lands on any other slots (except DRAW), then the player loses. The same is true for betting a Green "0" play. Here if the Green ball lands on any of the Yin set tiles, the player wins 1:1, otherwise the player loses (except for a DRAW). However, if one bets a RG "0" play, then both the Red and the Green balls have to land on any of the Yin set tiles before the player wins, but then the payoff is 2:1 for a win.

Note that in order to balance the 22 Yin set tiles and the 10 Yang set tiles, 12 (or 6 pairs) of Feng Shui parameter tiles described earlier have been added in order to make the number of Yang set tiles also 22. Thus, when one bets the Red "00" play, the player will win when the Red ball lands on any of the Yang set tiles (10) or any of the Feng Shui parameter tiles (12) with 1:1 payout. The same is true for both the Green "00" (1:1) and the RG "00" (2:1) bets. The other available bets for this new casino game are summarized in the betting chart as shown in FIG. 18. Thus, for example, if one bets the Red "1" play, one will win with a 20:1 payout when the Red ball lands on either the No. 1 (call the "Tien" tile) or the No. 25 (also "Tien" tile) spots.

The design and configuration of the new casino game Yin Yang roulette for the Mahjongg and Fan Tan versions are virtually identical to that for the Tin Gau version except for the layout design of the square wheel, the betting chart and codes for the playing of the respective games.

Figure 19:
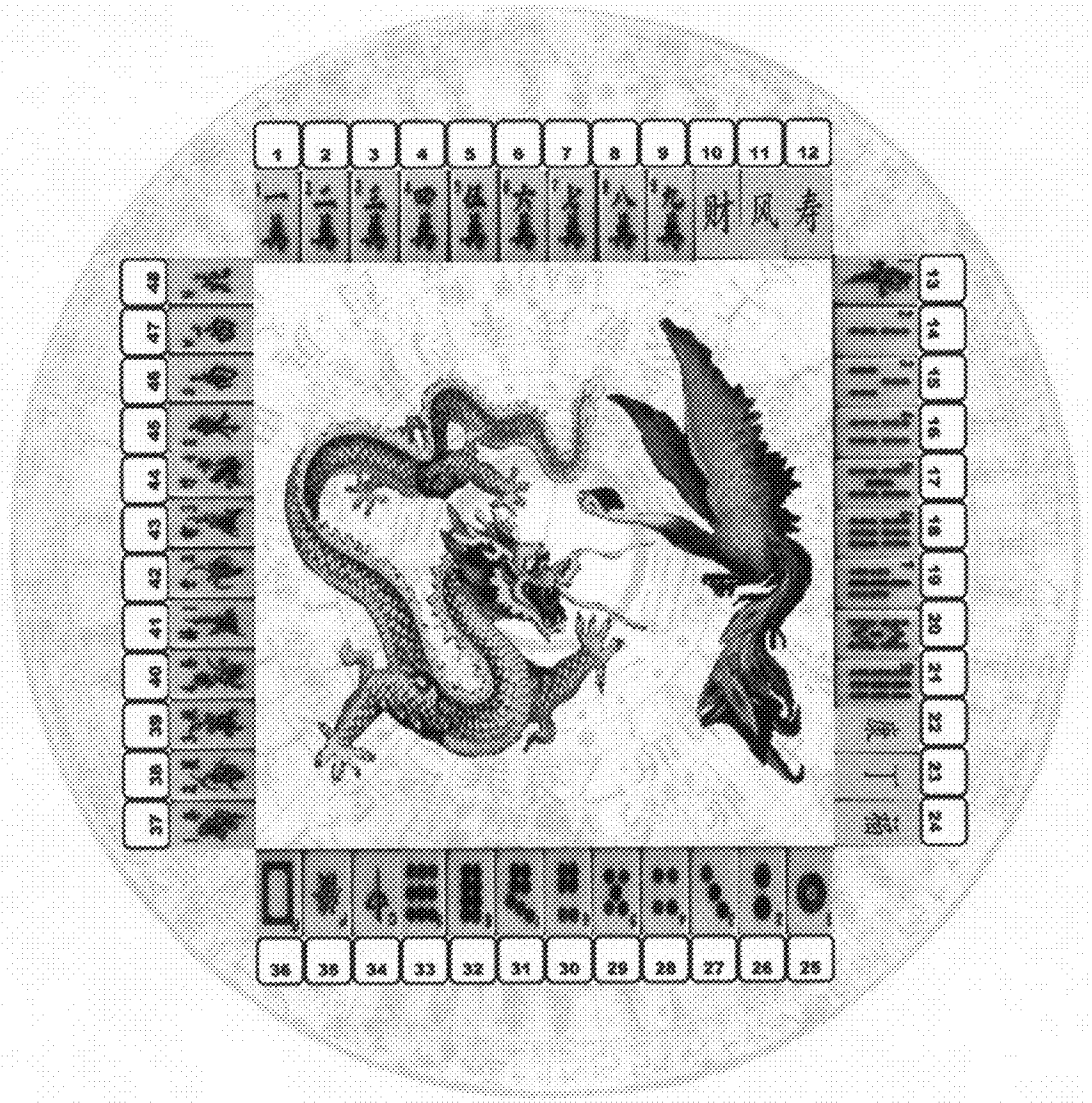
FIG. 19 illustrates the square wheel of the Yin Yang roulette casino game, Mahjongg version.

Like the Tin Gau version (see FIG. 17), the Mahjongg version of the Yin Yang Roulette Game™ also has 48 slots in the square wheel as shown in FIG. 19. Starting with slot "1" at the upper left hand corner and going clockwise, the first 12 slots are occupied by the 9 tiles of the "Script" suit in ascending order, followed by the first three of the Feng Shui parameter tiles, namely "Wealth (W)", "Wind (T)" and "Longevity (L)." Starting with slot "13", the next 12 slots are occupied by the 9 tiles of the "Bamboo" suit, again in ascending order, followed by the remaining three Feng Shui parameter tiles, namely "Health (H)", "Fertility (F)" and "Luck (G)." Starting with slot "25", the next 12 slots are occupied by the 9 tiles of the "Circle" suit, again in ascending order, followed by the three dragon tiles, namely the Red, Green and White dragons. Finally, starting with slot "37", the next 12 slots are occupied by the 8 Flower tiles. The first four Flower tiles represent, respectively, the seasons "Spring", "Summer", "Autumn" and "Winter." The next four Flower tiles represent, respectively, the "Plum", the "Orchid", the "Chrysanthemum" and the "Bamboo" flowers. The 8 Flower tiles are followed by the four wind directions East (E), South (S), West (W) and North (N) to complete the 12 slots.

Although the tiles occupying the slots for the Yin Yang Roulette Game, both for the Tin Gau and Mahjongg versions, might appear to be extremely exotic and complicated for Western players to discern, for Chinese and Asian players, these tiles are as familiar to them as the 52 cards of the Poker deck are to Western players since most of these people have been playing the Tin Gau and Mahjongg games a large portion of their adulthood. Thus, it should not be surprising that these newly invented games should seem as familiar to Chinese and Asian players as the traditional roulette game is familiar to Western players.

Figure 20:
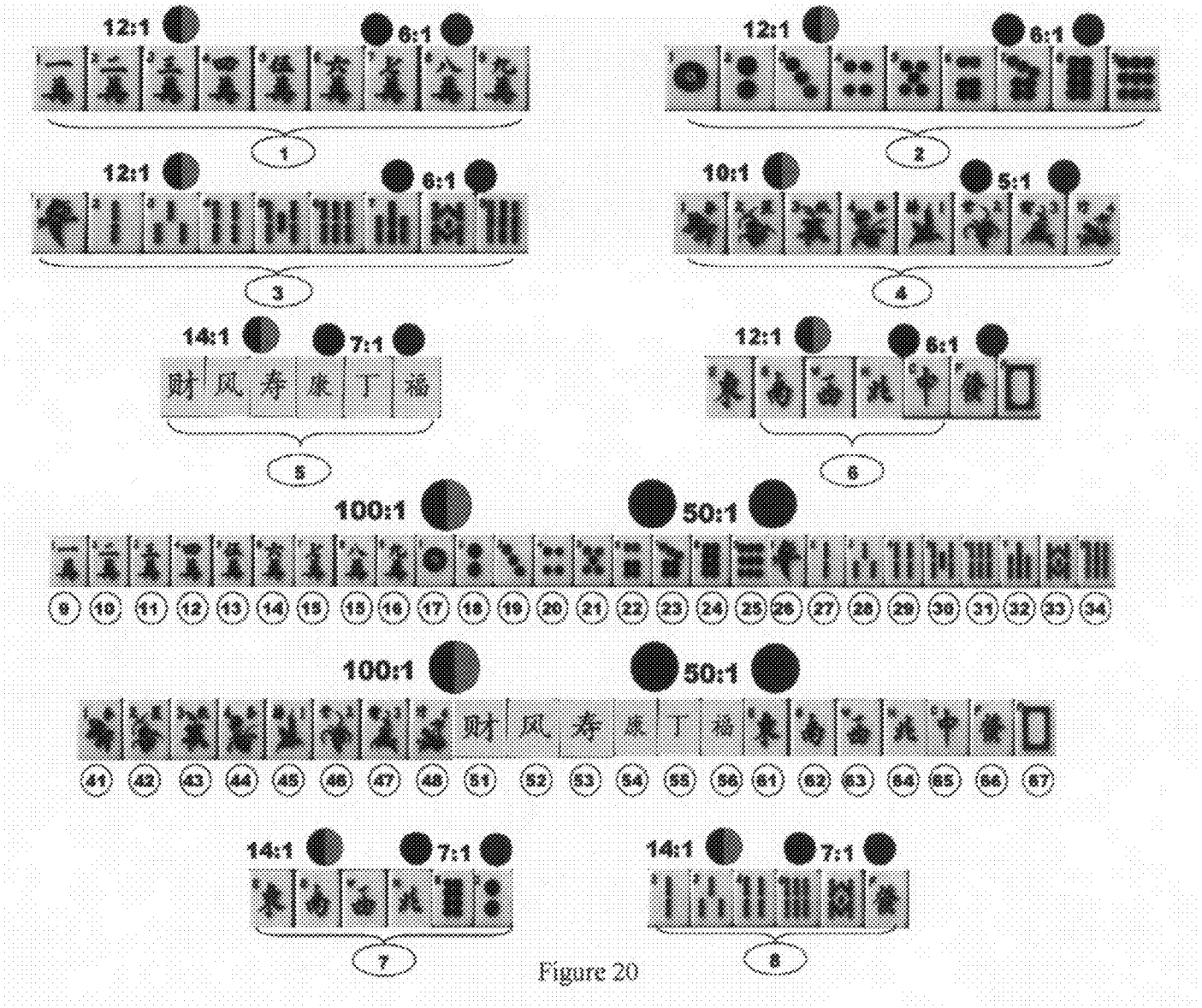
FIG. 20 sets forth the betting chart and betting codes for the Yin Yang roulette casino game, Mahjongg version.

Exactly like the Tin Gau version, the Mahjongg version will also have two balls, one Red and one Green, moving in opposite directions along the 48-slot track of the square wheel (see FIG. 19) in the playing of the game. The betting chart together with the betting codes for the Mahjongg version of the Yin Yang roulette casino game are shown in FIG. 20. Much like the way to bet the Tin Gau version which follows closely the rules for playing the Tin Gau game itself, the way to bet this Mahjongg version is also along the same line of thought. Thus, the bet Red "1" play (see FIG. 20) means that if the Red ball lands in any one of the "Script" set tiles, namely slots "1" through "9", then the player will win and the payoff is 6:1, the bet Red "2" means that if the Red ball lands in any one of the "circle" suits of the Mahjongg set tiles, then the player will win and the payoff is 6:1, and the bet Red "3" means that if the Red ball lands in any one of the "Bamboo" suits of the Mahjongg set tiles, then the player will win and the payoff is 6:1. If one bets RG "5", for example, referring to FIG. 20, then if both the Red and Green ball land on any of the Feng Shui tiles, namely slots "10" to "12" or "22" to "24", then the player will win and the payoff is 14:1; otherwise the player will lose if either the Red or the Green balls lands elsewhere.

Figure 21:
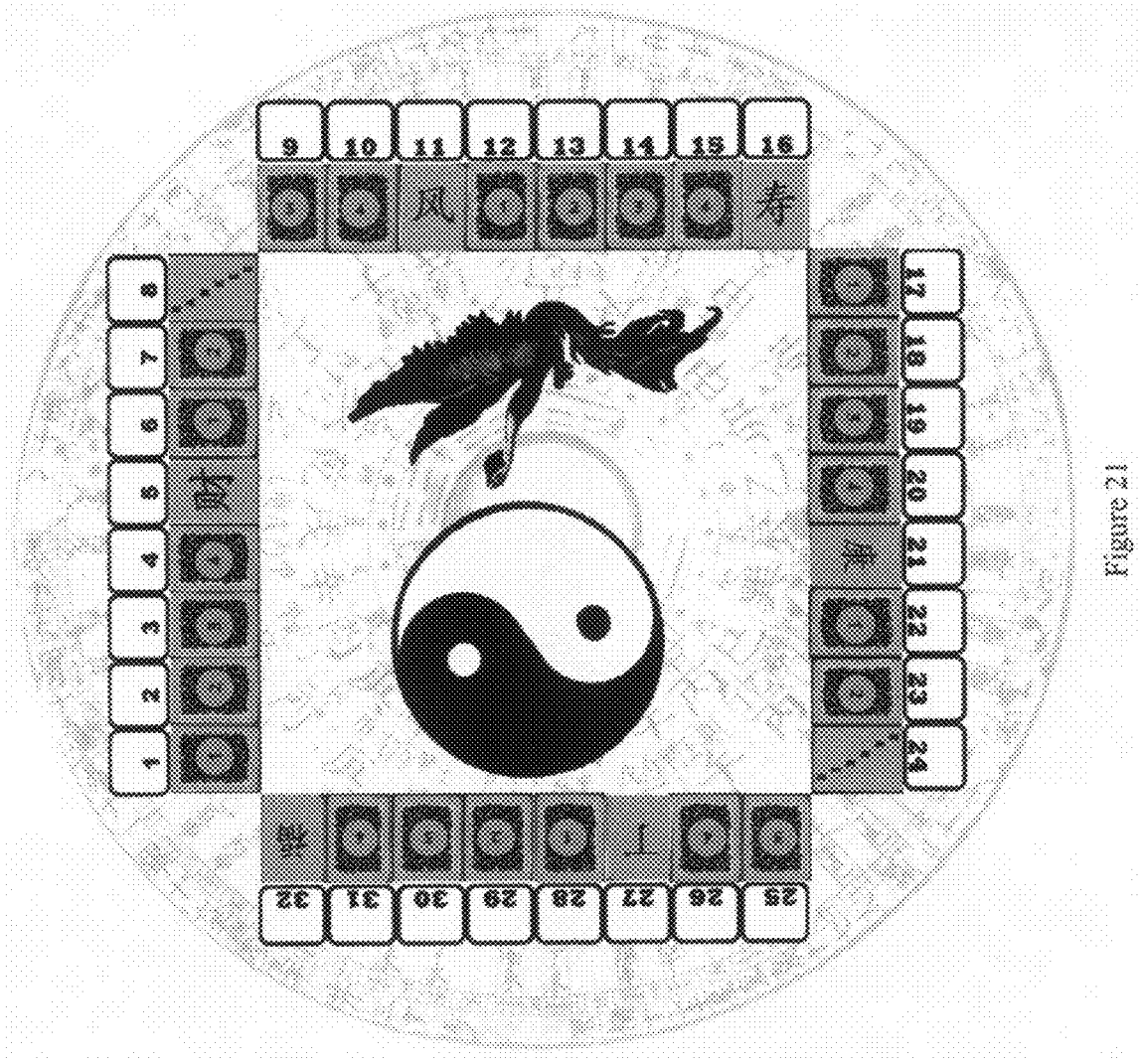
FIG. 21 illustrates the square wheel of the Yin Yang roulette casino game, Fan Tan version.

Unlike the Tin Gau and the Mahjongg versions, the Fan Tan version of the Yin Yang Roulette Game™ will only have 32 slots in the square wheel with eight slots on a side as depicted in FIG. 21. Starting with slot "1" at the upper left hand corner, the first eight slots going clockwise are occupied by the four possible Fan Tan outcomes of the play, namely, "1", "2" "3" and "4" followed by one Feng Shui parameter tile, namely "Wealth (W)," and then by two Fan Tan outcome tiles "1" and "2" and finishing up with the "BANKER" tile. Starting out with slot "9" the next eight slots are occupied first by the Fan Tan outcome tiles of "3" and "4", the Feng Shui parameter tile "Wind (T)," then the four possible Fan Tan outcomes of the play, namely "1", "2", "3" and "4" and finishing up with another Feng Shui parameter tile "Longevity (L)." Starting with slot "17" and continue going clockwise, the next eight tiles are occupied by the Fan Tan outcomes of "1", "2", "3" and "4" followed by the Feng Shui parameter tile "Health (H)" and then by two more Fan Tan outcome tiles "1" and "2" and finishing up with another "BANKER" tile. Finally, starting out at slot "25" the next eight tiles going clockwise are occupied by Fan Tan outcome tiles of "3" and "4", followed by the Feng Shui parameter tile "Fertility (F)," then four Fan Tan outcome tiles of "1", "2", "3", and "4" and finishing up with another Feng Shui parameter tile "Luck (G)."

Figure 22:
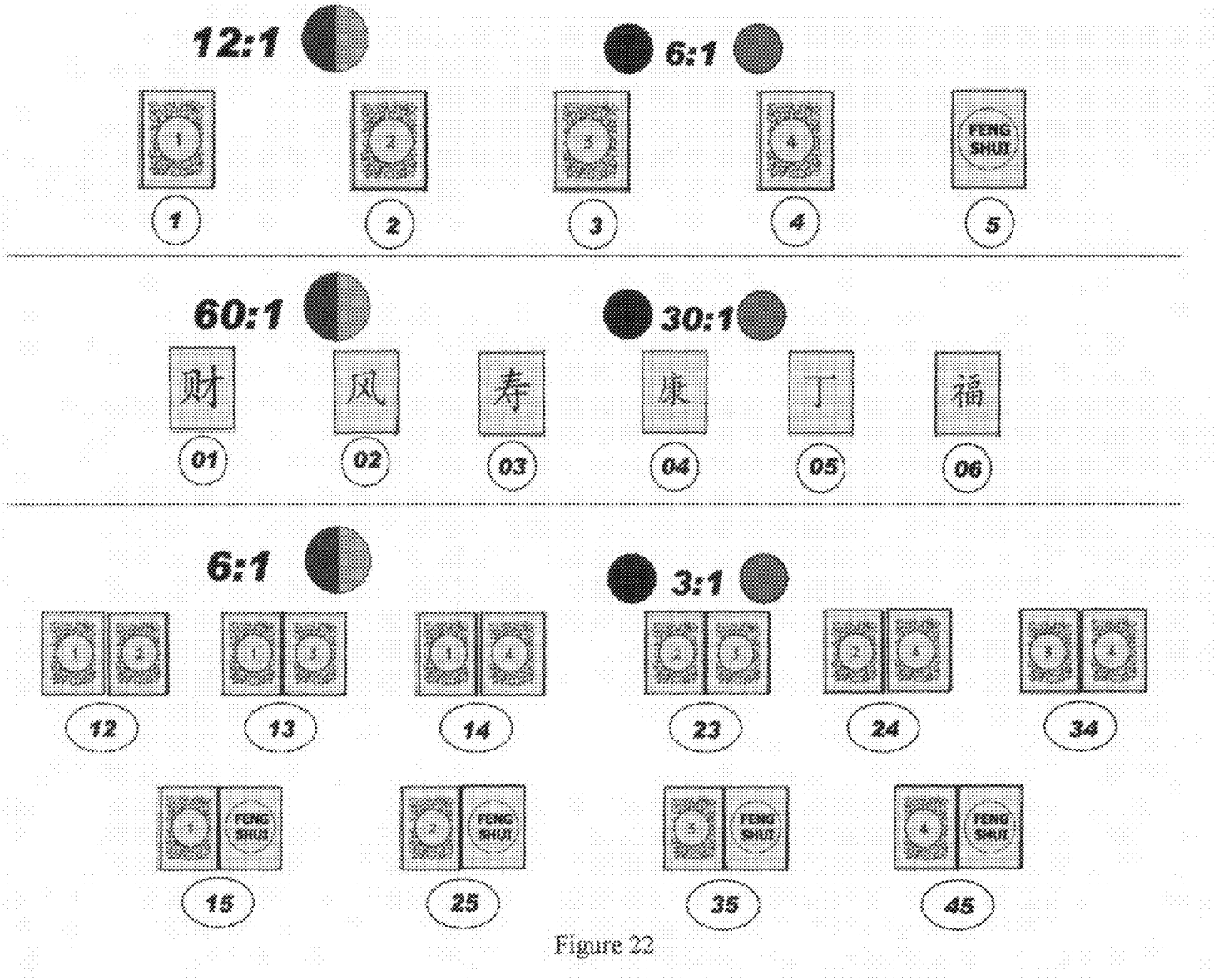
FIG. 22 sets forth the betting chart and betting codes for the Yin Yang roulette casino game, Fan Tan version.

Like the Tin Gau and Mahjongg versions, the Fan Tan version of the Yin Yang Roulette Game™ also has two balls, one Red and one Green, moving in opposite directions in the 32-slot track of the square wheel in the playing of the game. The betting chart together with the betting codes for the Fan Tan version of the Yin Yang roulette casino game is shown in FIG. 22. Preserving most of the betting scheme of the original Fan Tan game, the main betting centers around a single winning number (the number of objects remaining at the end of the separation of the bean or pebble pile), namely "1", "2", "3" and "4" and any two numbers, e.g. "1,2", "1,3" etc. For example, if one bets Red "1" using the betting codes as shown in FIG. 22, one wins if the Red ball lands on an "1" slot, such as slots No. 1, 6, 12, 17, 22 and 28 (see FIG. 21). The payout is 6:1. The same holds true for the bets Green "1" and RG "1" except that the payout is 12:1 for the RG bet. Similarly, if one bets Red "12", which is a two-number bet, one wins 3:1 if the Red ball lands on any "1" or "2" slots. The same holds true for the bets Green "12" and RG "12" except that the payout is 6:1 for the RG bet.

The addition of the Feng Shui parameters to the Ying Yang casino roulette, Fan Tan version, livens up the game tremendously and quite certainly to the delight of most Chinese and Asian gamblers. Thus, if one bets Red "5" (see FIG. 22 for the betting code assignment), one wins 6:1 if the Red ball lands at any of the Feng Shui parameter slots, viz. Slots No. 5, 11, 16, 21, 27 and 32. The same holds true for the Green "5" and RG "5" bets except that the payout is 12:1 for the RG bet. The Feng Shui parameter tiles can also be bet individually for much bigger payouts. For example, if one bets Red "01" (see FIG. 22) or the Feng Shui parameter of "Wealth (W)," one wins if the Red ball lands at the No. 5 or "Wealth (W)" slot. The payout is a whopping 30:1. The same holds true for the Green "01" and RG "01" bets except that for the RG bet, both the Red and the Green ball have to land at slot No. 5 simultaneously. The payout is a gargantuan 60:1. Finally, there are two BANKER slots which are the House' advantage in this game. Any time the Red ball lands at these two slots, the House wins or every Red bet loses, and the same rule applies similarly for the Green ball; however, any RG bet survives unless both the Red and the Green ball land at one or two BANKER slots simultaneously.

IV New Video Slot Machines

While the Casino Feng Shui Slot Machine Game is obviously a new slot machine game, almost all of the games already described can also be adapted for use in video slot machines (such as the Casino Feng Shui Sic Bo Game and the Yin Yang Roulette Game). In addition, The Casino Feng Shui Game can be adapted for use in a video slot machine linked with other similar machines so that players can play the game against each other. If such machines are linked together there may no need for the type of parlor already described since the game can be played by linked machines without the need for attendants; alternatively, such linked machines might be used as a good way to introduce players to the game in a low stakes environment, or to allow remote play over an on-line casino, while an actual parlor might be used to capture the excitement of group interaction or even be reserved for high rollers, frequent players or some other class of persons.

A. Video Poker Games with the Chinese Poker Deck

Based upon the disclosure so far, it is clear that pretty much all of the games now played with video poker games can be played with the Chinese Poker Deck, by just substituting the Chinese Poker Deck and adapting the game for the rules already noted. For instance, five card draw and Yangtze Hold 'em are naturals for video poker games, and there is no reason why Yangtze Hold 'em tournaments cannot be played online in the same fashion as Texas Hold 'em tournaments presently being played online. Similarly, all of the other card games already described involving the Chinese Poker Deck can also be adopted for play in video poker games or in an online environment.

B. Carousel-Type Slot Machines

A three wheel carousel was described above in the discussion of The Casino Feng Shui Game. The concept of such a carousel, or a variant of the same, is especially powerful for video slot machines. As noted above, when slot machines first came into existence, they were based upon actual mechanical reels that spun, albeit in a circular path perpendicular to the plane of viewing of the player, so that only a portion of the reel is visible to a player at any given moment. As these reels have been replaced with simulated reels, some old time players of slot machines have complained that the new slot machines have lost some of their appeal, and this is one reason why so many video slot machines go to such trouble to simulate the action of the old mechanical machines.

The use of a carousel can bring back some of what was lost when mechanical reels were replaced by simulated wheels, and even create a new sense of excitement not previously obtained with mechanical slot machines. This is because spinning wheels of a carousel have what might be seen as something akin to reels (albeit of different sizes instead of the same sizes found in old mechanical slot machines) that actually rotate in the plane of vision. So, depending upon the speed of rotation, just as is the case with the roulette wheel, the spinning of the carousel can be observed by the player. In addition, if the wheel is programmed to slow down in a fashion similar to a roulette wheel, the anticipation of where the carousel wheels will stop can heighten expectations and suspense and create an even more exciting sense of anticipation than can be achieved by traditional mechanical slot machines, especially if the wheels are programmed to stop at different points in time. Also, there is something especially visually appealing about having two or more wheels, rotating in opposite directions, eventually coming to a stop, especially if they are timed to heighten the expectation associated with the outcome and its payouts.

While the visual aspects and heightened excitement associated with a carousel having at least two spinning wheels traveling in opposite directions provides plenty of justification in and of itself for developing new video slot machines around such a format, such a format should also resonate with Eastern gamblers because of the ancient Chinese cultural concepts of Yin Yang. Now, if one also allows such gamblers to have an option of having the outcome determined by a Feng Shui element (which might be used in the same fashion as a 7 or some other symbol in a traditional slot machine, or if the player is allowed to select a particular Feng Shui element from a group of such elements as a potentially winning symbol, or even have an option buy that allows a player to select multiple Feng Shui elements for winning symbols), then such a machine can combine both Yin Yang and Feng Shui in a new, visually appealing and exciting format sure to intrigue, entice and satisfy many Eastern gamblers.

In designing a carousel for use in video slot machines, many different formats might be used. While it is believed that circular wheels should be used to resonate with the concepts of Yin Yang, one might decide, as a variant, to use some other shape, such as a square (which might resonate with Eastern gamblers for certain varieties of the Yin Yang Roulette Game involving tiles or Mahjongg variants, harkening back to the standard table of four in which the tile games are played).

In designing a carousel for use in video slot machines, the entire content of the carousel can be varied or shuffled, or only a portion of itself be varied or shuffled, as is discussed in previously filed U.S. patent application Ser. No. 941,514 for "Method and Apparatus for the Casino Feng Shui Sic Bo Game," and, more specifically, that portion of said description involving its FIG. 4, in which the Feng Shui elements might be fixed while the representations of dice could be electronically shuffled. If one compares a carousel slot machine structure to current reel slot machine structures, an immediately apparent difference is that outer wheels of a carousel are larger than inner wheels, which means it is easier for, such wheels to have more designations or symbols than inner wheel. Thus, in contrast to reels in which each reel typically has the same number of designations as the next reel, each wheel in a carousel may have a different number of designations. If some of the designations on the wheels are also shuffled, this gives a designer of a carousel-type video slot machine an almost unlimited range of possibilities of adjusting desired odds for one or more designations if one also considers varying the number of designations in the wheels, the number of wheels, and the variations in shuffled elements of wheels.

To avoid sensory overload, if more than three wheels are used in a carousel type video slot machine, it is presently believed that it is probably best not to have all of the wheels rotate, and instead have some such wheels only have shuffled representations, but if more than three wheel are rotated, it is probably best if they alternate rotating directions.

It should also be noted that, if one uses an inner wheel divided into six locations, there can be six different locations of "lines" for a given play of the carousel, as is the case when such a carousel is used in connection with the Casino Feng Shui Sic Bo Game. However, the number of spots on the inner wheel can be varied, thus also increasing the number and range of possibilities for video slot machine games. In addition, just as current video slot machines can allow for players to bet on multiple lines with additional coins, the same can be done in a carousel-type video slot machine. Also, in contrast to traditional reel-type slot machines, carousel-type video slot machines offer another unique betting opportunity in that a player might be allowed to bet on all of the "lines" found in a given play of the carousel. This opens up additional possibilities for bonus rounds or jackpots derived from matches found in multiple lines, especially if every visible line has a match, which certainly would be a visually pleasing and arresting sight to a player, and especially if such a possibility comes progressively into view as the various wheels stop at varying times.

Thus, in summary, it should be apparent that carousel-type video slot machines offer a new and visually exciting alternative to traditional reel-type video slot machines which can offer all of the advantages of the latter machines, while offering many new advantages, especially if such machines are coupled with new East-West fusion games.

C. Progressive Feng Shui Keno Slots

The game of Keno has been played in casinos in the United States (Las Vegas, Atlantic City and others) for decades. The game puts forth 80 numbers, from one to eighty, for players to guess which 20 of them will be randomly drawn during the game. During a particular game, players can bet anywhere from one number to all 20 numbers with different payouts if the appropriate numbers are correctly drawn. The most common bets are from 8 to 10 numbers when if all are drawn, a player wins the maximum payout allowed per game (usually $50K).

Equally popular for the Keno games are the so-called Keno slots. These are actually slot machines at which a player can play the game of Keno at any time. Although the odds are slightly worse in favor of the House, the Keno slots are much faster and players like their quick turnaround outcome without having to wait for each normal Keno game to complete and re-start. At the Keno slots a player can select how many numbers to play by punching in the numbers selected and the extent of a wager before pushing the "Play" button. The payout is automatic from the machine unless a player is lucky enough to win more than a stipulated amount (usually $1,000 or more) which will be paid instead by a change attendant.

Because Keno is played in almost every major casino in the United States, it offers a major opportunity and class for betting if a new fusion game can be invented that satisfies traditional Keno players, and such a game is also disclosed herein, although its description will require a digression into a description of the Chinese language.

It is a known fact that each and every Chinese character can be uniquely decomposed into their constituents, namely, symbols called "radicals," and the fact that every Chinese character can be dissected into a unique group of radicals is fundamental to understanding the current invention. Although there can be as many as 100,000 Chinese characters found in the Chinese National Dictionary compiled during the Ching Dynasty (1644-1911 AD), each character can be uniquely decomposed into a number of individual symbols called "radicals." These individual radicals, sequentially classified from the simplest to the most complicated, were themselves orderly compiled, based upon the number of strokes it takes to make a radical, also during the Ching Dynasty, into an official "Radical Chart." Today it is generally believed among Chinese scholars that there exists not just one official radical chart, like the one compiled during the Ching Dynasty, but a number of lesser known ones, each of which compiles all the radicals in an orderly fashion. Notwithstanding, all official radical charts are practically the same and differ from one another only to a minor extent; thus, although these charts are not the same in the minutest detail, they are all nonetheless equivalent in substance.

FIG. 23 shows the Official Radical Chart selected for devising the current invention. This chart is published in the *Elementary Kanji Dictionary* in 2001 by Kodansha International Ltd. And Kodansha America, the disclosure of which is specifically incorporated herein by reference. Note that the total number of radicals listed in this chart is 190 starting from radicals having just one (1) stroke to the last radical having fourteen (14) strokes as shown in FIG. 23. Each radical is assigned a number starting with those having just one stroke, namely, "-" having a radical number (RN) of #1 and going horizontally and down in FIG. 23 to "八" at the end of the second row having two strokes and an RN of #15. In the same manner, radical "大" will have three strokes and RN #41 (last radical of fifth row in FIG. 23).

Before one can proceed to devise a game using the radicals selected from the Official Radical Chart (see FIG. 23), one should understand a little bit about the utility structure of the Chinese language. It is commonly stated that the Chinese language has no alphabet but possesses a very large number of standalone and distinct characters. In fact, an ensemble of Chinese characters constitutes a "Unit of Meaning." An example of an ensemble of Chinese characters is shown in FIG. 24. There are four (4) Chinese characters in FIG. 24 lining up in a row. The "Unit of Meaning" of these 4 characters refers to what this ensemble of characters will convey to an observer or reader when the characters are read horizontally from left to right. On the other hand, when they are read from right to left, the four characters will literally have no meaning. Thus, it is very important to note that reading an ensemble of Chinese characters lining up in a row, it only makes sense if they are read from left to right instead of from right to left. If the Chinese characters are lined up in a column, then the "Unit of Meaning" represented by the characters is always interpreted from top to bottom without exceptions.

Each of the four Chinese characters shown in FIG. 24 can be uniquely decomposed into a number of radicals, and some of the radicals may be repeated in the same character. This can be analogized to decomposing an English word into its unique alphabetical letters (consonants and vowels) as illustrated in FIG. 25. In this figure, the first Chinese character "成" is decomposed in RN # 4, #1, #7 and #74 (see FIG. 23). The second character "敗" is decomposed into RN #16, #11 and #78. The third Chinese character "得" is decomposed into RN #63, #84, #1 and #45. Finally, the fourth character "失" is decomposed into RN #4, #1 and #41. From this example, one can see that an ensemble of Chinese characters, constitutes a "Unit of Meaning" and can be equated to one or more English words, also having a "Unit of Meaning." The summation of radicals representing the four Chinese characters can be analogized to the summation of letters (consonants or vowels) that makes up the English expression comprising one or more words.

The New Progressive Feng Shui Keno Slots.

The Progressive Feng Shui Keno Slots are new Keno slot machines with an added flavor of an Eastern cultural theme. In addition to the usual 80 numbers, this new game also features five (5) Feng Shui parameters represented by five distinctive Chinese characters, namely 1) Luck; 2) Longevity; 3) Wealth; 4) Health and 5) Fertility. Each Feng Shui character (see FIG. 26 which lists these five Feng Shui characters along with their radicals) is followed by three additional special Chinese characters to form a celebrated old Chinese saying. Thus, together there are a total of 20 Chinese characters forming five rows of four characters each. Each row of four Chinese characters represents a celebrated Chinese proverb relevant to the particular Feng Shui parameter that they follow. These five sayings, decomposed by radicals, are listed in FIG. 27. The meaning of the five celebrated Chinese sayings are, starting from the top 4-character row progressing down: "Luck"—Your luck is as big as the Eastern sea (referring to the Pacific Ocean); "Longevity"—Your longevity will be as old as the Southern mountain; "Wealth"—Your wealth will be like a water fountain rushing in all the time; "Health"—Your health and bliss will be godlike; and "Fertility"—Your descendants will fill the lobby of your gigantic mansion."

To make these specially added Feng Shui features even more fascinating, each of the 20 Chinese characters are decomposed into their unique subset of radicals from the original radical set of 80. The original set of 80 radicals, chosen to be consistent with the 80 Keno numbers in the game, can be used to construct a large number of Chinese characters very much like the composition of a very large number of English words with the 26 alphabets in the English language.

Thus, associated with each of the 20 Chinese characters which form by row the five celebrated Chinese proverbs, led by the five respective Feng Shui parameters, is a set of numbers representing the radical subset that make up the character itself as shown in FIG. 27. Note that as expected not all 20 characters have the same number of radicals. Some characters have as many as seven and other have as little as 1. When one associates these radical subset numbers forming the 20 Chinese characters with the 80 Keno numbers, a host of new and exciting playing features can be added to the old and rather mundane Keno game!

The New Game Features:

1. The Feng Shui Blessing

Before the player pushes the "Play" button on their old Keno game after selecting the wager and the numbers to bet, the player in the new game chooses one of the five Feng Shui parameters by pushing a respective button. Since one of the Feng Shui parameters will appear randomly after each and every play independent of the 20 regular Keno numbers drawn by the Keno number machine, if the player's selected Feng Shui parameter shows up, then the player will not lose the bet for that particular play but also will win double the amount entitled to the player. What a blessing by simply playing the new Progressive Feng Shui Keno Slots!

2. The Feng Shui Bonus.

In addition to one of the five Feng Shui parameters randomly appearing after each and every play, one of the 20 Chinese characters will also appear flashing (may even be the same Feng Shui parameter appearing earlier). If the player's winning Keno numbers (dependent upon how many numbers are being played) match all of the radical numbers appearing in the flashing Chinese character, then the player will win:

A) Double, triple, quadruple, quintuple and sextuple the amount bet if the flashing Chinese character has one, two, three, four, or five radical numbers, respectively;

B) Ten times the amount bet if the flashing Chinese character has six radical numbers; and C) The Progressive Jackpot whose amount accumulates every time somebody plays that particular Keno Slot until somebody wins.

3. The Easy Feng Shui Play:

The easiest way to play the Feng Shui Keno Slot is to press any of the 20 Chinese character buttons. Since the number of radical numbers of a particular Chinese character is shown beside the character, the player will know the stake and the odds being played. For example, if the player bets the "Luck" character which has seven radical numbers, the player will win the Progressive Jackpot if all 7 numbers are drawn by the Keno machine. However, the player will win nothing otherwise. The same is true if the player bets a two-radical Chinese character. If both numbers are drawn by the Keno machine, the player will win double the amount bet for that play.

D. New Bonus Round Content

Once it is recognized that many of the bonus rounds in current video slot machines are nothing other than some type of limited game, which often offers the possibility of additional winnings based upon the performance of the bonus round, it should be apparent that almost any of the games described herein can also be used as the basis for the content of such a bonus round. This opens up the possibility of mixing combinations of such games, or simply using such games in bonus rounds for traditional reel-type video slot machines. In other words, just based upon the present disclosure, there should be hundreds, if not thousands, of additional video slot machines that can be designed based upon the teachings of this disclosure, which certainly goes a long way to creating an East-West casino that is both exciting and new that appeals to all sorts or gamblers.

1. Feng Shui Elements

It also bears special note that feng shui elements themselves can be used in bonus rounds. Thus, for example, a player might choose one of a number of feng shui elements (preferably five or six as already disclosed herein) as the player's own personal bonus round payout symbol, and then a bonus round with an element of chance could be designed to pay a bonus or jackpot if the player's own bonus round payout symbol is chosen (by whatever method) as the bonus or jackpot symbol.

2. Feng Shui Radicals

Just as feng shui elements can be used in bonus rounds, so too can feng shui radicals. Thus, if a particular feng shui element is chosen, the bonus round can be played to see if the radicals for that feng shui element are selected. Indeed, a progressive feng shui keno type of bonus round could easily be designed based upon the teachings already described above, or such a game could be simplified so that the universe of numbers (associated with different radicals) that can be chosen is much smaller, and the odds adjusted accordingly.

V. Fusing New Games into a Truly Unique East-West Casino Concept

In view of the wealth of information and options provided above, it should be apparent to one of ordinary skill in the art of casino design that new East-West casinos can easily be designed that fuse new games into a totally new casino experience. However, it also bears note that this very wealth itself offers many new options in casino design.

For example, it should go without saying that it makes sense to blend new games into environments where similar games can be found now. Thus, while it is certainly possible for an East-West casino to have a Western poker room with all the traditional games found in such a room now and a separate Eastern poker room with games based upon the Chinese Poker Deck, it probably makes much more sense to blend all of the games together in the same room. Similarly, it also makes sense to have tables that offer Tarracab in Baccarat rooms, to have Lo Shu tables intermixed amongst blackjack tables, and to have Yin Yang Roulette games near traditional Roulette games.

However, to the extent that a casino wants to create an "Asian Pit," which is now a growing trend in Atlantic City, then it also makes sense to play new games with an Asian flavor in such an area; otherwise, an Asian pit is simply a rehash of Western games with some new architectural or design elements, but without any regard to games played in Asia. By contrast, with the teachings set forth herein, an "Asian Pit" can be stocked with slot machines based upon East-West fusion games, card games based upon the Chinese Poker Deck, roulette-type games based upon games Eastern gamblers readily recognize, and even games similar to traditional Eastern games in a new format that still makes them profitable and exciting in a Western casino.

Figure 28:
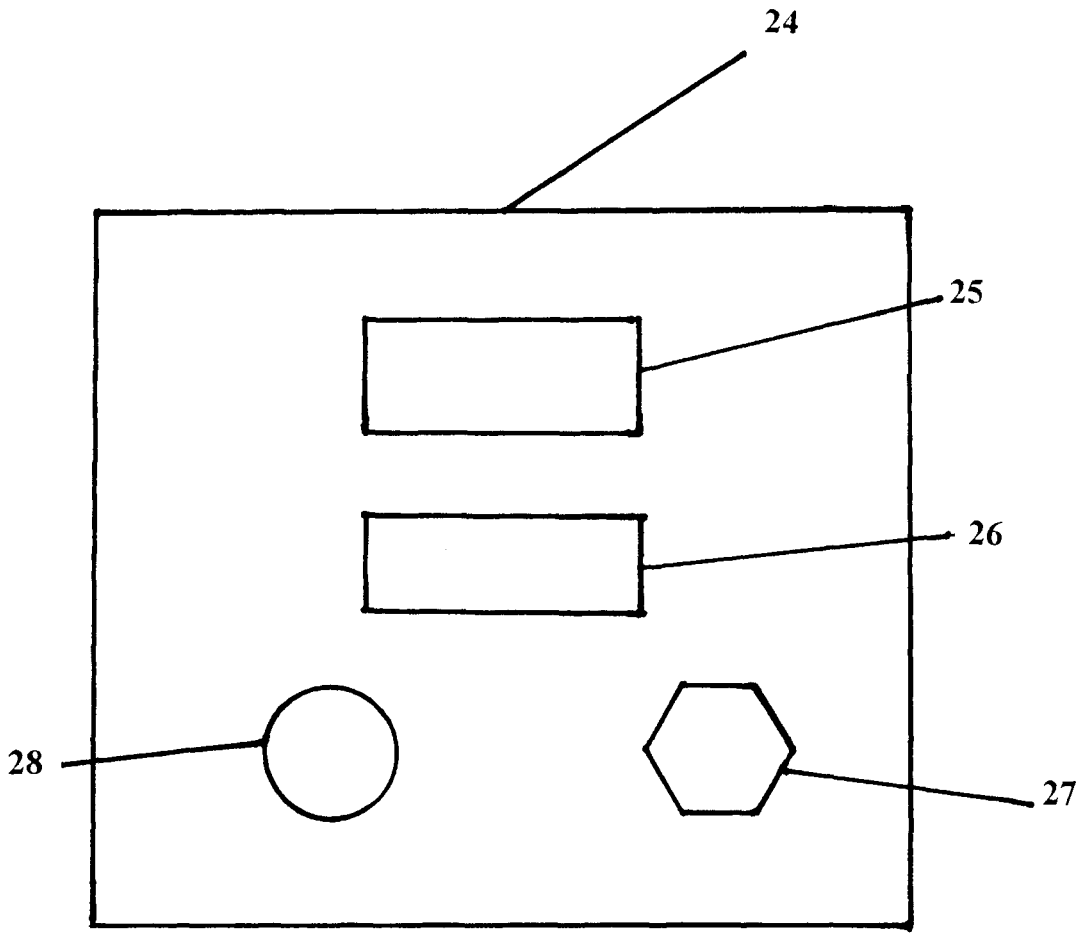
FIG. 28. A gaming environment according to the present invention.
Figure 29:
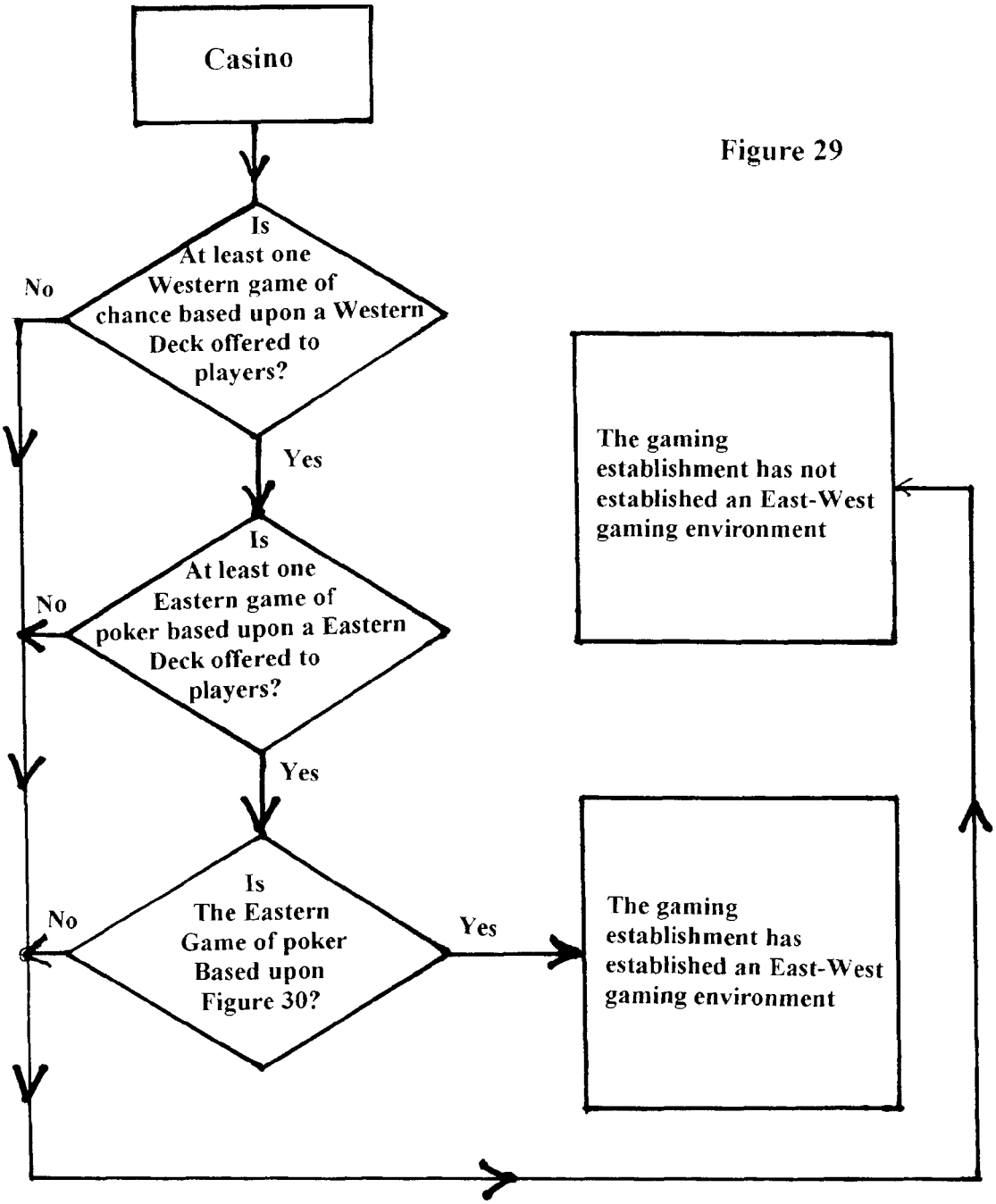
FIG. 29. A flow chart showing a first method according to the present invention.

FIG. 28 illustrates a casino 24 having different gaming areas for creating an East-West gaming environment in which multiple gambling games are offered to players. Gambling area 25 can be an area where players are offered at least one Western game of chance based upon one Western deck of 52 playing cards having four suits comprised of clubs, diamonds, hearts and spades, each suit having one card from each of the designations of 2-10, J, Q, K and A and gambling table 26 is an area where a poker game using the same deck is offered. Gaming area 26 can be an area where players are offered at least one Eastern game of chance such as Tarracab based upon the Chinese Poker Deck and gaming table 27 is an area where a poker game using the Chinese Poker Deck is offered. Casino 24 can be a physical location, such as casinos found in Las Vegas, or a website.

Figure 30:
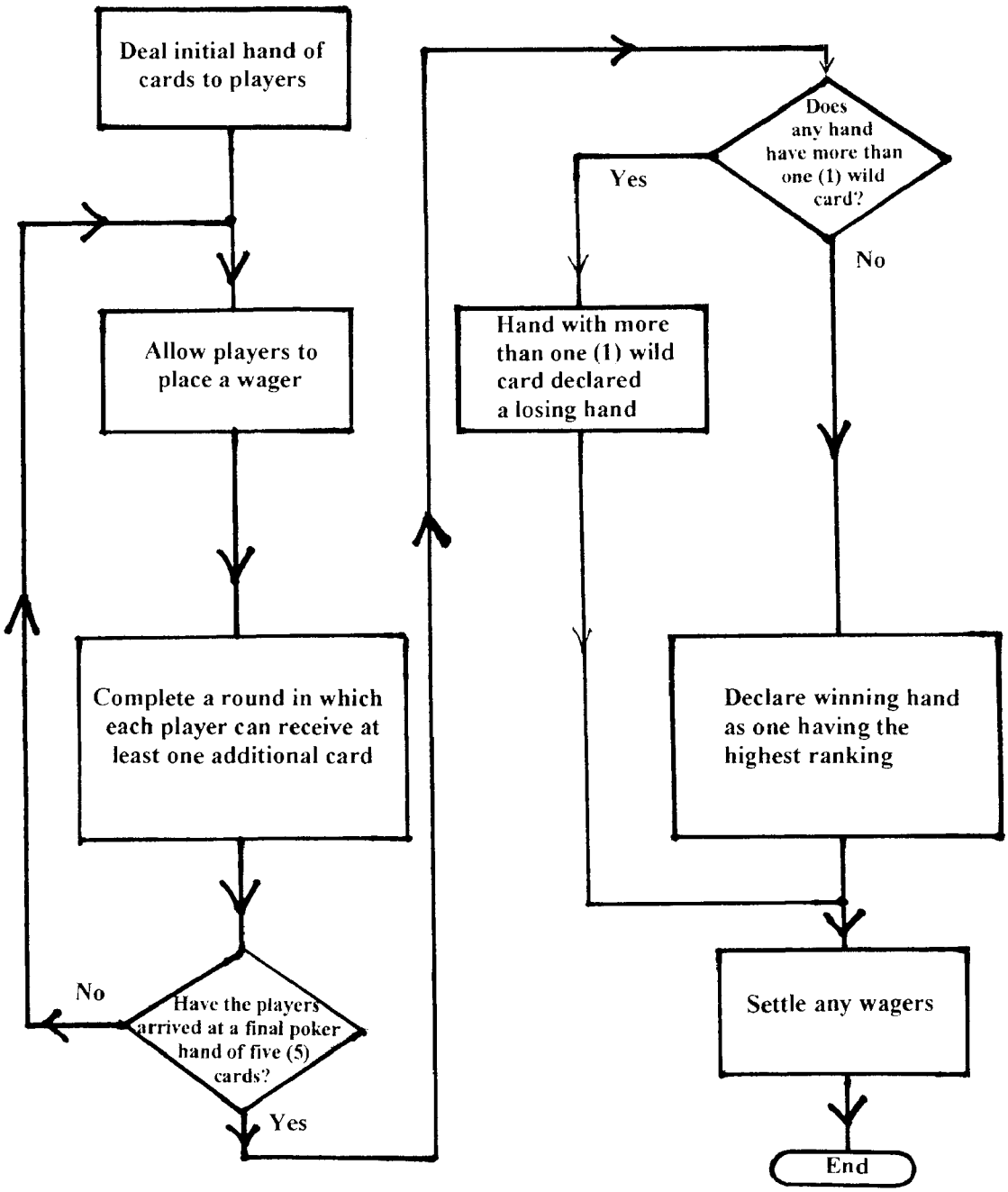
FIG. 30. A flow chart showing a method of playing poker used in conjunction with the present invention and FIG. 29.
Figure 31:
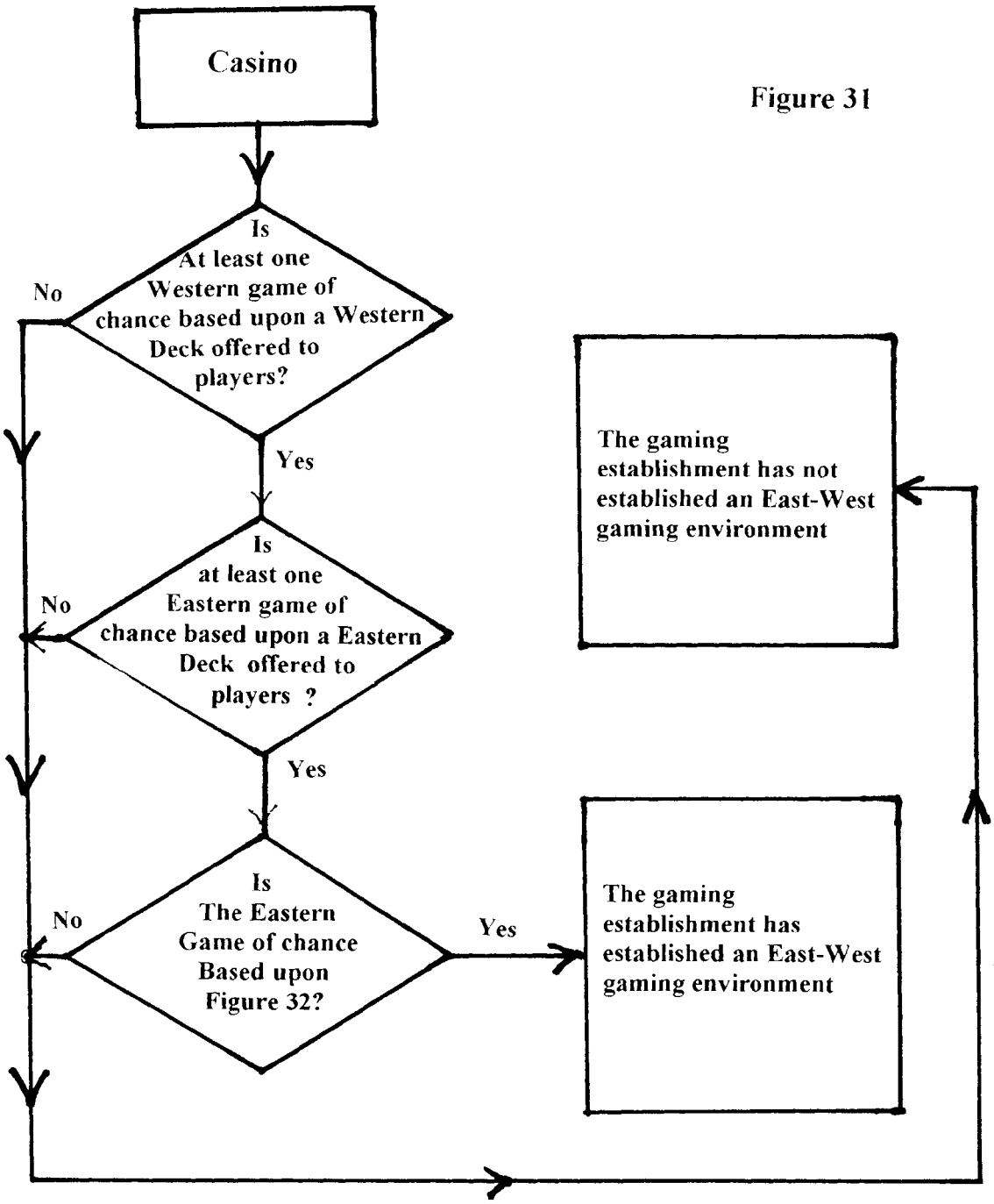
FIG. 31. A flow chart showing a second method according to the present invention.
Figure 32:
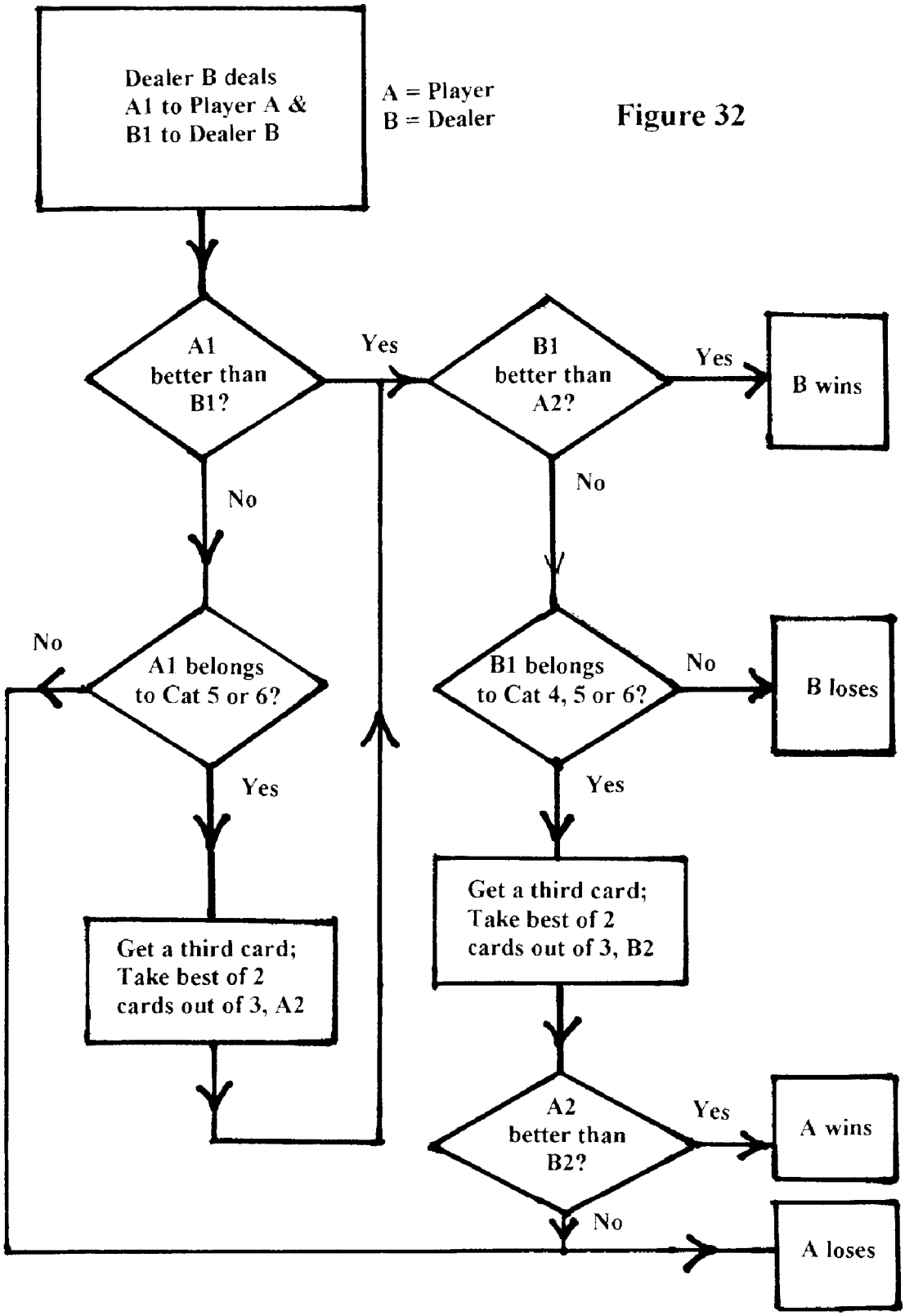
FIG. 32. A flow chart showing a method of playing an Eastern Game of chance used in conjunction with the present invention and FIG. 31.

Accordingly, it can be seen that a gaming environment according the present invention can be conveniently represented as shown in FIG. 28 in which there is a gaming environment or casino 24 that contains offerings of multiple types of games. Thus, offerings of a Western game of chance based upon a Western Deck of cards are depicted as 25 and 26, an offering of an Eastern game of poker based upon an Eastern Deck of cards (and described in the flow chart of FIG. 30) is depicted as 28 and an offering of an Eastern game of chance described in the flow chart of 31 is depicted as 27.

While the invention has been described herein with reference to certain embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. A gaming establishment in which an East-West gaming environment is created by a plurality of gambling games offered to players, comprising:

a casino, a first game involving a Feng Shui element of chance;

a second game based upon a Chinese Poker Deck of cards having three different sets of nine cards in three suits of cards, each of said nine cards in one of said three suits of cards bearing a different designation representing the numbers 1 through 9, five different sets of four cards bearing a unique group designation with a hierarchal ranking of from 1 to 5 such that the hierarchal ranking of 1 is higher than 2 which is higher than 3 which is higher than 4 which is higher than 5 which is higher than a designation representing the number 9, and a set of five additional cards with a Feng Shui designation and a unique Feng Shui hierarchal ranking of from 1 to 5 such that the unique Feng Shui hierarchal ranging of 1 is higher than 2 which is higher than 3 which is higher than 4 which is higher than 5;

wherein players are offered at least one Eastern game of poker based upon use of the Chinese Poker Deck of cards;

wherein the at least one Eastern game of poker is comprised of the following steps:

dealing an initial hand of cards to at least two players from the at least one deck of Eastern playing cards;

granting the at least two players a chance to place a wager or draw at least one additional card;

determining a final poker hand for each of the at least two players;

determining whether any final poker hand has more than one wild card and, if it does, declaring any such hand a losing hand;

declaring a winning hand to be the final poker hand having a highest ranking that is not a losing hand; and settling any wagers.

2. The gaming establishment of claim 1, wherein players are offered a third game comprising at least one Western game of poker based upon use of at least one Western deck of 52 playing cards having four suits comprised of clubs, diamonds, hearts and spades, each suit having one card from each of the designations of 2, 3, 4, 5, 6, 7, 8, 9, 10, Jack, Queen, King and Ace.

3. The gaming establishment of claim 2, wherein the poker game and the Eastern game of poker are each comprised of a draw poker game.

4. The gaming establishment of claim 2, wherein the poker game and the Eastern game of poker are each comprised of a stud poker game.

5. The gaming establishment of claim 2, wherein the poker game and the Eastern game of poker are each comprised of a community card poker game.

6. The gaming establishment of claim 2, wherein the highest ranking for both the poker game and the Eastern game of poker are determined based upon a poker ranking of hands, from highest to lowest, as follows:

a straight flush hand comprised of five suited cards in a single suit in a consecutive sequence;

a four of a kind hand;

a full house hand comprised of a three of a kind and two of a kind;

a flush hand comprised of five suited cards in a single suit in a non-consecutive sequence;

a straight hand comprised of five suited cards in more than a single suit in a consecutive sequence;

a three of a kind hand;

a two pair hand comprised of a pair of two of a kind;

a pair hand comprised of a single pair of two of a kind; and a high card hand comprised of none of the above hands.

7. The gaming establishment of claim 2, wherein each of the five wild cards has a unique fang shui designation, the nine identical number designations of the first group of suited cards are 1, 2, 3, 4, 5, 6, 7, 8, and 9 and the three suits are comprised of a circle designation, a bamboo designation and a script designation and wherein four of the unique designations of the five sets of four identical non-suited cards are an East Wind designation, a South Wind designation, a West Wind designation and a North Wind designation.

8. The gaming establishment of claim 1, wherein the at least one Western game of chance and the at least one Eastern game of poker are offered in a casino.

9. The gaming establishment of claim 1, wherein the at least one Western game of chance and the at least one Eastern game of poker are offered in a website.

10. A gaming establishment with an East-West gaming environment in which a plurality of gambling games are offered to players, comprising:

a casino;

a first game involving a Feng Shui element of chance;

a second game based upon a Chinese Poker Deck of cards having three different sets of nine cards in three suits of cards, each of said nine cards in one of said three suits of cards bearing a different designation representing the numbers 1 through 9, five different sets of four cards bearing a unique group designation with a hierarchal ranking of from 1 to 5 such that the hierarchal ranking of I is higher than 2 which is higher than 3 which is higher than 4 which is higher than 5 which is higher than a designation representing the number 9, and a set of five additional cards with a Feng Shui designation and a unique Feng Shui hierarchal ranking of from 1 to 5 such that the unique Feng Shui hierarchal ranging of 1 is higher than 2 which is higher than 3 which is higher than 4 which is higher than 5;

wherein players are offered at least one Eastern game of chance based upon the Chinese Poker Deck of cards;

wherein the at least one Eastern game of chance is comprised of the following steps:

the player placing a wager based upon the outcome of a winning hand between a player hand and a dealer hand;

a dealer dealing two cards to the player hand and two cards to the dealer hand;

determining if the player hand is better than the dealer hand and, if it is not, declaring the dealer hand the winning hand if the player hand belongs to a class 1 through 4 hand or dealing the player hand a third player hand card and then determining if the player hand is better than the dealer hand and, if it is not declaring the dealer hand the winning hand or if it is declaring the player hand the winning hand if the dealer hand belongs to a class 1 through 3 hand or dealing the dealer hand a third dealer hand card and then declaring the better hand between the player hand and the dealer hand the winning hand; and settling the wager based upon the winning hand;

wherein the class rankings are based upon identifying whether the cards are in a first, a second or a third group of cards which are then used to form the class rankings and, then for determining rankings within the class rankings, using either a first ranking system for cards in the first group of cards or a second ranking system for cards in the second group of cards; and wherein a hand having a card from the third group of cards will have a ranking of class 1, 2 or 3 depending upon the second card in the hand and a pairing of any two identical cards in the second group of cards will also have a class 1 ranking but be inferior to a pair of class 3 cards; and wherein a hand having a card from the third group of cards and the second group of cards will have a class 2 ranking while a hand having a card from the third group of cards and the first group of cards will have a class 3 ranking; and wherein two non-identical cards in the second group of cards will have a class 4 ranking, two cards from the first group of cards will have a class five ranking, and one card from the first group of cards combined with one card from the second group of cards will have a class 6 ranking.

11. The gaming establishment of claim 10, wherein the five cars in the third group of cards have a feng shui designation and the five sets of four identical cards have the designations of a Green Dragon, an East Wind, a South Wind, a West Wind and a North Wind.

12. The gaming establishment of claim 11, wherein the second ranking system for cards in the second group of cards is that a Green Dragon designation is higher than an East Wind designation which is higher than a South Wind designation which is higher than a West Wind designation which is higher than a North Wind designation.

13. The gaming establishment of claim 12, wherein the first ranking system for cards in the first group of cards is that a higher number designation beats a lower number designation.

14. The gaming establishment of claim 10, further comprising a third game of poker.

* * * * *